US006555308B1

(12) United States Patent
Asami et al.

(10) Patent No.: US 6,555,308 B1
(45) Date of Patent: Apr. 29, 2003

(54) SILVER HALIDE PHOTOGRAPHIC EMULSION AND LIGHT-SENSITIVE MATERIAL CONTAINING THE SAME, AND IMAGE-FORMING METHOD USING THEREOF

(75) Inventors: Masahiro Asami, Minami-ashigara (JP); Tadanobu Sato, Minami-ashigara (JP); Tadashi Inaba, Minami-ashigara (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 1 day.

(21) Appl. No.: 09/660,492

(22) Filed: Sep. 12, 2000

(30) Foreign Application Priority Data

Sep. 17, 1999 (JP) ..... 264588/1999

(51) Int. Cl.[7] ..... G03C 1/05
(52) U.S. Cl. ..... 430/567; 430/569
(58) Field of Search ..... 430/567, 569

(56) References Cited

U.S. PATENT DOCUMENTS 4,933,272 A * 6/1990 McDugle et al. ..... 430/567
4,937,180 A * 6/1990 Marchetti et al. ..... 430/567
4,945,035 A * 7/1990 Keevert, Jr. et al. ..... 430/567
5,360,712 A 11/1994 Olm et al.
5,457,021 A * 10/1995 Olm et al. ..... 430/567
5,462,849 A * 10/1995 Kuramoto et al. ..... 430/567
5,945,264 A * 8/1999 Asami et al. ..... 430/351
5,989,800 A * 11/1999 Hosoya et al. ..... 430/589
6,228,556 B1 * 5/2001 Asami et al. ..... 430/203
6,280,920 B1 * 8/2001 Maruyama et al. ..... 430/567

FOREIGN PATENT DOCUMENTS

JP 2001-0920565 * 4/2001

* cited by examiner

*Primary Examiner*—Janet Baxter
*Assistant Examiner*—Amanda C. Walke
(74) *Attorney, Agent, or Firm*—Burns, Doane, Swecker & Mathis, LLP

(57) ABSTRACT

Disclosed is a silver halide photographic emulsion which comprises silver halide particles containing a polynuclear metal complex in which an organic compound is contained as a bridging ligand, wherein 50% or more of a projected area of the particles is occupied by tabular particles having a particle thickness of 0.3 $\mu$m or less. This photographic emulsion is high in sensitivity, as well as give high contrast and good graininess. Also disclosed are a light-sensitive material for photographing of high image quality, which contains the photographic emulsion, and a simple method for forming a color image wherein the light-sensitive material is used.

18 Claims, No Drawings

SILVER HALIDE PHOTOGRAPHIC EMULSION AND LIGHT-SENSITIVE MATERIAL CONTAINING THE SAME, AND IMAGE-FORMING METHOD USING THEREOF

FIELD OF THE INVENTION

The present invention relates to a silver halide emulsion having such characteristic as high sensitivity and high contrast, which are suitable for use for shooting. The present invention also relates to a silver halide color photographic light-sensitive material using the emulsion. Further, the present invention relates to an easy to practice and rapid method for forming a color image by using the light-sensitive material.

BACKGROUND OF THE INVENTION

Owing to recent remarkable development of photographic light-sensitive materials utilizing silver halides—silver halide photography system, high-quality color images are now easily available. In recent years, the process of color photography ordinarily utilized has made remarkable progress, and large-scale, centralized color laboratories, in which a large quantity of color prints are produced high-efficiently, and the so-called mini labs, which are installed in shops and are designed to use compact and simple printer-processors, have spread widely. Therefore, anyone can enjoy color photography easily.

In addition, recently, a new-concept APS system, which uses a color negative film capable of recording various information as magnetic records by utilizing a support coated with a magnetic material, has been introduced into the market. This system proposes simplicity in handling films and photographic pleasure, such as capability to change the print size by recording information at the time photographs are taken. In addition, this system proposes a tool for compiling or processing images by reading out image information from a processed negative film by means of a simple scanner. Such methods enable high-quality image information of silver salt photographs to be digitized easily, and they are making the use of the image information commonplace beyond the traditional scope of enjoyment as photographs.

On the other hand, so-called digital still cameras utilizing a CCD as an imaging element are making rapid progress. Cameras for amateurs which are mounted with a CCD element having millions or more of pixels have been put on the market for the past several years to obtain image qualities close to those of photographs. These digital still cameras save a step of developing the film taken, in contrast to usual color photographic systems, and they can produce directly digitized image information. Therefore, it can be made easy to confirm the image directly on a liquid crystal monitor when taking a photograph and to make use of the resulting digital information variously. The image information can be transferred to a printer to make a print readily, it can be variously processed using a personal computer, and it makes image transfer through an internet easy. Along with recent progresses in high density CCDs and in the abilities of equipment treating massive digital data, high quality images worth being appreciated as a photograph have come to be available. Discussion has been made on the possibilities of these digital still cameras being substituted for general photographing means.

In this situation, it is desired to further investigate the high sensitivity and high latitude possessed by silver halide light-sensitive materials with the view of further developing a silver salt photographic system in opposition to a digital still camera system. Although the performance of CCDs used as imaging elements of a digital still camera have been improved remarkably, there is a limitation on the provision of high sensitivity while increasing pixels in elements having a limited size. Also, it is basically difficult to impart high latitude under the restrictions imposed on an inexpensive and simple camera system. Hence, if silver halide light-sensitive materials with higher sensitivity and latitude are attained and mounted on inexpensive and readily handlable products, e.g., films with a lens, a system attractive to customers will be provided.

High sensitization of the silver halide light-sensitive material can be generally attained by increasing the grain size of silver halide grains used as photocells (photosensors). However, this poses the problem of impaired granularity (graininess) as the grain size increases. As measures to increase the sensitivity without impairing the granularity, the use of an emulsion comprising tabular grains with a grain thickness smaller for the projected diameter of a grain (the diameter of a circle equivalent to the projected area of a grain) is disclosed in, for instance, the specifications of U.S. Pat. Nos. 4,434,226 and 4,439,520. In the descriptions of photographic emulsion grains, the value calculated by dividing the projected diameter of a grain by the thickness of the grain, which value is called as an aspect ratio, is used. These specifications describe the fact that grains with a high aspect ratio exhibit better sensitivity/graininess ratio than those having low aspect ratios. In the case of comparing grains having the same grain projected diameter, it is considered that by increasing the aspect ratio, the number of grains can be increased, whereby the granularity can be improved even if the amount of silver to be applied is the same.

However, it has been clarified that if the aspect ratio of grains is increased and the thickness of the grain is designed to be thin, it is hard to obtain high sensitivity and a deterioration of the contrast is further caused by a reduction in the maximum color density.

Such a phenomenon, although the way of its appearance differs depending upon the composition and size of emulsion grains, generally starts to appear as a problem when the thickness of a grain is 0.2 $\mu$m or less and becomes significant when the thickness of a grain is 0.15 $\mu$m or less. Various techniques have been reported as attempts to solve this problem. Examples of these techniques may include a technique in which an epitaxial microcrystalline portion having a different halogen composition is formed on the external surface of a grain, especially at the top thereof or such a portion is doped with a 6-cyano iron group complex, as disclosed in the specifications of U.S. Pat. Nos. 5,536,632 and 5,576,168. However, it has been confirmed that the use of these techniques is insufficient although an improvement in the sensitivity is observed and a reduction in the contrast is not improved occasionally.

In the meanwhile, it is an urgent problem to make it possible to carry out the developing step, which is a weak point of the silver halide light-sensitive material, more easily and rapidly. The strength of the digital still camera lies, after all, in the point that liquid development processing is not required. On the contrary, the development processing of the silver halide light-sensitive material needs private treating equipment and careful control and is hence utilized only in limited bases at present. This reason is as follows. The first reason for this is that expertise and skilled operation are necessary due to the requirement of strict control of the composition and the temperature of the solutions in processing baths for the above-mentioned procedure of color development, bleaching and fixation. The second reason is that equipment to be used exclusively for the developing process is often required, due to substances, contained in the processing solutions, such as color-developing agents and bleaching agents comprising an iron chelate compound and others the discharge of which is regulated from the standpoint of environmental protection. The third reason is that the currently available systems do not satisfactorily fulfill the requirement for rapid reproduction of recorded images, because the above-mentioned development processes still take time, although this time has been shortened with recent advances in technology.

In view of these aspects, many improved technologies have been proposed. For example, IS & T's 48th Annual Conference Proceedings, pp.180, disclose a system in which the dye formed in the developing reaction is transferred to a mordant layer and thereafter a light-sensitive material is stripped off, to remove the developed silver and unreacted silver halide without the use of a bleach-fixing bath which has been indispensable to conventional color photographic processing. However, this technology cannot perfectly solve environmental problems because a developing process using a processing bath containing a color developing agent is still necessary.

As a system requiring no developer containing a color-developing agent, PICTROGRAPY SYSTEM is provided from Fuji Photo Film Co., Ltd. This system is environmentally advantageous in the point of not using the above-mentioned processing bath. However, this system is not suited as such for processing light-sensitive materials for photographing (shooting) of ultra-high sensitivity as in the present invention, since this system is intended for obtaining a printed image by forming a diffusive dye due to development reaction and transferring the dye to an image-receiving material. A technology for making light-sensitive materials for photographing developable by simple and rapid processing as in the above-mentioned PICTROGRAPHY SYSTEM is disclosed in JP-A-9-204031 ("JP-A" means unexamined published Japanese patent application) or JP-A-9-274295. However, the following problems arise in thermal development processing disclosed in these publications, wherein the light-sensitive material containing a developing agent is stuck together with a processing material containing a base precursor, in the presence of a small amount of water, and then, they are heated at a temperature of 60° C. or more. More precisely, a problem in the use of tabular particles (grains) of a high aspect ratio as described above, especially a problem of lowering in contrast becomes apparent.

SUMMARY OF THE INVENTION

As is apparent from the fact mentioned above, an object of the present invention is to provide a silver halide photographic emulsion which gives high contrast and better granularity, while it has high sensitivity. Another object of the present invention is to provide a light-sensitive material for photographing of high image quality, using the silver halide photographic emulsion. Still another object of the present invention is to provide a simple method for forming a color image by using the light-sensitive material.

Other and further objects, features, and advantages of the invention will appear more fully from the following description.

DETAILED DESCRIPTION OF THE INVENTION

The above objects of the present invention have been achieved effectively according to the following items (1) to (14).

(1) A silver halide photographic emulsion, which comprises silver halide particles containing a polynuclear metal complex in which an organic compound is contained as a bridging ligand, wherein 50% or more of a projected area of the particles is occupied by tabular particles having a particle thickness of 0.3 $\mu$m or less.

(2) The silver halide photographic emulsion according to the above (1), wherein 50% or more of the projected area is occupied by tabular particles having a particle thickness of 0.2 $\mu$m or less.

(3) The silver halide photographic emulsion according to the above (1), wherein the polynuclear metal complex in which an organic compound is contained as a bridging ligand is a compound represented by the following formula A:

$$[L'_nM(L(ML'_m)_j)_k]^l \qquad \text{Formula A}$$

wherein M represents an arbitrary metal or metal ion, and all of Ms may be the same metal species or Ms may be the different metal species; L is a bridging ligand and represents an organic compound capable of bridging two or more metals or metal ions; L' represents an inorganic compound of no electric charge having atoms of 8 or less, an arbitrary organic compound, or an arbitrary inorganic anion, and all of L's may be the same chemical species or L's may be the different chemical species, with the proviso that when some of the L's are arbitrary inorganic anions, the inorganic anions occupy not more than half of coordinate sites out of the coordinate sites of one metal; n represents an integer of 1 to 5, m represents an integer of 0 to 5, j represents an integer of 1 to 4,k represents an integer of 1 or more, and l represents an electric charge of the whole complex.

(4) The silver halide photographic emulsion according to the above (3), wherein, in the polynuclear metal complex, L' in the formula A is a heterocyclic compound or a compound selected from $H_2O$, $NH_3$ or $PH_3$.

(5) The silver halide photographic emulsion according to the above (4), which contains the polynuclear metal complex, in which the bridging ligand L in the formula A is a saturated or unsaturated hydrocarbon having a cyano group, or a heterocyclic compound, or a compound represented by the following formula B or C:

Formula B

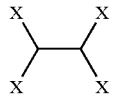

wherein X may be the same or different and represents an oxygen atom, a sulfur atom, a hydroxyl group, a cyano group, an amino group or a nitro group; each bond in the formula may be a single bond or a double bond so far as the octet rule is not disturbed; and a bond between the carbon atoms to which two coordinating substituents are respectively bonded may be replaced with a benzene ring;

Y–R Formula C wherein Y represents an oxygen atom, or a sulfur atom, and R represents an alkyl group or an aromatic group.

(6) The silver halide photographic emulsion according to the above (5), which contains the polynuclear metal complex (a binuclear or trinuclear metal complex), in which L in the formula A represents an organic compound bridging two or three metals or metal ions, and j and k each are 1 or 2.

(7) The silver halide photographic emulsion according to the above (6), which contains the binuclear or trinuclear metal complex, in which L' in the formula A is a compound selected from a nitrogen-containing heterocyclic compound, an oxygen-containing heterocyclic compound, a sulfur-containing heterocyclic compound, or $NH_3$.

(8) The silver halide photographic emulsion according to any one of the above (1), (2), (3), (4), (5), (6) and (7), wherein the polynuclear metal complex to be contained is a complex having magnesium, calcium, strontium, barium, iron, cobalt, nickel, ruthenium, rhodium, palladium, osmium, iridium, platinum, zinc, cadmium or mercury, as a central metal thereof.

(9) The silver halide photographic emulsion according to the above (8), which contain the binuclear or trinuclear metal complex, in which L' in the formula A is 2,2'-bipyridine, 1,10-phenanthroline, 1,4,8,11-tetraazacyclotetradecane, or a derivative thereof.

(10) The silver halide photographic emulsion according to the above (8), wherein the silver halide particles contained in the emulsion contain the binuclear or trinuclear metal complex represented by the following formula D, E or F:

$$[(NH_3)_5MLM(NH_3)_5]^n \qquad \text{Formula D}$$

wherein M represents an ion of a metal selected from iron, ruthenium and cobalt, with the proviso that two Ms may be the same metal ion or different; L represents a bridging ligand of a compound selected from dicyano compounds, cyanopyridines, pyrazines and 4,4'-bipyridines, and n represents 4, 5 or 6;

$$[(bpy)_2X_mMLMX_m(bpy)_2]^l \qquad \text{Formula E}$$

$$[(cyc)X_mMLMX_m(cyc)]^l \qquad \text{Formula F}$$

wherein, in formulas E and F, M represents an ion of a metal selected from iron, ruthenium, cobalt, manganese, rhodium and iridium, with the proviso that two Ms may be the same metal ion or different; L represents a bridging ligand that is one selected from pyrazines, 4,4'-bipyridines, 2,2'-bipyrimidines, 2,2'-biimidazoles, 2,2'-bibenzimidazoles and 2,5-bis(2-pyridyl)pyrazines, bpy represents 2,2'-bipyridine, cyc represents 1,4,8,11-tetraazacyclotetradecane, X represents $Cl^-$, $H_2O$, $CH_3OH$, $C_2H_5OH$ or $CH_3CN$; m is 1 when L is coordinated unidentately to one of the metal ions, or m is zero (0) when L is coordinated bidentately; and 1 represents 4, 5 or 6.

(11) A silver halide photographic light-sensitive material, which has, on a support, the silver halide emulsion according to any one of the above (1), (2), (3), (4), (5), (6), (7), (8), (9) and (10).

(12) A silver halide color photographic light-sensitive material, which comprises at least, on a support, a silver halide emulsion, a developing agent, and a compound capable of forming a dye by coupling reaction with an oxidized product of the developing agent, wherein 50% or more of a projected area of silver halide particles contained in at least one of the silver halide emulsions is occupied by tabular particles having a particle thickness of 0.3 $\mu$m or less, and wherein the silver halide particles contained in the emulsion contain a polynuclear metal complex in which an organic compound is contained as a bridging ligand.

(13) The silver halide color photographic light-sensitive material according to the above (12), which comprises a compound represented by the following formula (I), (II), (III) or (IV), as the developing agent:

formula (I)

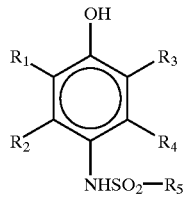

formula (II)

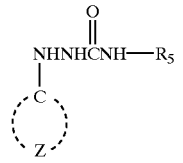

formula (III)

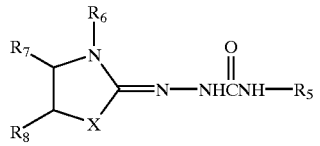

formula (IV)

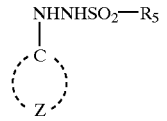

wherein $R_1$, $R_2$, $R_3$, and $R_4$each represent a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms to form a aromatic ring (including a hetroaromatic ring) together with the C, if Z is a group of atoms necessary to form, together with the C, a benzene ring, the sum of Hammett's constant ($\sigma$) of its substituent(s) is 1 or more; $R_6$ represents an alkyl group; X represents an oxygen atom, a sulfur atom, a selenium atom, or an alkyl- or aryl-substituted tertiary nitrogen atom; $R_7$ and $R_8$ each represent a hydrogen atom or a substituent, or $R_7$ and $R_8$ may bond together to form a double bond or a ring; further, at least one ballasting group having 8 or more carbon atoms is contained in each of formulae (I) to (IV), in order to make the molecule soluble in an oil.

(14) A method for forming a color image, comprising:

subjecting the light-sensitive material according to the above (11), (12), or (13) to exposure image-wise, attaching the light-sensitive material to a processing material face to face each other, in the state that water, equivalent to one-tenth to one-fold as much as that required for maximally swelling all the coated films of the light-sensitive material and the processing material, is maintained between the light-sensitive material and the processing material, and heating the processing material and the light-sensitive material at a temperature of 60° C. or higher but 100°

C. or lower for a time period of 5 seconds or more but 60 seconds or less, thereby forming an image in the light-sensitive material, wherein the processing material has a composition layer including a processing layer containing a base and/or a base precursor, applied on a support.

The polynuclear metal complex that contains an organic compound as a bridging ligand, which is contained in the silver halide emulsion of the present invention, is explained in detail.

By the term "a polynuclear metal complex" is meant a complex compound wherein at least two central metal atoms exist which are bonded by a bridging ligand or ligands. In the present invention, the silver halide particles are doped with the polynuclear metal complex.

In case the molecule of the complex is entered in silver halide particles, a part of the units $[AgX_6]^{5-}$ (X=a halogen ion) in the silver halide particles is replaced with the molecule of the complex, whereby a lattice position of $Ag^+$ ion will be occupied by the central metal atom, while a lattice position of the halide ion will be occupied by each ligand, as disclosed in various literatures and patent publications including J. Phys.: Condens. Matter 9 (1997), 3227~3240. If this matter of thinking is spread, it is expected that silver halide units such as $[Ag_2X_{11}]^{9-}$, $[Ag_3X_{16}]^{13-}$, . . . are replaced with binuclear or more complex compounds. From the consideration on molecular model, it is assumed that a $[X_5Ag\text{-}X\text{-}Ag\text{-}X\text{-}AgX_5]^{9-}$ unit in the silver halide particles will be replaced with a binuclear complex compound of iron represented by $[(NC)_5Fe(\mu\text{-}4,4'\text{-bipyridine})Fe(CN)_5]^{6-}$ as disclosed in U.S. Pat. No. 5,360,712. Thus, it is expected that in case complex compound molecules are entered in the silver halide particles, replacement with flexibility to a certain degree will take place. In case too large complex compound molecules are used as dopant, however, it is not considered to be advantageous for replacement, thus leading the assumption to be undesirable. Consequently, it is considered that among the polynuclear metal complex compounds, preferable ones for doping are binuclear or trinuclear metal complex compounds.

By the term "an organic compound" in the present invention is meant herein a group of compounds comprising linear or cyclic hydrocarbons as their mother structure or compounds in which carbon atoms or hydrogen atoms as a part of the mother structure thereof are substituted by other atoms or atomic groups. Ligands bridging metal-metal are preferably organic compounds, especially compounds coordinated with a metal bidentately or compounds capable of accepting (or capable of forming contraproviding bonds) a d electron from the metal in a π orbit in which an N-atom forming a double bond or triple bond, or an N-atom, a P-atom, an S-atom, or the like in an aromatic ring, is contained as a coordinating atom. Namely, those compounds strongly bonded to a metal ion are preferable as the bridging ligand, and those compounds capable of imparting a strong ligand field effect in such case are more preferable.

Other ligands are preferably organic compounds similar to the bridging ligands, and especially, compounds capable of coordinating to metal bidentately or compounds capable of forming contraproviding bonds to metal are preferable. It is also preferable that these ligands have a negative electric charge. Assuming that the complex compounds are entered in the silver halide particles, the halogen ions inherently possessing a negative electric charge will be replaced with the organic compounds as ligand so that the organic compounds may preferably approach in electric charge to a replaceable unit of the silver halide. Considering capture of electrons in a broader range as described above, however, it may be preferable on the contrary to use a ligand of no electric charge. In order to obtain a shallow adequate electron trap due to a dopant, it may be better that distribution of electric charge is poor in molecules utilizable for dopant lest localization of electrons should take place in the electron trap. In case a separate donor site due to a hetero atom or a substituent exists in ligands in addition to a donor site to a central metal, it may be a high possibility of polarization in the ligands, thus considering possibility of impertinence for capturing electrons with uniformly mild binding force. Even in case the molecule size of the ligand becomes larger to such an extent that replacement of the moiety of the ligand affects not only the position of the halogen ion but also the adjacent silver ion, it is considered more preferably that the ligand of a dopant is a compound of no electric charge. Irrespective of whether an organic compound possessing a negative electric charge is used for ligand or whether an organic compound possessing no electric charge is used for ligand, the use of the above organic compounds commonly and largely contributes increase in sensibility up to the present so that it cannot be said whichever is more preferable. Nevertheless, an organic compound, especially a complex compound having an aromatic compound or a heterocyclic compound as ligand, above all a compound coordinating bidentately or terdentately to metal ion is more preferable as a dopant for sensitivity enhancement from the viewpoint of the ligand field effect.

In the present invention, preferable examples of the bridging ligand, more specifically one having a saturated or unsaturated hydrocarbon as a fundamental skeleton thereof include oxalic acid, malonic acid, succinic acid, glutaric acid, adipic acid, tartaric acid, meso-2,3-dimethylmercaptosuccinic acid, 1,2,3,4-cyclobutanetetracarboxylic acid, oxamide, oxamic acid, malonamide, succinamide, adipamide, dithioxamide, 1,1,3,3-propanetetracarbonitrile, tetracyanoethylene, diaminomaleonitrile, 1,2,4,5-benzenetetramine, and 1,2,4,5-benzenetetacarboxylic acid. Above all, smaller molecules such as oxalic acid, malonic acid, oxamide, oxamic acid, etc. are preferable. It is also preferable that $H^+$ of OH group in an alcohol or a phenol is liberated and the —O— moiety is bridged to two metals or metal ions. On the other hand, illustrative of the heterocyclic compound utilizable as the bridging ligand include preferably pyrazole, imidazole, triazole, tetrazole, oxazole, isoxazole, thiazole, thiadiazole, thiatriazole, tetrathiafruvaren, 4,4'-bipyridine, 4-hydroxypyridine, isonicotic acid, 4-cyanopyridine, pyridazine, pyrimidine, pyrazine, 2,3-bis(2-pyridyl)pyrazine, 2,5-bis(2-pyridyl)pyrazine, triazine, 2,2'-bipyrimidine, 2,2'-imidazole, 2,2'-benzimidazole, and derivatives thereof having these compounds as their skeleton. Among these, pyrazole, 4,4'-bipyridine, pyrazine, 2,3-bis(2-pyridyl)pyrazine, 2,5-bis(2-pyridyl)pyrazine, 2,2'-bipyrimidine, 2,2'-imidazole, and 2,2'-benzimidazole are especially preferable. Considering the magnitude of the field effect of ligand as described above, aromatic compounds and heterocyclic compounds are preferable as other ligands. Preferable as the aromatic compounds are those compounds having substituents which form coordinating sites respectively to the two adjacent carbon atoms on the ring. Illustrative of such compounds are, for example, veratrol, catechol, (+/−)-hydrobenzoin, 1,2-benzenedithiol, 2-aminophenol, o-anisidine, 1,2-phenylenediamine, 2-nitronaphthol, 2-nitroaniline, and 1,2-dinitrobenzene. An aromatic compound, which is different from a compound having the adjacent two carbon atoms to which substituents forming coordinating sites have been bonded, wherein two substituents forming coordinating sites are within a distance capable of coordinating to one metal is also preferable, and benzil, 1,8-dinitronaphthalene, 1,8-naphthalenediol, etc. are mentioned as exemplified compounds. A heterocyclic compound coordinating in unidentate preferably has an oxygen atom, a sulfur atom, a selenium atom, a tellurium atom or nitrogen atom as a hetero atom in ligand, and also preferably has a phosphorus atom. Preferable as a unidentate ligand are specifically furane, thiophene, 2H -pyrol, pyrane, pyridine, and derivatives thereof. A heterocyclic compound coordinating bidentately or terdentately to a metal or a metal ion is preferably a ring-assembled heterocyclic compound to which heterocyclic compounds coordinated unidentately as mentioned above are connected together. As a concrete compound, preferable is a compound to which the above preferable unidentate ligands are connected together. Especially, in case of a bidentate ligand, 2,2'-bithiophene, 2,2'-bipyridine and their derivatives are preferable, while in case of terdentate ligand, 2,2':5'2"-terthiophene, 2,2':5'2"-terpyridine and their derivatives are preferable. 2,2'-Biquinoline, 1,10-phenanthroline and derivatives thereof accompanying a condensed ring are preferable for the skeleton of these bidentate ligands. Further, as ligands other than the bridging ligands, those coordinating in coordinating sites beyond three positions to metal ion are also preferable, and 1,4,8,11-tetraazacyclotetradecane and crown ethers such as 18-crown-6 are preferable. Illustrative of the substituent in these derivatives are preferably, for example, a hydrogen atom, a substituted or unsubstituted alkyl group (for example, methyl, ethyl, n-propyl, isopropyl, n-butyl, t-butyl, hexyl, octyl, 2-ethylhexyl, dodecyl, hexadecyl, t-octyl, isodecyl, isostearyl, dodecyloxypropyl, trifluoromethyl or methanesulfonylaminomethyl), an alkenyl group, an alkynyl group, an aralkyl group, a cycloalkyl group (for example, cyclohexyl or 4-t-butylcyclohexyl), a substituted or unsubstituted aryl group (for example, phenyl, p-tolyl, p-anisyl, p-chlorophenyl, 4-t-butylphenyl or 2,4-di-t-aminophenyl), a halogen atom (for example, fluorine, chlorine, bromine or iodine), a cyano group, a nitro group, a mercapto group, a hydroxyl group, an alkoxy group (for example, methoxy, butoxy, methoxyethoxy, dodecyloxy or 2-ethylhexyloxy), an aryloxy group (for example, phenoxy, p-tolyloxy, p-chlorophenoxy or 4-tert-butylphenoxy), an alkylthio group, an arylthio group, an acyloxy group, a sulfonyloxy group, a substituted or unsubstituted amino group (for example, amino, methylamino, dimethylamino, anilino or N-methylanilino), an ammonio group, a carbonamido group, a sulfonamido group, an oxycarbonylamino group, an oxysulfonylamino group, a substituted ureido group (for example, 3-methylureido group, 3-phenylureido group, 3,3-dibutylureido group, or thioureido group), an acyl group (for example, formyl group, acetyl group), an oxycarbonyl group, a substituted or unsubstituted carbamoyl group (for example, ethylcarbamoyl, dibutylcarbamoyl, dodecyloxypropylcarbamoyl, 3-(2,4-di-t-aminophenoxy) propylcarbamoyl, pyridinocarbonyl or morpholinocarbonyl), a thiocarbonyl group, a thiocarbamoyl group, a sulfonyl group, a sulfinyl group, an oxysulfonyl group, a sulfamoyl group, a sulfino group, a sulfano group, a carboxylic acid group or a salt thereof, a sulfonic acid group or a salt thereof, or a phosphonic acid or a salt thereof. Further, $R_2$ and $R_3$ may preferably be combined together to ring-close to form a saturated carbocycle, an aromatic carbocycle or a heteroaromatic ring.

No particular limitation exists in the central metal in the present invention. In case an octahedric complex compound having 6 coordination is entered as a dopant in silver halide particles whereby a part of the particles is replaced by the dopant, deeming $[AgX_6]^{5-}$ (wherein X represents a halogen ion) in the silver halide particles as one unit, it is preferable, as disclosed in a lot of publications and patents including J. Phys.: Condens. Matter 9 (1997) 3227~3240,that the coordinate structure around the metal shows a planer 4 coordination structure or 6 coordination structure. More preferably, a metal or metal ion has unpaired electrons, or alternatively, a metal in which stabilized orbits are wholly filled with electrons when a ligand field splitting takes place in the d orbit thereof. More specifically, can be mentioned preferably each metal ion of an alkali earth metal, iron, ruthenium, manganese, cobalt, rhodium, iridium, copper, nickel, palladium, platinum, gold, zinc, titanium, chromium, osmium, cadmium, and mercury. Among these, a metal ion of iron, ruthenium, manganese, cobalt, rhodium, iridium, titanium, chromium, and osmium is especially preferable. Most preferable is each ion of iron, ruthenium, and cobalt.

Specific examples of the complex compound used in the present invention will now be exemplified but the compounds of the present invention are not limited to these exemplifications.

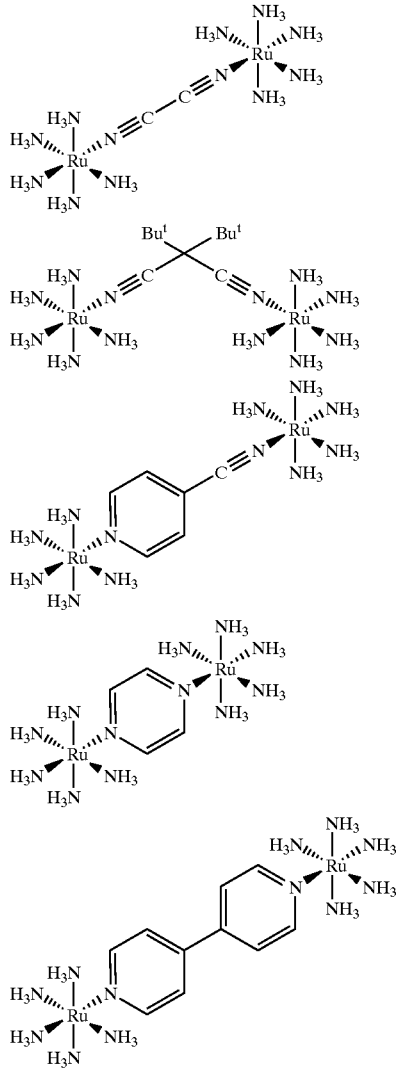

-continued
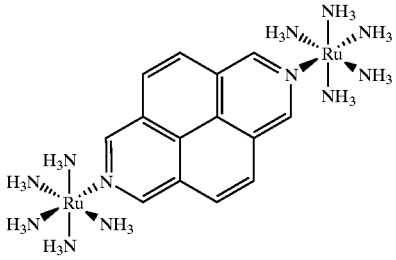
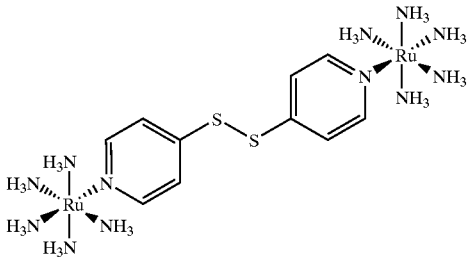
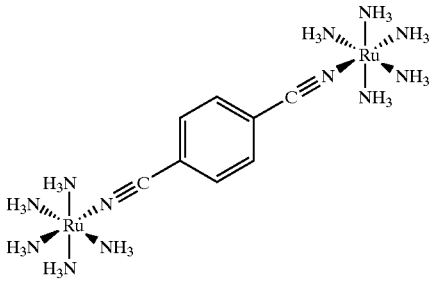
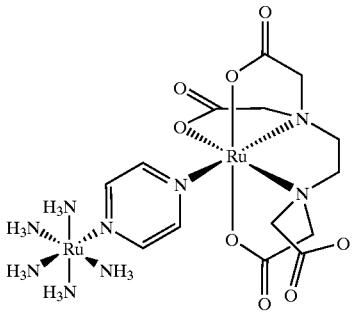
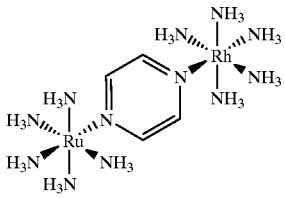
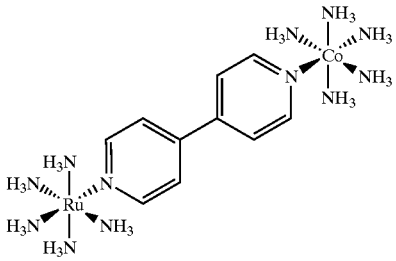
-continued
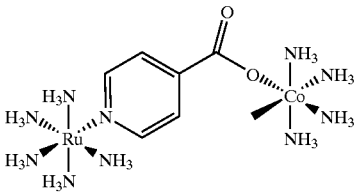
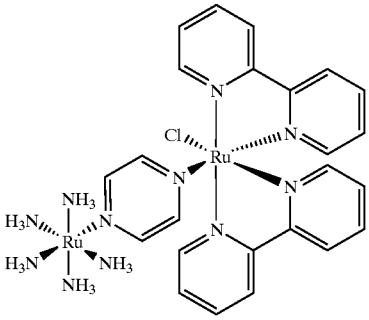
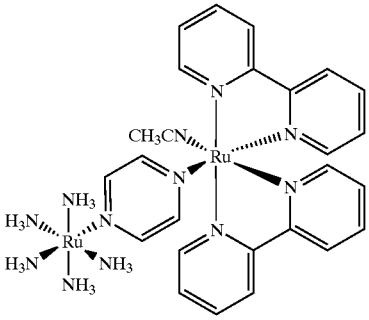
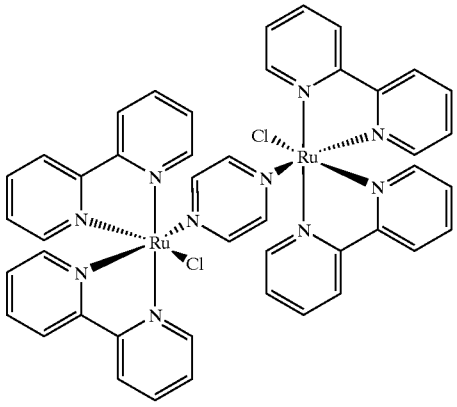
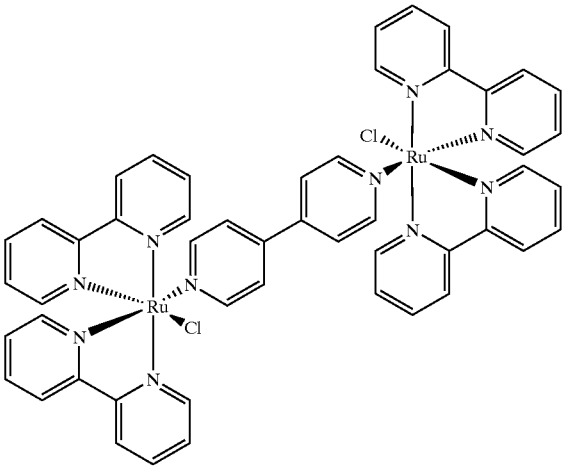

-continued
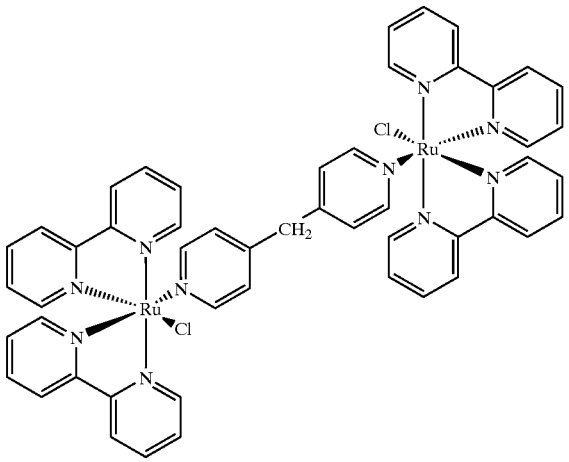
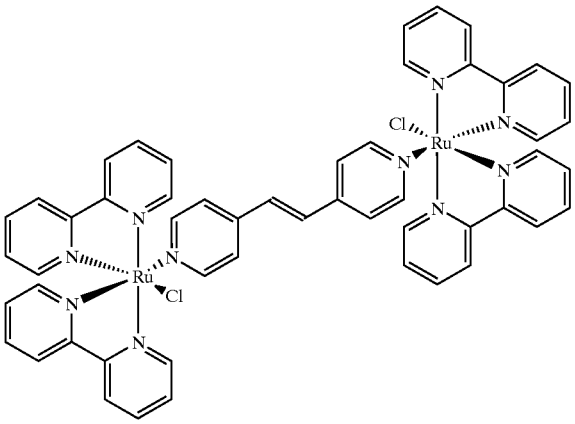
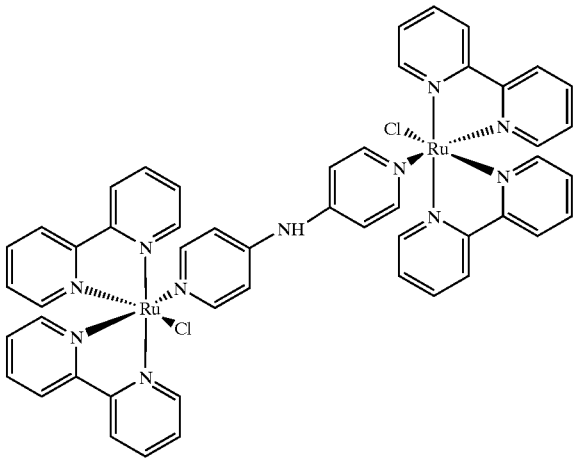
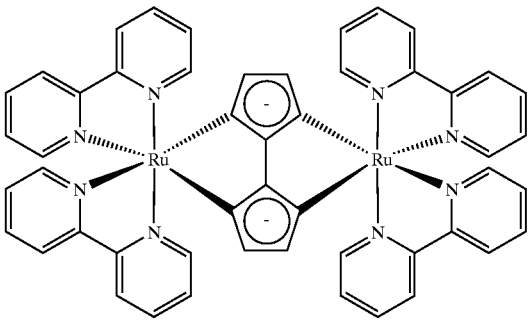
-continued
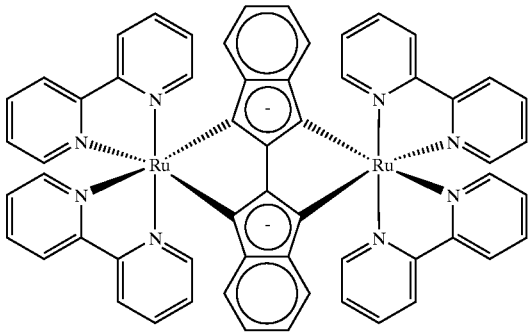
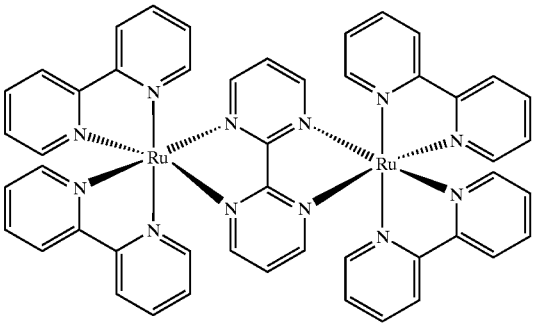
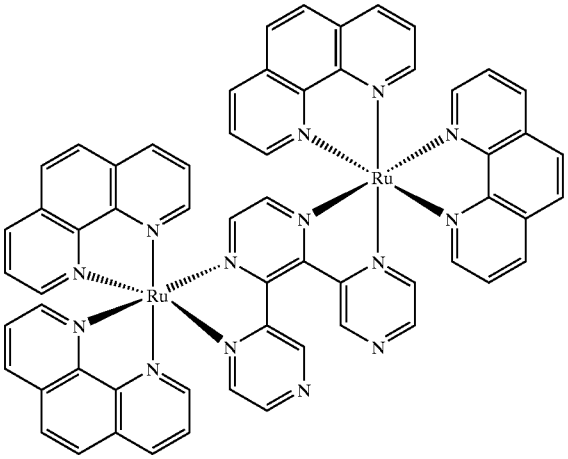
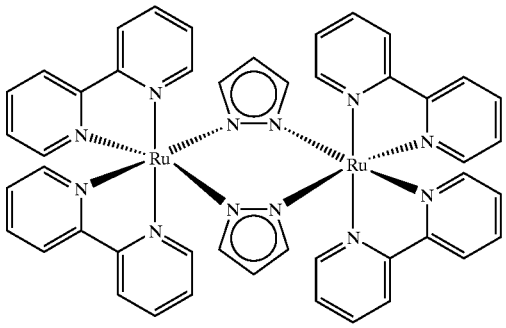

-continued
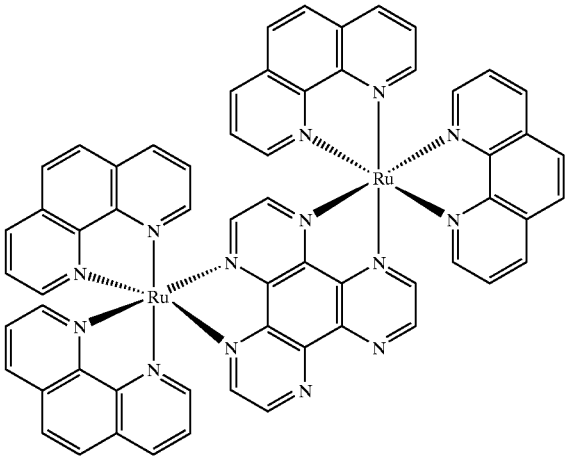
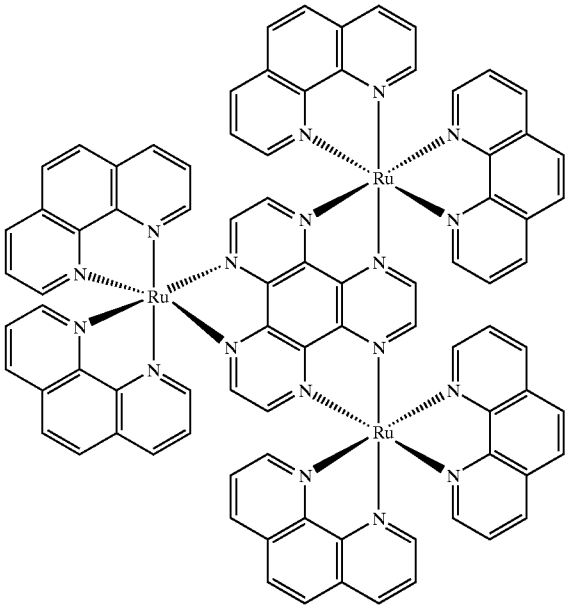
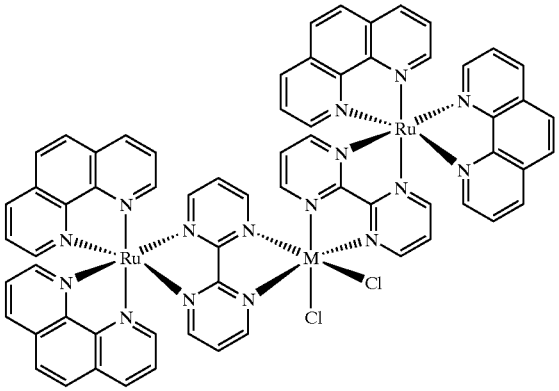
M = $Rh^{3+}$, $Ir^{3+}$
-continued
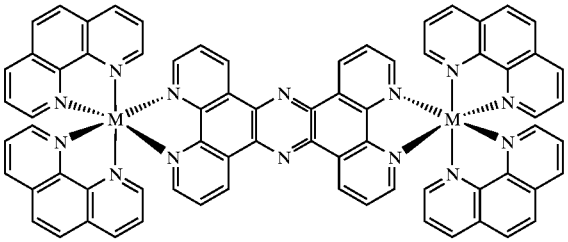
M′, M″ = Ru, Ru
Os, Os
Ru, Os
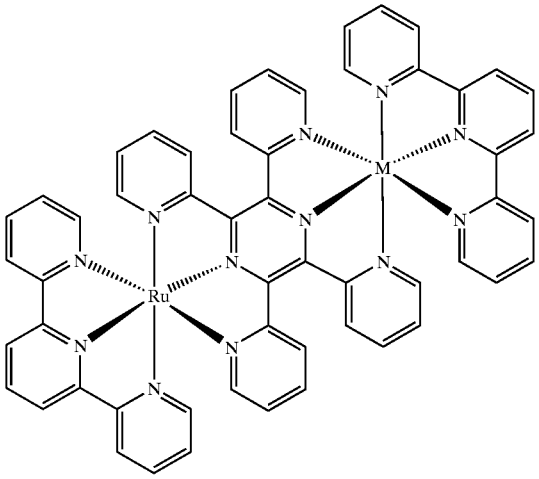
M = $Ru^{2+}$, $Os^{2+}$
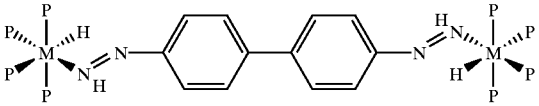
Me = $Fe^{2+}$, $Ru^{2+}$; P = $P(OMe)_3$, $P(OEt)_3$
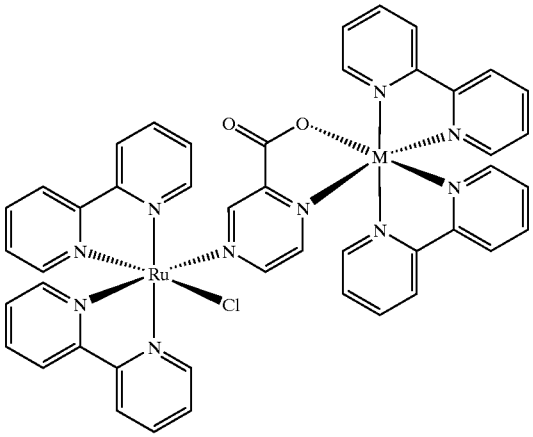
M = $Ru^{2+}$, $Os^{2+}$ -continued
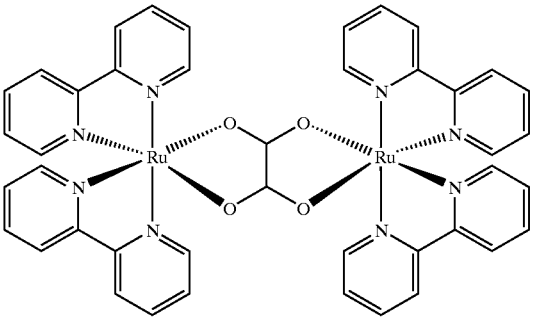
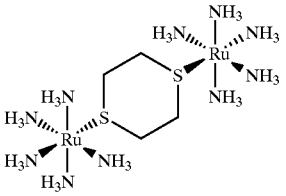
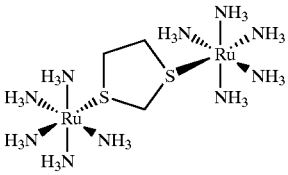
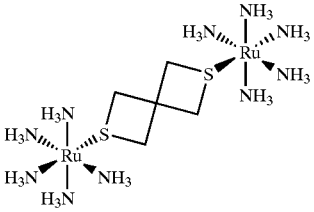
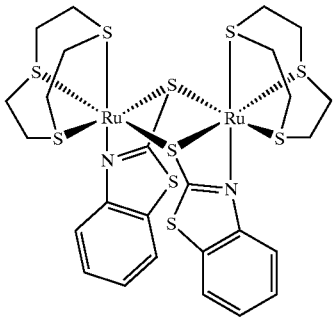
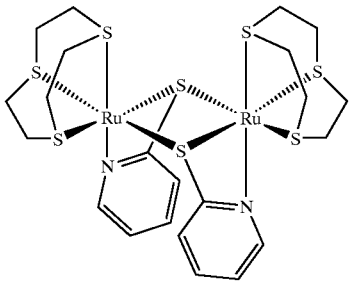
-continued
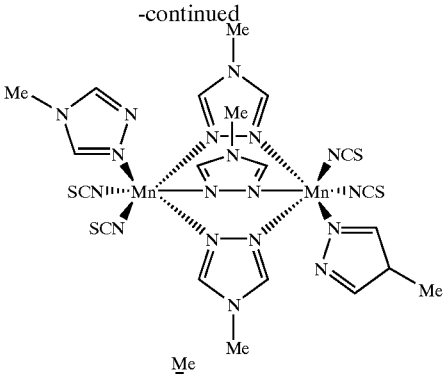
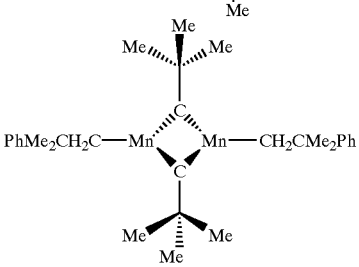
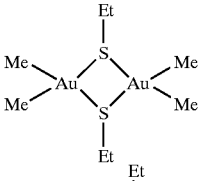
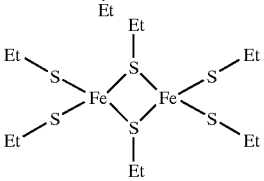
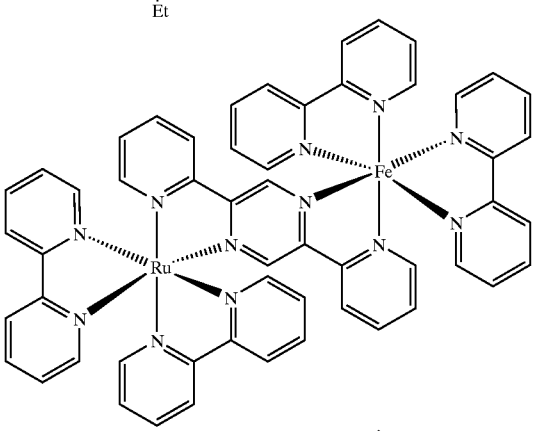
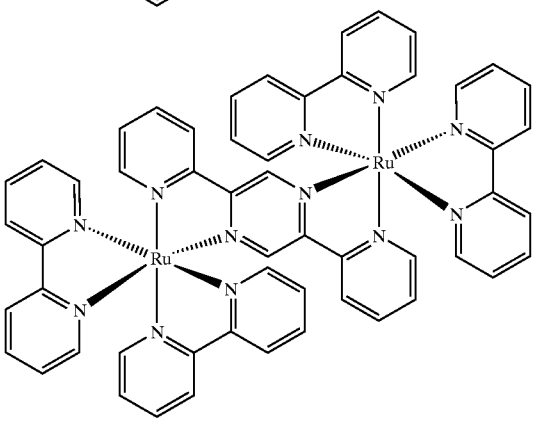

-continued

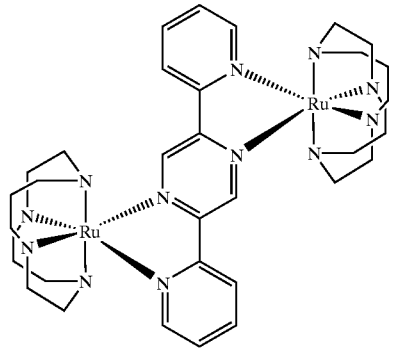

In the present invention, in the case the complex molecule for doping is a cation so as to form a salt with an anion, as the paired anion, one easily soluble in water and suited for a precipitation operation of a silver halide emulsion is preferable. Concretely, it is preferable to use halogen ion, nitric acid ion, perchloric acid ion, tetrafluoroboric acid ion, hexafluorophosphoric acid ion, tetraphenylboric acid ion, hexafluorosilicic acid ion, and trifluoromethane sulfonic acid ion. Since the ligand exchange reaction with the ligand of the complex is generated if an anion with a strong coordination, such as cyano ion, thiocyano ion, nitrous acid ion, oxalic acid ion, or the like, is used as the paired anion so that the composition and the structure of the complex according to the present invention may not be sustained, it is not preferable to use these anions. On the contrary, when the complex compound molecule becomes an anion and forms a salt with a cation, a pair cation in this case is preferably an alkali metal ion such as sodium ion, potassium ion, rubidium ion and cesium ion, as well as ammonium ion. The use of a quaternary alkyl ammonium ion is also preferable. In case the quaternary alkyl ammonium ion is used, substituents optionally selected from alkyl groups such as methyl group, ethyl group, propyl group, iso-propyl group and n-butyl group can be used.

The complex compounds for use in the present invention can be synthesized by several methods. For example, Coord. Chem. Rev. 84 (1988) 85~277 is a well-researched outline for ruthenium complex compounds. Thus, a number of complex compounds can be synthesized on the basis of literatures mentioned in this literature. Other complex compounds can be synthesized in accordance with synthetic methods mentioned in the outline for each metal specifically published once in several years in Coord. Chem. Rev.

It is preferable that the metal complex to be used in the present invention is incorporated into a silver halide grain, by adding directly to the reaction solution at the time of silver halide grain formation, or by adding to a grain forming reaction solution through the addition to an aqueous halide solution or other solution intended for silver halide grain formation. Furthermore, the metal complex may be doped into a silver halide grain by a combination of these methods.

In case silver halide particles are doped with the complex compound for use in the present invention, the complex compound may be present uniformly in the particles, or alternatively, the surface layer of the particles may be doped with the complex compound or the particles may be doped inside with the complex compound while the surface of the particles may be added with a layer not doped, as disclosed in JP-A-4-208936, JP-A-2-125245, JP-A-3-188437. In the present invention, the surface layer of the particles is preferably doped with the complex compound. Further, the surface layer of the particles may be modified according to physical ripening with fine particles doped with the complex compound, as disclosed in U.S. Pat. Nos. 5,252,451 and 5,256,530. Further, the silver halide particles may preferably be doped with the complex compound by initially preparing fine particles doped with the complex compound and then adding the fine particles to the particles followed by physical ripening. These above mentioned doping methods may be combined.

An appropriate amount of the complex compound used for doping is within the range of generally $1\times10^{-9}$ mol or more and not more than $1\times10^{-3}$ mol, preferably $1\times10^{-7}$ mol or more and not more than $1\times10^{-3}$ mol, per mol of silver halide.

In the silver halide emulsion of the present invention, it is necessary that at least a 50% of a projected area of the silver halide particles contained in the emulsion is occupied by tubular particles having a particle thickness of 0.3 $\mu$m or less. The particle thickness is preferably 0.2 $\mu$m or less, more preferably 0.15 $\mu$m or less, and the most preferably 0.10 $\mu$m or less. The effects of the present invention become more remarkable as the particle thickness becomes thinner.

Silver chloride, silver bromide, silver chlorobromide, silver iodobromide, silver chloroiodide, and silver chloroiodobromide can be employed for the silver halide emulsion of the present invention according to the intended purpose. The effects of the present invention is most remarkable in case of using the emulsion containing silver bromide, silver chlorobromide and silver iodobromide.

In order to describe the shape of particles contained in the emulsion, the so-called aspect ratio is usually employed which is a value obtained by dividing the particle thickness by a projected diameter of the particle. The term "tabular particles" means herein such particles as having an aspect ratio of 2 or more. In the emulsion of the present invention, an average aspect ratio is preferably 5 or more, more preferably 8 or more and most preferably 12 or more. In case particles of comparatively small particle size, which is not more than about 0.5 $\mu$m in terms of a diameter of a sphere having the same volume of an individual particle, are used, it is preferable to use such particles as having a value of 25 or more in a tabularity which is obtained by dividing the aspect ratio further by the particle thickness.

In order to enhance sensitivity of photographic emulsions comprising tabular particles having a high aspect ratio with a small particle thickness as in the emulsion of the present invention, it is known to be effective that dislocation is formed in a fringe part of the tabular particles. The dislocation is introduced as an edge dislocation in the field of crystallography. The density of such dislocation can easily be observed by an electron microscopic observation under the condition that the silver halide particles are cooled. For example, gelatin in the silver halide emulsion is decomposed by an enzymatic action to take out the silver halide particles which are then mounted on a mesh for observation by an electronic microscope and then observed by way of the transmission method while cooling the sample with liquid nitrogen for preventing any damage by electronic beam. In this case, it is preferable to use a high accelerating voltage of at least 200 kV for enhancing transmission rate of electronic beam. It is effective to slant the sample within the range of about 10° for seeking a higher disposition for a diffraction contrast due to dislocation.

A technology of coating a nucleus having a low iodine content with a first shell having a high iodine content followed by depositing thereon a second shell having a low iodine content is known as an example for a method of introducing dislocation, as disclosed in the known art publications. In this case, the shell deposited on the high iodine phase (corresponding to the fringe portion in the outer periphery of particles in case of the tabular particles) forms a dislocation line based on crystalline irregularity (unconformity), thus contributing to obtaining high sensitivity. For deposition of the high iodine phase, a method of adding a solution of a water-soluble iodide such as potassium iodide alone or together with a solution of a water-soluble silver salt such as silver nitrate, a method of introducing fine particles of silver iodide into the system, or a method of adding a compound capable of releasing iodide ion by the reaction with an alkali or a nucleophilic agent, for example, sodium p-iodoacetamidobenzenesulfonate or the like, can preferably be adopted.

Such methods are effective for tabular particles in a relatively small region of the aspect ratio. In case of particles of a high aspect ratio of 8 or more, however, it is sometimes difficult to obtain sensitivity in proportion to the projected area, thus placing obstacles to enhancing sensitivity.

It has now been found by the present inventors that when the emulsion particles are doped with a polynuclear metal complex dopant having an organic compound as bridging ligand, a high sensitivity can be imparted to the emulsion even if the particles have a high aspect ratio and a thin particle thickness. It is also observed that in case of particles into which the above-described fringe dislocation has been introduced, density of the fringe dislocation is increased in addition to attaining high sensitivity, by allowing the emulsion to contain the metal complex dopant in accordance with the present invention. The effects of the present invention become more remarkable in respect of the tabular particles having a large particle size.

U.S. Pat. Nos. 4,433,048, 4,434,226 and 4,439,520 disclose the use technology and characteristics of the tabular particles per se of a high aspect ratio that are preferably used in the present invention. Moreover, techniques with respect to tabular grains having a grain thickness lower than 0.07 $\mu$m and hence super high aspect ratio are disclosed, for example, in U.S. Pat. Nos. 5,494,789, 5,503,970, 5,503,971 and 5,536,632 and European Patent Nos. 0699945, 0699950, 0699948, 0699944, 0701165 and 0699946. In order to prepare tabular grains having a low grain thickness and hence a high aspect ratio, it is important to control the concentration of a binder, temperature, pH, the type of excess halogen ion, the ion concentration of the excess halogen ion and further the supply speed of a reaction solution when the nuclei is formed. In order to grow the tabular nuclei, to be formed, selectively not in the direction of the thickness but in the direction of the periphery of the tabular, it is also important to control the addition speed of the reaction solution for the growth of a grain, as well as to select an optimum one as a binder in the course of the growth from when a grain is formed. For this, gelatins with low methionine content or gelatins whose amino groups are modified by phthalic acid, trimellitic acid or pyromellitic acid are advantageous. By the term "a low methionine content" is meant herein the number of the methionine residue is not more than 3 out of 1000 amino acid residues.

The halogen composition of the silver halide emulsion particles which can be used in the present invention is selected according to the characteristics which should be imparted to the light-sensitive silver halide.

In the present invention, although silver halide grains having various forms may be used, the distribution of grain size of these grains is preferably a monodispersion. Silver halide emulsions preferably used in the present invention are preferably 40% or less in terms of coefficient of variation in the distribution of grain size. The coefficient of variation is more preferably 30% or less and most preferably 20% or less.

Also, in the case where the silver halide grains to be used have a tabular form, the coefficient of variation in grain thickness distribution is preferably small. In this case, the coefficient of variation is also preferably 40% or less. Further it is more preferably 30% or less and most preferably 20% or less.

In addition to the above contrivances regarding shape, the silver halide grains are prepared to have a variety of structures in the grains. A generally used method is one in which grains are formed to have layers different in silver halide composition. In the case of silver iodobromide grains used for photographing materials, it is preferable to provide layers different in iodine content. There are known so-called inside-high-iodine-type core/shell grains, wherein the nuclei in the form of layers high in iodine content are covered with shells low in iodine content, for the purpose of controlling developability. Reversely thereto, there are known outside-high-iodine-type core/shell grains, wherein nuclei are covered with shells high in iodine content, which are effective in increasing the stability of the shape when the thickness of tabular grains is made smaller. In the present invention, an epitaxial projecting portion may be deposited onto the surface of various host grains as mentioned above and used.

It is preferable to dope various multivalent metal ions such as transition metal atoms, in combination with the metal complex dopant for use in the present invention, into a silver halide emulsion grain for use in the present invention. Although these multivalent metal ions can be introduced in the form of halides, nitrates or the like during grain formation, preferably these multivalent metal ions are introduced in the form of a metal complex (e.g., halogeno complex, ammine complex, cyano complex, and nitrosyl complex) having the multivalent metal ion as the central metal.

The metal complex, preferably used in combination with the metal complex dopant in the present invention, is a complex comprising a metal ion belonging to the first, second or third transition series, and a ligand, such as a cyanide ion, capable of largely cleaving the d orbit in spectrochemical series. The coordination geometry of these complexes is a six coordinate complex, in which 6 ligands are coordinated to form an octahedron shape, and preferably the number of cyano ligand among the ligands is 4 or more.

Examples of preferred central transition metal include iron, cobalt, ruthenium, rhenium, osmium, and iridium.

In the case where not all of the 6 ligands of the metal ion are cyano ligands, the rest of the ligands may be selected from halide ions, such as a fluoride ion, a chloride ion, and a bromide ion; inorganic ligands, such as SCN, NCS, and $H_2O$, and organic ligands, such as pyridine, phenanthroline, imidazole and pyrazole.

Besides the above-described metal complexes, a complex composed of ruthenium, rhodium, palladium, or iridium, having halide ions or thiocyanate ions as ligands, a complex composed of ruthenium having one or more nitrosyl ligands, and a complex composed of chromium having cyanide ion ligands, may be preferably used in combination with the metal complex dopant, in the emulsion of the present invention.

It is also preferable to dope the silver halide grain for use in the emulsion of the present invention with a divalent anion of a so-called chalcogen element, such as sulfur, selenium, tellurium, or the like, besides the metal complexes described previously. These dopants are also effective in obtaining high sensitivity and in improving exposure condition dependence.

As a method employed to prepare silver halide grains for use in the present invention, known method described, for example, by P. Glafkides in "Chemie et Phisique Photographique," Paul Montel, 1967; by G. F. Duffin in "Photographic Emulsion Chemistry," Focal Press, 1966; or by V. L. Zelikman et al. in "Making and Coating Photographic Emulsion," Focal Press, 1964, can be referred to. That is, any of pH regions among the acid process, the neutral process, the ammonia process, and the like can be used to prepare silver halide grains. Further, to supply a water-soluble silver salt solution and a water-soluble halogen salt solution that are reaction solutions, any of the single-jet method, the double-jet method, a combination thereof, and the like can be used. The controlled double-jet method, can also be used preferably, wherein the addition of reaction solutions are controlled, to keep the pAg in the reaction constant. A method in which the pH of the reaction liquid during the reaction is kept constant can also be used. In the step for forming grains, a method in which the solubility of the silver halide is controlled by changing the temperature, pH, or pAg of the system can be used, and a thioether, a thiourea, and a rhodanate, can be used as a silver halide solvent, examples of these are described in JP-B-47-11386 ("JP-B" means examined Japanese patent publication), and JP-A-53-144319.

Generally, the preparation of the silver halide grains for use in the present invention is carried out by feeding a solution of a water-soluble silver salt, such as silver nitrate, and a solution of a water-soluble halogen salt, such as an alkali halide, into an aqueous solution containing a water-soluble binder dissolved therein, such as gelatin, under controlled conditions. After the formation of the silver halide grains, the excess water-soluble salts are preferably removed. For example, the noodle water-washing method, in which a gelatin solution containing silver halide grains are made into a gel, and the gel is cut into a string-shape, then the water-soluble salts are washed away using a cold water; and the sedimentation method, in which inorganic salts comprising polyvalent anions (e.g. sodium sulfate), an anionic surfactant, an anionic polymer (e.g. sodium polystyrenesulfonate), or a gelatin derivative (e.g. an aliphatic-acylated gelatin, an aromatic-acylated gelatin, and an aromatic-carbamoylated gelatin) is added, to allow the gelatin to aggregate, thereby removing the excess salts, can be used. In particular, the sedimentation method is preferably used because removal of the excess salts can be carried out rapidly.

In the present invention, generally it is preferable to use a chemically sensitized silver halide emulsion, to which the chemical sensitization is performed using a known method singly or in combination. The chemical sensitization contributes to giving high sensitivity to the prepared silver halide grains, and to giving exposure condition stability and storage stability.

Preferably use is made of, as the chemical sensitization method, the chalcogen sensitization method, wherein a sulfur, selenium, or tellurium compound is used. As the sensitizer used therein, a compound is used that, when added to the silver halide emulsion, releases the above chalcogen element, to form a silver chalcogenide. The use of such sensitizers in combination is preferable to obtain high sensitivity and to keep fogging low.

The noble metal sensitization method, wherein gold, platinum, iridium, or the like is used, is also preferable. Particularly the gold sensitization method, wherein chloroauric acid is used alone or in combination with thiocyanate ions or the like that act as ligands of gold, can give high sensitivity. The use of a combination of gold sensitization with chalcogen sensitization can give higher sensitivity.

The so-called reduction sensitization method is also preferably used, wherein a compound having a suitable reducing ability is used during the grain formation to introduce reducing silver nuclei, to obtain high sensitivity. The reduction sensitization method, wherein an alkynylamine compound having an aromatic ring is added at the time of chemical sensitization, is also preferred.

In carrying out the chemical sensitization, it is also preferable to use various compounds adsorbable to silver halide grains, to control reactivity. Particularly the method wherein sensitizing dyes, such as nitrogen-containing heterocyclic compounds, mercapto compounds, or, cyanines and melocyanines, are added prior to chalcogen sensitization or gold sensitization, is particularly preferable.

The reaction conditions under which the chemical sensitization is conducted vary in accordance with the purpose: the temperature is generally 30 to 95° C., and preferably 40 to 75° C.; the pH is generally 5.0 to 11.0, and preferably 5.5 to 8.5; and the pAg is generally 6.0 to 10.5, and preferably 6.5 to 9.8.

Chemical sensitization techniques are described, for example, in JP-A-3-110555, JP-A-5-241267, JP-A-62-253159, JP-A-5-45833, and JP-A-62-40446. It is also preferable to form epitaxial protrusions during the chemical sensitization process.

In the present invention, preferably the so-called spectral sensitization, for sensitizing the light-sensitive silver halide emulsion to a desired light wavelength range, is carried out. Particularly, in a color photographic light sensitive material, for color reproduction faithful to the original, light-sensitive layers having light sensitivities to blue, green, and red are incorporated. These sensitivities are provided by spectrally sensitizing the silver halide, with a so-called spectrally sensitizing dye.

Examples of such dyes include cyanine dyes, merocyanine dyes, composite cyanin dyes, composite merocyanine dyes, halopolar dyes, hemicyanine dyes, styryl dyes, and hemioxonol dyes. These examples are described, for example, in U.S. Pat. No. 4,617,257, JP-A-59-180550, JP-A-64-13546, JP-A-5-45828, and JP-A-5-45834.

These spectral sensitizing dyes can be used singly or in combination, and a single use or a combination use of these sensitizing dyes is selected for the purpose of adjusting the wavelength distribution of the spectral sensitivity, and for the purpose of supersensitization. When using a combination of the dyes having supersensitizing effect, it is possible to attain sensitivity much larger than the sum of sensitivities which can be attained by each single dye.

Further, together with the sensitizing dye, it is also preferable to use a dye having no spectral sensitizing action itself, or a compound that does not substantially absorb visible light and that exhibits supersensitization. As an example of the supersensitizer, a diaminostilbene compound and the like can be mentioned. These examples are described, for example, in U.S. Pat. No. 3,615,641 and JP-A-63-23145.

The addition of these spectrally sensitizing dyes and supersensitizers to the silver halide emulsion may be carried out at any time during the preparation of the emulsion. Different methods, such as addition when a coating solution is prepared from the chemically sensitized emulsion, addition after the completion of the chemical sensitization, addition during the chemical sensitization, addition prior to the chemical sensitization, addition after the formation of the grains and before the desalting, addition during the formation of the grains, and addition prior to the formation of the grains, can be used alone or in combination. The addition is preferably carried out in a step before the chemical sensitization, to obtain high sensitivity.

The amount of the spectrally sensitizing dye or the supersensitizer to be added may vary widely depending on the shape of the grains, the size of the grains, and the desired photographic properties, and it is generally in the range of $10^{-8}$ to $10^{-1}$ mol, and preferably $10^{-5}$ to $10^{-2}$ mol, per mol of the silver halide. These compounds can be added with them dissolved in an organic solvent, such as methanol and a fluoroalcohol, or with them dispersed together with a surfactant or gelatin in water.

In the silver halide emulsion according to the present invention, various stabilizers can be incorporated for the purpose of preventing fogging, or for the purpose of improving stability at storage. As a preferable stabilizer, nitrogen-containing heterocyclic compounds, such as azaindenes, triazoles, tetrazoles, and purines; mercapto compounds, such as mercaptotetrazoles, mercaptotriazoles, mercaptoimidazoles, and mercaptothiadiazoles, can be mentioned. Details of these compounds are described, for example, by T. H. James in "The Theory of the Photographic Process," Macmillan, 1997, pages 396 to 399, and literatures referred to therein.

In the present invention, among those antifogging agents, mercaptoazoles that have an alkyl group having 4 or more carbon atoms, or having plural aromatic groups, as substituent(s) is particularly preferably used.

The timing when the antifoggant or the stabilizer is added to the silver halide emulsion, may be at any stage in the preparation of the emulsion. The addition to the emulsion can be carried out at any time, singly or in combination, of after the completion of the chemical sensitization and during the preparation of a coating solution, at the time of the completion of the chemical sensitization, during the chemical sensitization, prior to the chemical sensitization, after the completion of the grain formation and before desalting, during the grain formation, or prior to the grain formation.

The amount of these antifogging agents or stabilizers to be added varies in accordance with the halogen composition of the silver halide emulsion and the purpose, and it is generally in the range of $10^{-6}$ to $10^{-1}$ mol, and preferably $10^{-5}$ to $10^{-2}$ mol, per mol of the silver halide.

Such additives for photography that can be used in the light-sensitive material of the present invention are described in more detail in Research Disclosures (hereinafter abbreviated to as RD) No. 17643 (December 1978), RD No. 18716 (November 1979), and RD No. 307105 (November 1989), and the particular parts are shown below.

| Kind of Additive | RD 17643 | RD 18716 | RD 307105 |
|---|---|---|---|
| Chemical sensitizers | p. 23 | p. 648 (right column) | p. 866 |
| Sensitivity-enhancing agents | — | p. 648 (right column) | — |
| Spectral sensitizers and Supersensitizers | pp. 23–24 | pp. 648 (right column)–649 (right column) | pp. 866–868 |
| Brightening agents | p. 24 | pp. 648 (right column) | p. 868 |
| Antifogging agents and Stabilizers | pp. 24–26 | p. 649 (right column) | pp. 868–870 |

-continued

| Kind of Additive | RD 17643 | RD 18716 | RD 307105 |
|---|---|---|---|
| Light absorbers, Filter dyes, and UV Absorbers | pp. 25–26 | pp. 649 (right column)–650 (left column) | p. 873 |
| Dye image stabilizers | p. 25 | p. 650 (left column) | p. 872 |
| Hardeners | p. 26 | p. 651 (left column) | pp. 874–875 |
| Binders | p. 26 | p. 651 (left column) | pp. 873–874 |
| Plasticizers and Lubricants | p. 27 | p. 650 (right column) | p. 876 |
| Coating aids and Surfactants | pp. 26–27 | p. 650 (right column) | pp. 875–876 |
| Antistatic agents | p. 27 | p. 650 (right column) | pp. 876–877 |
| Matting agents | — | — | pp. 878–879 |

In the present invention, the light-sensitive silver halide may be used together with an organic metal salt as an oxidizing agent. Among such organic metal salts, organosilver salt is particularly preferably used.

As the organic compound that can be used to form the above organosilver salt oxidizing agent, benzotriazoles, aliphatic acids, and other compounds, as described in U.S. Pat. No. 4,500,626, columns 52 to 53, can be mentioned. Also useful is acetylene silver described in U.S. Pat. No. 4,775,613. Organosiliver salts may be used in the form of a combination of two or more.

The above organosilver salts may be used additionally in an amount of generally 0.01 to 10 mol, and preferably 0.01 to 1 mol, per mol of the light-sensitive silver halide.

As the binder of the constitutional layer of the light-sensitive material, a hydrophilic binder is preferably used. Examples thereof include those described in the above-mentioned Research Disclosures and JP-A-64-13546, pages (71) to (75). Specifically, a transparent or semitransparent hydrophilic binder is preferable, and examples include natural compounds, such as proteins including gelatin, gelatin derivatives, and the like, or polysaccharides including cellulose derivatives, starches, gum-arabic, dextrans, pullulan, and the like; and synthetic polymer compounds such as polyvinyl alcohols, modified polyvinyl alcohols (e.g. terminal-alkyl-modified POVAL MP103, MP203, and the like, trade name, manufactured by Kuraray Co., Ltd.), polyvinyl pyrrolidones, and acrylamide polymers. Further, highly water-absorptive polymers described, for example, in U.S. Pat. No. 4,960,681, and JP-A-62-245260; that is, homopolymers of vinyl monomers having —COOM or —$SO_3$M (M represents a hydrogen atom or an alkali metal), or copolymers of these vinyl monomers, or copolymers of the vinyl monomer(s) with another vinyl monomer (e.g., those comprising sodium methacrylate or ammonium methacrylate, including Sumika Gel L-5H, trade name, manufactured by Sumitomo Chemical Co., Ltd.) can also be used. Two or more of these binders can be used in combination. Particularly, combinations of gelatin with the above binders are preferable. Further, the gelatin can be selected from lime-processed gelatin, acid-processed gelatin; so-called de-ashed gelatin from which the calcium content, etc., have been reduced, in accordance with various purposes, and combinations thereof are also preferable.

In the present invention, the amount of a binder to be applied is generally 1 to 20 g/$m^2$, preferably 2 to 15 g/$m^2$, and further preferably 3 to 12 g/$m^2$. In the binder, gelatin is used generally in the ratio of 50 to 100%, and preferably 70 to 100%.

The effects of the present invention can further be improved by incorporating (building-in) a developing agent to the light-sensitive material of the present invention. As a developing agent to be incorporated, the compounds represented by the above mentioned formulas (I) to (IV) are preferably used.

The compound represented by formula (I) is a compound so-called sulfonamidephenol.

In the formula, $R_1$ to $R_4$ each represent, a hydrogen atom, a halogen atom (e.g. chloro and bromo), an alkyl group (e.g., methyl, ethyl, isopropyl, n-butyl, and t-butyl), an aryl group (e.g., phenyl, tolyl, and xylyl), an alkylcarbonamido group (e.g., acetylamino, propionylamino, and butyroylamino), an arylcarbonamido group (e.g. benzoylamino), an alkylsulfonamido group (e.g. methanesulfonylamino and ethanesulfonylamino), an arylsulfonamido group (e.g. benzenesulfonylamino and toluenesulfonylamino), an alkoxy group (e.g. methoxy, ethoxy, and buthoxy), an aryloxy group (e.g. phenoxy), an alkylthio group (e.g. methylthio, ethylthio, and butylthio), an arylthio group (e.g. phenylthio and tolylthio), an alkylcarbamoyl group (e.g. methylcarbamoyl, dimethylcarbamoyl, ethylcarbamoyl, diethylcarbamoyl, dibutylcarbamoyl, piperidylcarbamoyl, and morpholylcarbamoyl), an arylcarbamoyl group (e.g. phenylcarbamoyl, methylphenylcarbamoyl, ethylphenylcarbamoyl, and benzylphenylcarbamoyl), a carbamoyl group, an alkylsulfamoyl group (e.g. methylsulfamoyl, dimethylsulfamoyl, ethylsulfamoyl, diethylsulfamoyl, dibutylsulfamoyl, piperidylsulfamoyl, and morpholylsulfamoyl), an arylsulfamoyl group (e.g. phenylsulfamoyl, methylphenylsulfamoyl, ethylphenylsulfamoyl, and benzylphenylsulfamoyl), a sulfamoyl group, a cyano group, an alkylsulfonyl group (e.g. methanesulfonyl and ethanesulfonyl), an arylsulfonyl group (e.g. phenylsulfonyl, 4-chlorophenylsulfonyl, and p-toluenesulfonyl), an alkoxycarbonyl group (e.g. methoxycarbonyl, ethoxycarbonyl, and butoxycarbonyl), an aryloxycarbonyl group (e.g. phenoxycarbonyl), an alkylcarbonyl group (e.g. acetyl, propionyl, and butyloyl), an arylcarbonyl group (e.g. benzoyl and alkylbenzoyl), or an acyloxy group (e.g. acetyloxy, propionyloxy, and butyloyloxy). Among $R_1$ to $R_4$, $R_2$ and/or $R_4$ is (are) preferably a hydrogen atom. Further, the total of Hammett's constant $\sigma_p$ values of $R_1$ to $R_4$ is preferably 0 or more.

$R_5$ represents an alkyl group (e.g., methyl group, ethyl group, butyl group, octyl group, lauryl group, cetyl group, and stearyl group), an aryl group (e.g., phenyl group, tolyl group, xylyl group, 4-methoxyphenyl group, dodecylphenyl group, chlorophenyl group, trichlorophenyl group, nitrochlorophenyl group, triisopropylphenyl group, 4-dodecyloxyphenyl group, and 3,5-di-(methoxycarbonyl)phenyl group), or a heterocyclic group (e.g., pyridyl group).

The compound represented by formula (II) is a compound so-called carbamoylhydrazine. The compound represented by formula (IV) is a compound so-called sulfonylhydrazine.

In the formula, Z represents a group of atoms forming an aromatic ring together with the C. The aromatic group formed by Z and the C should be sufficiently electron-attractive, to impart silver development activity to the compound. From this standpoint, a nitrogen-containing aromatic ring or an aromatic ring such as a benzene ring to which an electron-attractive group is introduced, is preferably used. Preferred examples of such aromatic rings include a pyridine ring, a pyrazine ring, a pyrimidine ring, a quinoline ring, and a quinoxaline ring.

In the case of a benzene ring, examples of its substituent include an alkylsulfonyl group (e.g., methanesulfonyl group and ethanesulfonyl group), a halogen atom (e.g., chlorine atom and bromine atom), an alkylcarbamoly group (e.g., methylcarbamoyl group, dimethylcarbamoyl group, ethylcarbamoyl group, diethylcarbamoyl group, dibutylcarbamoyl group, piperidylcarbamoyl group, and morpholinylcarbamoyl group), an arylcarbamoly group (e.g., phenylcarbamoyl group, methylphenylcarbamoyl group, ethylphenylcarbamoyl group, and benzylphenylcarbamoyl group), a carbamoyl group, an alkylsulfamoyl group (e.g., methylsulfamoyl group, dimethylsulfamoyl group, ethylsulfamoyl group, diethylsulfamoyl group, dibutylsulfamoyl group, piperidylsulfamoyl group, and morpholinylsulfamoyl group), an arylsulfamoyl group (e.g., phenylsulfamoyl group, methylphenylsulfamoyl group, ethylphenylsulfamoyl group, and benzylphenylsulfamoyl group), a sulfamoyl group, a cyano group, an alkylsulfonyl group (e.g., methanesulfonyl group and ethanesulfonyl group), an arylsulfonyl group (e.g., phenylsulfonyl group, 4-chlorophenylsulfonyl group, and p-toluenesulfonyl group), an alkoxycarbonyl group (e.g., methoxycarbonyl group, ethoxycarbonyl group, and butoxycarbonyl group), an aryloxycarbonyl group (e.g., phenoxycarbonyl group), an alkylcarbonyl group (e.g., acetyl group, propionyl group, and butyloyl group), and an arylcarbonyl group (e.g., benzoyl group and alkylbenzoyl group). The total of Hammett's constant $\sigma$ values of the above-mentioned substituents is preferably 1 or greater.

The compound represented by formula (III) is a compound so-called carbamoylhydrazone.

In the formula, $R_6$ represents a substituted or unsubstituted alkyl group (e.g., methyl group and ethyl group). X represents an oxygen atom, a sulfur atom, a selenium atom, or an alkyl- or aryl-substituted tertiary nitrogen atom, and X is preferably an alkyl-substituted tertiary nitrogen atom. $R_7$ and $R_8$ each represent a hydrogen atom or a substituent, and $R_7$ and $R_8$ may bond together to form a double bond or a ring (e.g. a substituted or unsubstituted benzene ring, and the like).

Specific examples of the compounds represented by formula (I), (II), (III) or (IV) are shown below, which of course are not meant to limit the present invention.

D-1

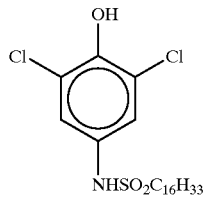

D-2

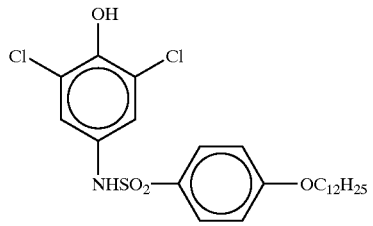

D-3

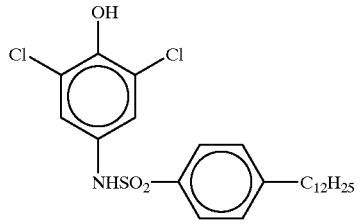

-continued
D-4
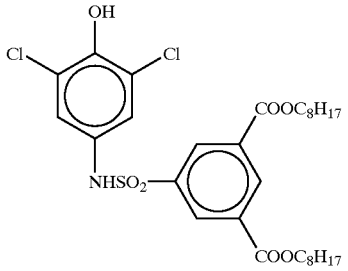
D-5
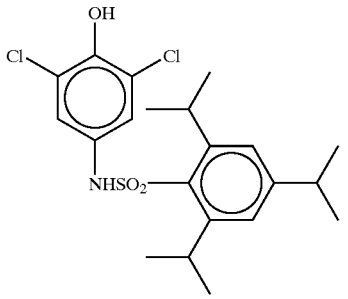
D-6
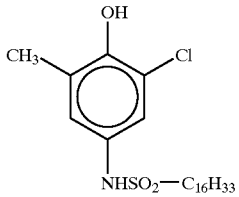
D-7
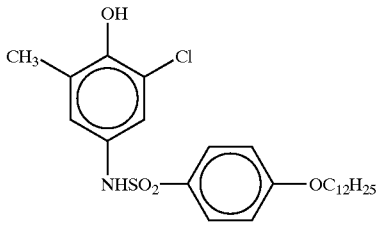
D-8
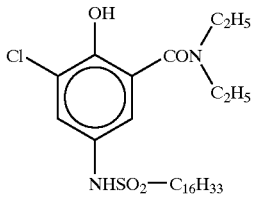
D-9
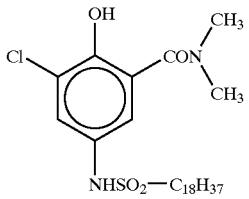
D-10
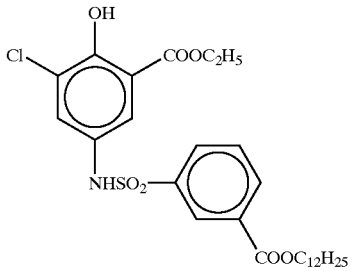
-continued
D-11
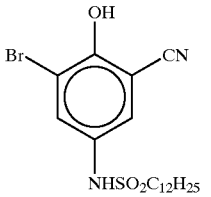
D-12
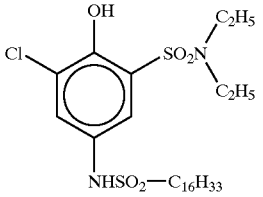
D-13
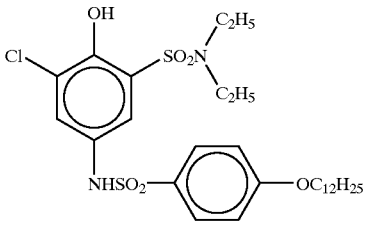
D1-4
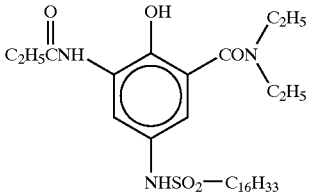
D-15
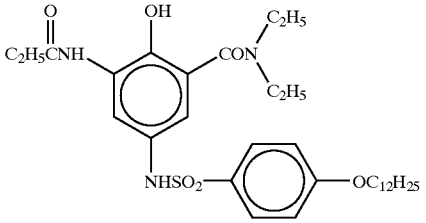
D-16
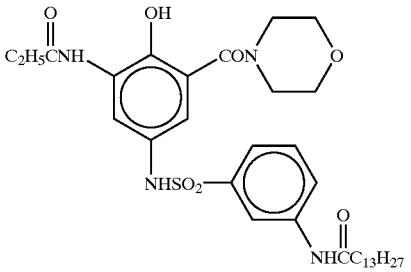
D-17
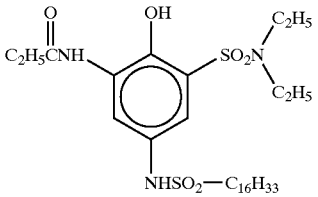

-continued
D-18
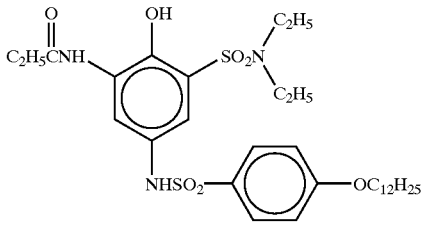
D-19
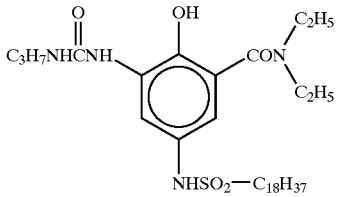
D-20
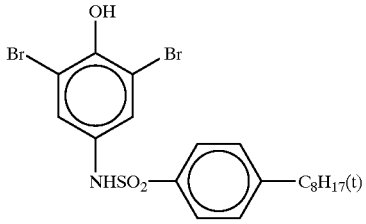
D-21
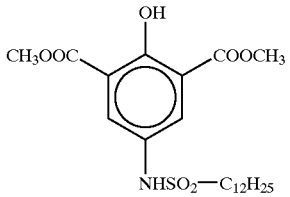
D-22
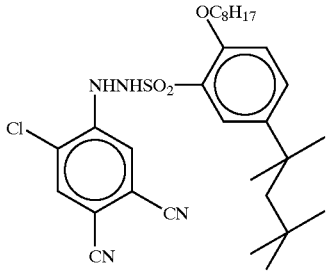
D-23
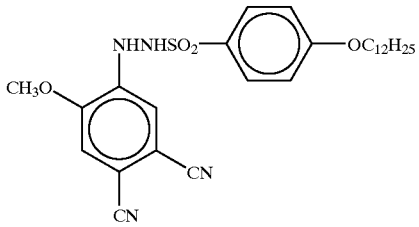
D-24
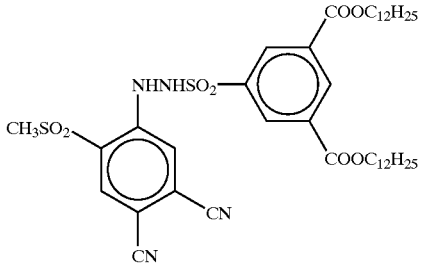
-continued
D-25
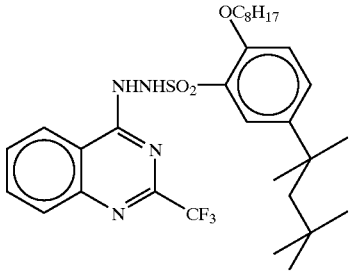
D-26
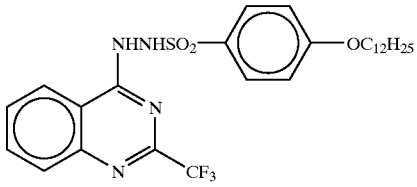
D-27
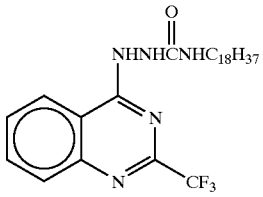
D-28
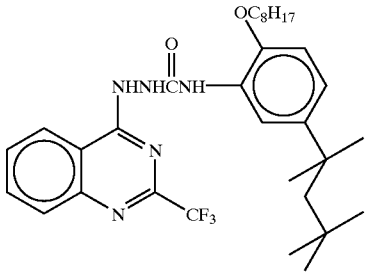
D-29
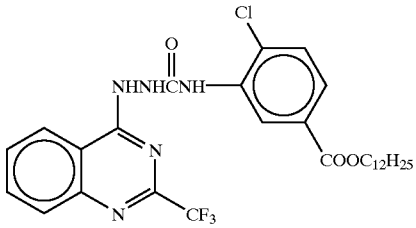
D-30
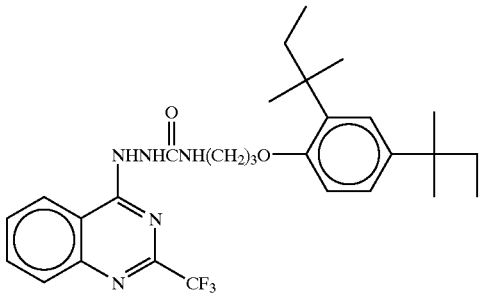

-continued
D-31
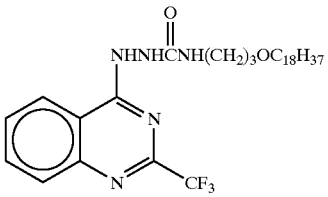
D-32
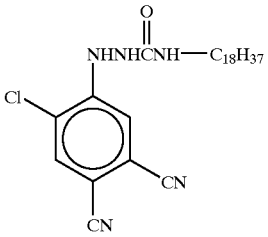
D-33
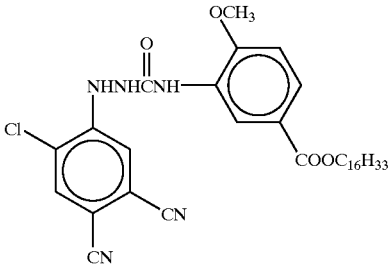
D-34
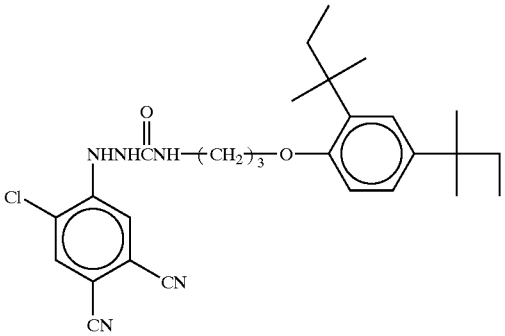
D-35
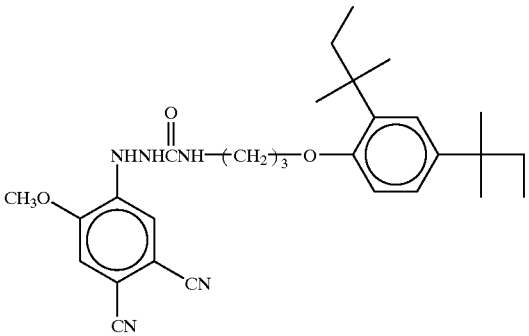
-continued
D-36
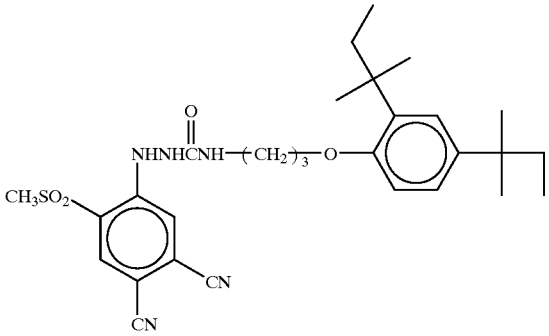
D-37
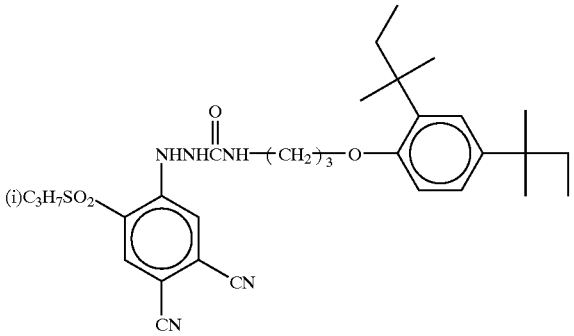
D-38
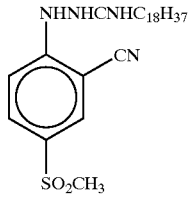
D-39
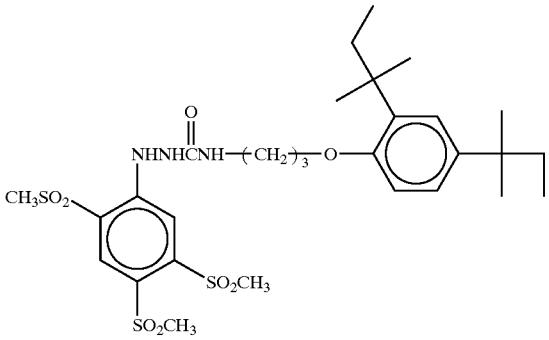
D-40
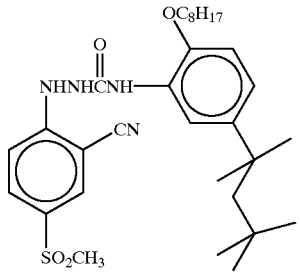

-continued
D-41
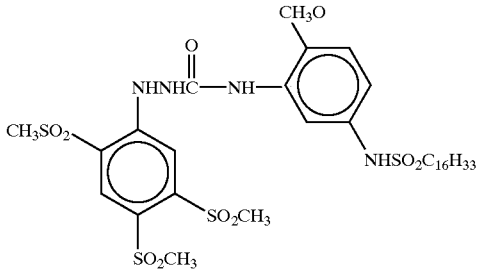
D-42
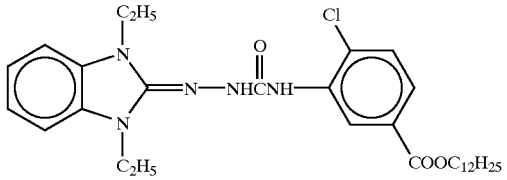
D-43
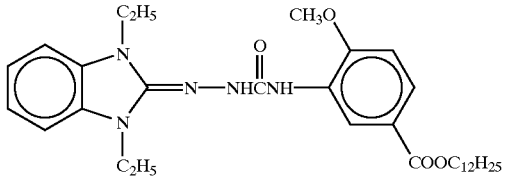
D-44
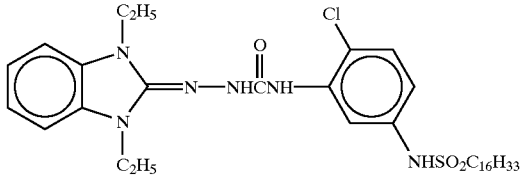
D-45
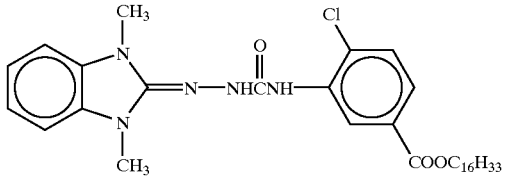
D-46
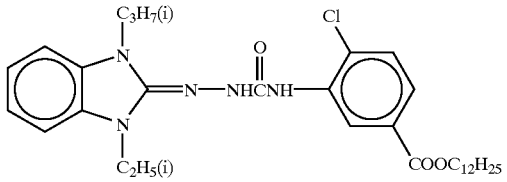
D-47
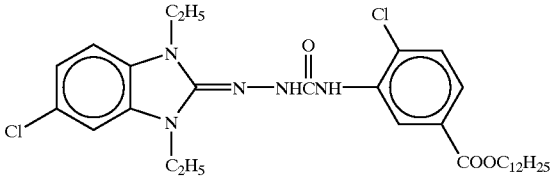
-continued
D-48
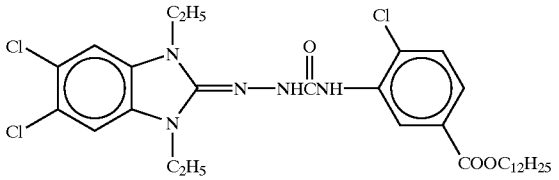
D-49
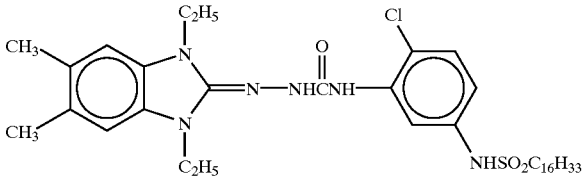
D-50
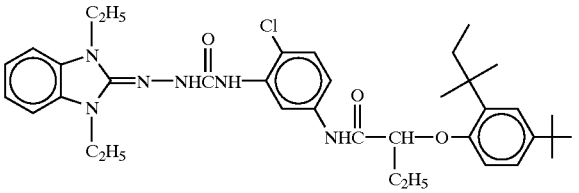
D-51
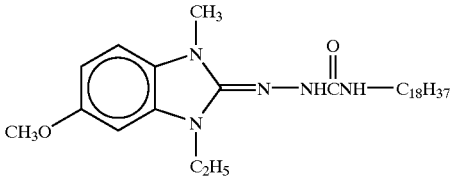
D-52
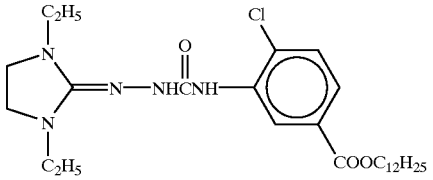
D-53
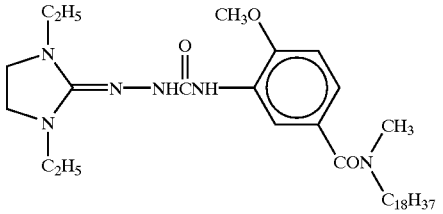
D-54
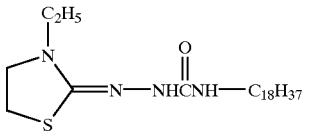
D-55
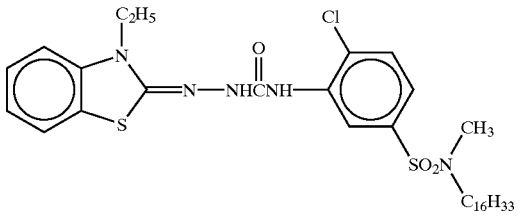

-continued

D-56

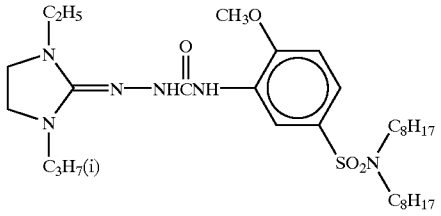

As a color developing agent(s), the above compound can be used singly or in a combination of two or more. The different developing agents can be used in separate layers. The total amount of those developing agents to be used is generally 0.05 to 20 mmol/$m^2$ and preferably 0.1 to 10 mmol/$m^2$.

Next, the coupler is explained. The coupler, which can be used in the present invention, means a compound that forms a dye by a coupling reaction with the oxidization product of a color-developing agent.

In the present invention, preferable couplers to be used include compounds that are collectively referred to as active methylenes, 5-pyrazolones, pyrazoloazoles, phenols, naphthols, and pyrrolotriazoles. For example, as the couplers, compounds referred to in Research Disclosure (hereinafter abbreviated to as RD) No. 38957 (September 1996), pages 616 to 624, "x. Dye image formers and modifiers" can be used preferably.

These couplers can be classified into so-called two-equivalent couplers and four-equivalent couplers. As groups that serve as anionic releasing groups of two-equivalent couplers, can be mentioned, for example, a halogen atom (e.g. chlorine and bromine), an alkoxy group (e.g., methoxy and ethoxy), an aryloxy group (e.g., phenoxy, 4-cyanophenoxy, and 4-alkoxycarbonylphenyl), an alkylthio group (e.g., methylthio, ethylthio, and butylthio), an arylthio group (e.g., phenylthio and tolylthio), an alkylcarbamoyl group (e.g., methylcarbamoyl, dimethylcarbamoyl, ethylcarbamoyl, diethylcarbamoyl, dibutylcarbamoyl, piperidylcarbamoyl, and morpholinylcarbamoyl), an arylcarbamoyl group (e.g., phenylcarbamoyl, methylphenylcarbamoyl, ethylphenylcarbamoyl, and benzylphenylcarbamoyl), a carbamoyl group, an alkylsulfamoyl group (e.g., methylsulfamoyl, dimethylsulfamoyl, ethylsulfamoyl, diethylsulfamoyl, dibutylsufamoyl, piperidylsulfamoyl, and morpholinylsulfamoyl), an arylsulfamoyl group (e.g., phenylsulfamoyl, methylphenylsulfamoyl, ethylphenylsulfamoyl, and benzylphenylsulfamoyl), a sulfamoyl group, a cyano group, an alkylsulfonyl group (e.g., methanesulfonyl and ethanesulfonyl), an arylsufonyl group (e.g., phenylsulfonyl, 4-chlorophenylsulfonyl, and p-toluenesulfonyl), an alkylcarbonyloxy group (e.g. acetyloxy, propionyloxy, and butyloyloxy), an arylcarbonyloxy group (e.g., benzoyloxy, toluyloxy, and anisyloxy), and a nitrogen-containing heterocyclic group (e.g., imidazolyl and benzotriazolyl).

Further, as groups that serve as cationic releasing groups of four-equivalent couplers, can be mentioned, for example, a hydrogen atom, a formyl group, a carbamoyl group, a substituted methylene group (the substituent of which includes, for example, an aryl group, a sulfamoyl group, a carbamoyl group, an alkoxy group, an amino group, and a hydroxyl group), an acyl group, and a sulfonyl group.

In addition to the compounds described in the above RD No. 38957, couplers described below can be preferably used.

As active-methylene-series couplers, use can be made of couplers represented by formula (I) or (II) of EP-A-502,424; couplers represented by formula (1) or (2) of EP-A-513,496; couplers represented by formula (I) in claim 1 of EP-A-568,037(A); couplers represented by formula (I) of U.S. Pat. No. 5 066 576, column 1, lines 45 to 55; couplers represented by formula (I) of JP-A-4-274425, paragraph number 0008; couplers described in claim 1 of EP-A-498,381(A1), page 40; couplers represented by formula (Y) of EP-A-447,969(A1), page 4; and couplers represented by any one of formulae (II) to (IV) of U.S. Pat. No. 4,476,219, column 7, lines 36 to 58.

As 5-pyrazorone-series magenta couplers, compounds described in JP-A-57-35858 and JP-A-51-20826 are preferable.

Preferable pyrazoloazole-series couplers are imidazo[1,2-b]pyrazoles described in U.S. Pat. No. 4,500,630, pyrazolo[1,5-b][1,2,4]triazoles described in U.S. Pat. No. 4,540,654, and pyrazolo[5,1-c][1,2,4]triazoles described in U.S. Pat. No. 3,725,067. Among these couplers, pyrazolo[1,5-b][1,2,4]triazoles are preferable in view of light fastness.

Preferable examples of the phenol-series couplers include 2-alkylamino-5-alkylphenol couplers described, for example, in U.S. Pat. Nos. 2,369,929, 2,801,171, 2,772,162, 2,895,826, and 3,772,002; 2,5-diacylaminophenol couplers described, for example, in U.S. Pat. Nos. 2,772,162, 3,758,308, 4,126,396, 4,334,011, and 4,327,173, West Germany Pat. Publication No. 3,329,729, and JP-A-59-166956; and 2-phenylureido-5-acylaminophenol couplers described, for example, in U.S. Pat. Nos. 3,446,622, 4,333,999, 4,451,559, and 4,427,767.

Preferable examples of the naphthol-series couplers include 2-carbamoyl-1-naphthol couplers described, for example, in U.S. Pat. Nos. 2,474,293, 4,052,212, 4,146,396, 4,228,233, and 4,296,200; and 2-carbamoyl-5-amido-1-naphthol couplers described, for example, in U.S. Pat. No. 4,690,889.

Preferable examples of the pyrrolotriazole-series couplers include those described in European Patent Nos. 488,248A1, 491,197A1, and 545,300.

Further, a fused-ring phenol, imidazole, pyrrole, 3-hydroxypyridine, active methine, 5,5-ring-fused heterocyclic, and 5,6-ring-fused heterocyclic coupler, can be used.

As the fused-ring phenol-series couplers, those described, for example, in U.S. Pat. Nos. 4,327,173, 4,564,586, and 4,904,575, can be used.

As the imidazole-series couplers, those described, for example, in U.S. Pat. Nos. 4,818,672 and 5,051,347, can be used.

As the pyrrole-series couplers, those described, for example, in JP-A-4-188137 and JP-A-4-190347 can be used.

As the 3-hydroxypyridine-series couplers, those described, for example, in JP-A-1-315736, can be used.

As the active methine-series couplers, those described, for example, in U.S. Pat. Nos. 5,104,783 and 5,162,196, can be used.

As the 5,5-ring-fused heterocyclic couplers, for example, pyrrolopyrazole couplers described in U.S. Pat. No. 5,164,289, and pyrroloimidazole couplers described in JP-A-4-174429, can be used.

As the 5,6-ring-fused heterocyclic couplers, for example, pyrazolopyrimidine couplers described in U.S. Pat. No. 4,950,585, pyrrolotriazine couplers described in JP-A-4-204730, and couplers described in European Patent No. 556,700, can be used.

In the present invention, in addition to the above couplers, use can be made of couplers described, for example, in West Germany Pat. Nos. 3,819,051A and 3,823,049, U.S. Pat. Nos. 4,840,883, 5,024,930, 5,051,347, and 4,481,268, European Patent Nos. 304,856A2, 329,036, 354,549A2, 374,781A2, 379,110A2, and 386,930A1, and JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731, and JP-A-4-204732.

The amount of these couplers to be used is generally 0.05 to 10 mmol/$m^2$, and preferably 0.1 to 5 mmol/$m^2$, per each color.

Further, functional couplers as shown below may be contained in the light-sensitive material of the invention.

As couplers whose color-formed dyes have suitable diffusibility, those described in U.S. Pat. No. 4,366,237, GB Patent No. 2 125 570, EP-B-96,873, and DE 3,234,533 are preferable.

Couplers for correcting undesired absorption of color-formed dyes are preferably, yellow-colored cyan couplers described in EP-A-456,257(A1); yellow-colored magenta couplers described in EP-A-456,257(A1); magenta-colored cyan couplers described in U.S. Pat. No. 4,833,069; (2) of U.S. Pat. No. 4,837,136; and colorless masking couplers represented by formula (A) in claim 1 of WO 92/11575 (particularly, exemplified compounds on pages 36 to 45).

As a compound (including a coupler) that reacts with the oxidized product of a developing agent to release a residue of a photographically useful compound, the following can be listed:

Development-inhibitor-releasing compounds: compounds represented by formula (I), (II), (III), or (IV) described in EP-A-378,236(A1), page 11; compounds represented by formula (I) described in EP-A-436,938(A2), page 7, compounds represented by formula (1) described in EP-A-568,037, and compounds represented by formula (I), (II), or (III) described in EP-A-440,195(A2), pages 5 to 6;

Bleaching-accelerator-releasing compounds: compounds represented by formula (I) or (I') described in page 5 of EP-A-310,125(A2), and compounds represented by formula (I) in claim 1 of JP-A-6-59411;

Ligand-releasing compounds: compounds represented by LIG-X recited in claim 1 in U.S. Pat. No. 4,555,478;

Leuco-dye-releasing compounds: compounds 1 to 6 in columns 3 to 8 in U.S. Pat. No. 4,749,641;

Fluorescent-dye-releasing compounds: compounds represented by COUP-DYE in claim 1 in U.S. Pat. No. 4,774,181; Development-accelerator- or fogging-agent-releasing compounds: compounds represented by formula (1), (2), or (3) in column 3 of U.S. Pat. No. 4,656,123, and ExZK-2 in EP-A-450, 637(A2), page 75, lines 36 to 38; and Compounds that releases a group capable of forming a dye upon the group is split off: compounds represented by formula (I) in claim 1 of U.S. Pat. No. 4,857,447; compounds represented by formula (I) in JP-A-5-307248; compounds represented by formula (I), (II), or (III) described in EP-A-440,195 (A2), pages 5 to 6; compounds represented by formula (I) in claim 1 of JP-A-6-59411.

Such functional couplers may preferably be used in an amount of generally 0.05 to 10 times, and preferably 0.1 to 5 times, per mol of the above mentioned couplers that contribute to color formation.

The hydrophobic additives, such as a coupler and a color-developing agent, can be introduced into layers of a light-sensitive material by a known method, such as the one described in U.S. Pat. No. 2,322,027. In this case, use is made of a high-boiling organic solvent as described, for example, in U.S. Pat. Nos. 4,555,470, 4,536,466, 4,536,467, 4,587,206, 4,555,476, and 4,599,296, and JP-B-3-62256, if necessary in combination with a low-boiling organic solvent having a boiling point of 50 to 160° C. Combination use of two or more kinds of these dye-providing couplers and high-boiling organic solvents is possible.

The high-boiling organic solvent is used in an amount of generally 10 g or less, preferably 5 g or less, and more preferably 1 to 0.1 g, per g of the hydrophobic additives to be used. The amount is also preferably 1 ml or less, more preferably 0.5 ml or less, and particularly preferably 0.3 ml or less, per g of the binder.

A dispersion method that uses a polymer, as described in JP-B-51-39853 and JP-A-51-59943, and a method wherein the addition is made with them in the form of a dispersion of fine particles, as described, for example, in JP-A-62-30242, can also be used.

If the hydrophobic additives are compounds substantially insoluble in water, besides the above methods, a method can be used wherein the compounds may be made into fine particles to be dispersed and contained in a binder.

In dispersing the hydrophobic compound in a hydrophilic colloid, various surface-active agents can be used. Examples of the surface-active agents that can be used include those described in JP-A-59-157636, pages (37) to (38), and in the RD publication shown above. Further, phosphate-series surface-active agents described in JP-A-7-56,267, JP-A-7-228,589, and West Germany Patent Publication No. 1,932,299 A, can be used.

To the color light-sensitive material of the present invention, it is necessary to provide, on a support (base), at least three photosensitive layers photosensitive to respectively different spectral regions. A typical example is a silver halide photographic light-sensitive material having on a support at least three photosensitive layers, each of which comprises a plurality of silver halide emulsion layers whose color sensitivities are substantially identical but whose sensitivities are different. The photosensitive layer is a unit photosensitive layer having color sensitivity to any of blue light, green light, and red light, and in a multilayer silver halide color photographic light-sensitive material, the arrangement of the unit photosensitive layers is generally such that a red-sensitive layer, a green-sensitive layer, and a blue-sensitive layer in the order stated from the support side are placed. However, the above order may be reversed according to the purpose, and such an order is possible that layers having the same color sensitivity have a layer different in color sensitivity therefrom between them. Nonphotosensitive layers may be placed between, on top of, or under the above-mentioned silver halide photosensitive layers. These layers may contain, for example, the above-described couplers, developing agents, DIR compounds, color-mixing inhibitors, and dyes. Each of the silver halide emulsion layers constituting unit photosensitive layers respectively can preferably take a two-layer constitution comprising a high-sensitive emulsion layer and a low-sensitive emulsion layer, as described in DE 1 121 470 or GB Patent No. 923 045. Generally, they are preferably arranged such that the sensitivities are decreased toward the support. As described, for example, in JP-A-57-112751, JP-A-62-200350, JP-A-62-206541, and JP-A-62-206543, a low-sensitive emulsion layer may be placed away from the support, and a high-sensitive emulsion layer may be placed nearer to the support.

A specific example of the order includes an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), or an order of BH/BL/GL/GH/RH/RL, or an order of BH/BL/GH/GL/RL/RH, stated from the side away from the support.

As described in JP-B-55-34932, an order of a blue-sensitive layer/GH/RH/GL/RL stated from the side away from the support is also possible. Further as described in JP-A-56-25738 and JP-A-62-63936, an order of a blue-sensitive layer/GL/RL/GH/RH stated from the side away from the support is also possible.

Further as described in JP-B-49-15495, an arrangement is possible wherein the upper layer is a silver halide emulsion layer highest in sensitivity, the intermediate layer is a silver halide emulsion layer lower in sensitivity than that of the upper layer, the lower layer is a silver halide emulsion layer further lower in sensitivity than that of the intermediate layer, so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity as described in JP-A-59-202464.

Further, for example, an order of a high-sensitive emulsion layer/low-sensitive emulsion layer/medium-sensitive emulsion layer, or an order of a low-sensitive emulsion layer/medium-sensitive emulsion layer/high-sensitive emulsion layer can be taken. In the case of four layers or more layers, the arrangement can be varied as above.

In the present invention, it is preferable to contain at least two types of silver halide emulsions that have sensitivity at the same wavelength region but that are different from each other in average projected area of grains. The term "having light-sensitivity at the same wavelength region" referred to in the present invention means that the silver halide emulsions have photographic sensitivity at the substantially same wavelength region. Accordingly, even emulsions that slightly differ in the distribution of spectral sensitivity are deemed to be emulsions having sensitivity in the same wavelength region, as long as their primary sensitive regions overlap each other.

In the above case, preferably the difference of the values of the average projected area of grains between the emulsions is at least 1.25 times. The difference is more preferably 1.4 times or more, and most preferably 1.6 times or more. When the emulsions to be used are three or more types, preferably the above-mentioned relation is fulfilled between an emulsion having the smallest average projected area of grains and an emulsion having the largest average projected area of grains.

In the present invention, in order to contain such plural emulsions that have light-sensitivity in the same wavelength region and differ from each other in the average grain-projected area, either each emulsion can be coated to form a separate light-sensitive layer, respectively, or the above plural emulsions may be mixed and contained in one light-sensitive layer.

When these emulsions are contained in separate respective layers it is preferable to arrange an emulsion having a large average grain-projected area on a upper layer (at the position close to the direction of incident light).

When these emulsions are contained in separate respective light-sensitive layers, as a color coupler to be used in combination, those having the same hue are preferably used. However, a coupler that develops a different hue may be mixed, to make the developed color hue of every light-sensitive layer different, or a coupler having a different absorption profile of a developed color hue may be used in each light-sensitive layer.

In the present invention, when these emulsions having light-sensitivity in the same wavelength region are applied, it is preferable to have constitution, wherein the ratio of the number of silver halide grains of an emulsion per unit area of a light-sensitive material is larger than the ratio of the value calculated by dividing the coated amount of silver of the emulsion, by the three-second (3/2) power of the average grain-projected area of the silver halide grains contained in the emulsion, and the larger the average projected area of grains an emulsion has, the larger the difference of the two ratios becomes. With such a constitution, an image having better granulation can be obtained, even in such a developing condition as heating to high temperatures. Also, high developing ability and wide exposure latitude can be satisfied at the same time.

The total coating amount of silver in the light-sensitive material, which is defined to obtain the effect of the present invention, is the total amount of silver (in terms of metal silver) utilized, in addition to silver halide contained in these silver halide emulsions, for example, in nonphotosensitive silver halide emulsion contained in light-sensitive layers and non-light-sensitive layers, and organometal salts additionally used as an oxidizing agent, and further, colloidal silver used in an antihalation layer or a yellow filter layer.

In the conventional color negative films for photographing, in order to attain a target granularity, a technology, for example, one using a so-called DIR coupler, which releases a development-inhibiting compound, at the time of coupling reaction with an oxidized product of a developing agent, has been employed, in addition to the improvement of the silver halide emulsion. In the light-sensitive material of the present invention, excellent granularity can be obtained without using any DIR coupler. If a DIR compound is used in combination, the granularity becomes more and more excellent.

In order to improve color reproduction, as described in U.S. Pat. Nos. 4,663,271, 4,705,744, and 4,704,436, and JP-A-62-160448 and JP-A-63-89850, it is preferable to form a donor layer (CL), which has a spectral sensitivity distribution different from those of a principal (main) light-sensitive layer, such as BL, GL and RL, and which has an inter-layer effect, in a position adjacent or in close proximity to the principal light-sensitive layer.

In the present invention, although a silver halide, a dye-providing coupler, and a color-developing agent may be contained in the same layer, these substances may be contained in different layers if these substances are present in a reactive state. For example, if the layer containing a color developing agent and the layer containing a silver halide are different, the raw stock storability of light-sensitive materials can be improved.

In the present invention, color reproduction according to a subtractive color process can be basically used for the preparation of a light-sensitive material to be used for recording an original scene and reproducing the original scene as a color image. That is, the color information of the original scene can be recorded by providing at least three light-sensitive layers, each having sensitivity to the blue, green, and red wavelength region of light, respectively, and by incorporating, respectively, a color coupler capable of producing a yellow, magenta, or cyan dye as a complementary color to the sensitive wavelength region of the sensitive layer. Through the thus obtained color image, color photographic paper, which has a relationship between sensitive wavelength and developed color hue identical to that of the light-sensitive material, is exposed to light to thereby reproduce the original scene. Alternatively, it is also possible to read out by means of a scanner the information of the color dye image obtained by taking a photograph of an original scene, and to reproduce an image for enjoyment based on the information read out.

The light-sensitive material of the present invention can comprise light-sensitive layers sensitive to three kinds or more wavelength regions.

In addition, the relationship between the sensitive wavelength region and developed color hue may be different from the complementary color relationship described above. In this case, it is possible to reproduce the original color information by conducting image processing, e.g., color hue conversion, after the image information is read out as described above.

Although the relationship between the spectral sensitivity and the hue resulting from the coupler is arbitrary in each layer, direct projection exposure onto conventional color paper is possible if a cyan coupler is used in the red-sensitive layer, a magenta coupler is used in the green-sensitive layer, and a yellow coupler is used in the blue-sensitive layer.

In the light-sensitive material, various non-light-sensitive layers can be provided, such as a protective layer, an under layer (undercoat layer), an intermediate layer, a yellow filter layer, and an antihalation layer, between the above silver halide emulsion layers, or as an uppermost layer or a lowermost layer; and on the opposite side of the photographic support, various auxiliary layers can be provided, such as a backing layer. Specifically, for example, layer constitutions as described in the above-mentioned patent publications, undercoat layers as described in U.S. Pat. No. 5,051,335, intermediate layers containing a solid pigment, as described in JP-A-1-167,838 and JP-A-61-20,943, intermediate layers containing a reducing agent or a DIR compound, as described in JP-A-1-120,553, JP-A-5-34,884, and JP-A-2-64,634, intermediate layers containing an electron transfer agent, as described in U.S. Pat. Nos. 5,017,454 and 5,139,919, and JP-A-2-235,044, protective layers containing a reducing agent, as described in JP-A-4-249,245, or combinations of these layers, can be provided.

In the present invention, the dye, which can be used in a yellow filter layer, a magenta filter layer, or in an antihalation layer, is preferably a dye whose component is transferred from the light-sensitive material to a processing material at the time of development or reacts to be converted into a colorless compound at the time of development, so that the amount of the dye remaining after the developing process is generally less than one third, preferably less than one tenth, of the amount of the dye present immediately before the coating, thus making no contribution to the photographic density after the process.

Specifically, dyes described in European Patent Application EP No. 549,489A, and dyes ExF 2 to 6 described in JP-A-7-152129, can be mentioned. A solid-dispersed dye as described in JP-A-8-101487 can also be used.

The dye may also be mordanted with a mordant and a binder. In this case, as the mordant and the dye, those known in the field of photography can be used, and examples include mordants described, for example, in U.S. Pat. No. 4,500,626, columns 58 to 59, and JP-A-61-88256, pages 32 to 41, JP-A-62-244043, and JP-A-62-244036.

Further, a reducing agent and a compound that can react with the reducing agent to release a diffusible dye can be used to cause a movable dye to be released with an alkali at the time of development, to be dissolved into the processing solution or to be transferred to the processing material, to thereby be removed. Specifically, examples are described in U.S. Pat. Nos. 4,559,290 and 4,783,396, European Patent No. 220,746 A2, and Kokai-Giho No. 87-6119, as well as JP-A-8-101487, paragraph Nos. 0080 to 0081.

Leuco dyes or the like that lose their color can be used, and specifically, a silver halide light-sensitive material containing a leuco dye that has been color-formed previously with a developer of an organic acid metal salt, is disclosed in JP-A-1-150132.

As the base (support) of the light-sensitive material in the present invention, those that are transparent and can withstand the processing temperature, are used. Generally, photographic bases, such as papers and synthetic polymers (films) described in "Shashin Kogaku no Kiso—Ginen Shashin-hen—," edited by Nihon Shashin-gakkai and published by Korona-sha, 1979, pages (223) to (240), can be mentioned. Specifically, use is made of polyethylene terephthalates, polyethylene naphthalates, polycarbonates, polyvinyl chlorides, polystyrenes, polypropylenes, polyimides, celluloses (e.g., triacetylcellulose), and the like.

Among the supports, a polyester composed mainly of polyethylene naphthalate is particularly preferable. The term "a polyester composed mainly of polyethylene naphthalate" as used herein means a polyester whose naphthalenedicarboxylic acid-component content in total dicarboxylic acid residues is preferably 50 mol % or more, more preferably 60 mol % or more, and even more preferably 70 mol % or more. This may be a copolymer or a polymer blend.

In the case of a copolymer, a copolymer, which has a unit of terephthalic acid, bisphenol A, cyclohexanedimethanol or the like, copolymerized therein, besides naphthalenedicarboxylic acid units and ethylene glycol units, is also preferable. Among these copolymers, a copolymer, in which terephthalic acid units are copolymerized, is most preferable from the standpoint of mechanical strength and costs.

Preferred examples of the counterpart for forming the polymer blend are polyesters, such as polyethylene terephthalate (PET), polyarylate (PAr), polycarbonate (PC), and polycyclohexanedimethanolterephthalate (PCT), from the standpoint of compatibility. Among these polymer blends, a polymer blend with PET is preferable, from the standpoint of mechanical strength and costs.

Particularly when heat resistance and curling properties are severely demanded, bases that are described as bases for light-sensitive materials in JP-A-6-41281, JP-A-6-43581, JP-A-6-51426, JP-A-6-51437, JP-A-6-51442, JP-A-6-82961, JP-A-6-82960, Japanese Patent Application No. 4-253545, JP-A-6-82959, JP-A-6-67346, Japanese Patent Application Nos. 4-221538, 5-21625, JP-A-6-202277, JP-A-6-175282, JP-A-6-118561, JP-A-7-219129, and JP-A-7-219144, can be preferably used.

Further, a base of a styrene-series polymer having mainly a syndiotactic structure can be preferably used. The thickness of the base is preferably 5 to 200 $\mu$m, more preferably 40 to 120 $\mu$m.

These supports are preferably subjected to a surface treatment, in order to achieve strong adhesion between the support and a photographic constituting layer. For the above-mentioned surface treatment, various surface-activation treatments can be used, such as a chemical treatment, a mechanical treatment, a corona discharge treatment, a flame treatment, an ultraviolet ray treatment, a high-frequency treatment, a glow discharge treatment, an active plasma treatment, a laser treatment, a mixed acid treatment, and an ozone oxidation treatment. Among the surface treatments, an ultraviolet irradiation treatment, a flame treatment, a corona treatment, and a grow treatment are preferable.

Next, with respect to the undercoating technique, a single layer or two or more layers may be used. As the binder for the undercoat layer, for example, copolymers produced by using, as a starting material, a monomer selected from among vinyl chloride, vinylidene chloride, butadiene, methacrylic acid, acrylic acid, itaconic acid, maleic anhydride, and the like, as well as polyethylene imines, epoxy resins, grafted gelatins, nitrocelluloses, gelatins, polyvinyl alcohol, and modified polymers thereof can be mentioned. As compounds that can swell the base, resorcin and p-chlorophenol can be mentioned. As gelatin hardening agents in the undercoat layer, chrome salts (e.g. chrome alum), aldehydes (e.g. formaldehyde and glutaraldehyde), isocyanates, active halogen compounds (e.g. 2,4-dichloro-6-hydroxy-s-triazine), epichlorohydrin resins, active vinyl sulfone compounds, and the like can be mentioned. $SiO_2$, $TiO_2$, inorganic fine particles, or polymethyl methacrylate copolymer fine particles (0.01 to 10 $\mu$m) may be included as a matting agent.

As for the color tone (hue) of the dye to be used for dyeing films, dyeing in gray is preferable in view of general characteristics of light-sensitive materials. A dye, which has excellent resistance to heat within the film forming temperature range, and excellent compatibility with polyester, is preferable. In this regard, the purpose can be achieved by blending dyes, such as Diaresin (trade name) manufactured by Mitsubishi Chemicals Industries Ltd. or Kayaset (trade name) manufactured by Nippon Kayaku Co., Ltd., which are commercially available as dyes for polyesters. From the standpoint of heat resistance in particular, an anthraquinone-series dye can be mentioned. For example, the dye described in JP-A-8-122970 is preferable for use.

Further, as the base, bases having a magnetic recording layer, as described, for example, in JP-A-4-124645, JP-A-5-40321, JP-A-6-35092, and JP-A-6-317875, is preferably used to record photographing information or the like.

The magnetic recording layer refers to a layer formed by coating a base with an aqueous or organic solvent coating solution containing magnetic particles dispersed in a binder.

To prepare the magnetic particles, use can be made of a ferromagnetic iron oxide, such as $\gamma Fe_2O_3$, Co-coated $\gamma Fe_2O_3$, Co-coated magnetite, Co-containing magnetite, ferromagnetic chromium dioxide, a ferromagnetic metal, a ferromagnetic alloy, hexagonal Ba ferrite, Sr ferrite, Pb ferrite, and Ca ferrite. A Co-coated ferromagnetic iron oxide, such as Co-coated $\gamma Fe_2O_3$, is preferable. The shape may be any of a needle shape, a rice grain shape, a spherical shape, a cubic shape, a plate-like shape, and the like. The specific surface area is preferably 20 $m^2/g$ or more, and particularly preferably 30 $m^2/g$ or more, in terms of $S_{BET}$. The saturation magnetization ($\sigma s$) of the ferromagnetic material is preferably $3.0\times10^4$ to $3.0\times10^5$ A/m, and particularly preferably $4.0\times10^4$ to $2.5\times10^5$ A/m. The ferromagnetic particles may be surface-treated with silica and/or alumina or an organic material. The surface of the magnetic particles may be treated with a silane coupling agent or a titanium coupling agent, as described in JP-A-6-161032. Further, magnetic particles whose surface is coated with an inorganic or organic material, as described in JP-A-4-259911 and JP-A-5-81652, can be used.

The polyester base is heat-treated at a heat treatment temperature of generally 40° C. or over, but less than the Tg, and preferably at a heat treatment temperature of the Tg−20° C. or more, but less than the Tg, so that it will hardly have core set curl. The heat treatment may be carried out at a constant temperature in the above temperature range, or it may be carried out with cooling. The heat treatment time is generally 0.1 hours or more, but 1,500 hours or less, and preferably 0.5 hours or more, but 200 hours or less. The heat treatment of the base may be carried out with the base rolled, or it may be carried out with it being conveyed in the form of web. The surface of the base may be made rough (unevenness, for example, by applying electroconductive inorganic fine particles, such as $SnO_2$ and $Sb_2O_5$), so that the surface state may be improved. Further, it is desirable to provide, for example, a rollette (knurling) at the both ends for the width of the base (both right and left ends towards the direction of rolling) to increase the thickness only at the ends, so that a trouble of deformation of the base will be prevented. The trouble of deformation of the support means that, when a support is wound on a core, on its second and further windings, the support follows unevenness of its cut edge of the first winding, deforming its flat film-shape. These heat treatments may be carried out at any stage after the production of the base film, after the surface treatment, after the coating of a backing layer (e.g. with an antistatic agent and a slipping agent), and after coating of an undercoat, with preference given to after coating of an antistatic agent.

Into the polyester may be blended (kneaded) an ultraviolet absorber. Further, prevention of light piping can be attained by blending dyes or pigments commercially available for polyesters, such as Diaresin (trade name, manufactured by Mitsubisi Chemical Industries Ltd.), and Kayaset (trade name, manufactured by Nippon Kayaku Co., Ltd.).

Now, film patrones, into which the light-sensitive material can be housed, are described.

The major material of the patrone to be used in the present invention may be metal or synthetic plastic.

Further, the patrone may be one in which a spool is rotated to deliver a film. Also the structure may be such that the forward end of film is housed in the patrone body, and by rotating a spool shaft in the delivering direction, the forward end of the film is delivered out from a port of the patrone. These patrones are disclosed in U.S. Pat. Nos. 4,834,306, and 5,226,613.

The light-sensitive material as shown above can also be preferably used for a film unit with a lens, as described in, for example, JP-B-2-32615 and JU-B-3-39784 (the term "JU-B" used herein means an "examined Japanese utility model publication).

The film unit with a lens is one obtained by pre-loading, in a light-proofing manner, an unexposed color or monochrome photographic light-sensitive material, in a production process of a unit main body having, for example, an injection-molded plastic body, equipped with a photographing lens and shutter. The unit after photographing by a user, is transported as such to a developing laboratory for development. In the laboratory, the photographed film is taken out of this unit, and development processing and photographic printing are carried out.

In the present invention, a processing material is preferably used, which contains at least a base and/or a base precursor in a layer of the processing material.

As the base, an inorganic or organic base can be used. Examples of the inorganic base include the hydroxide, the phosphate, the carbonate, the borate, and an organic acid salt of an alkali metal or an alkali earth metal described in JP-A-62-209448, and the acetylide of an alkali metal or an alkali earth metal described, for example, in JP-A-63-25208.

Further, examples of the organic base include ammonia, aliphatic or aromatic amines (e.g. primary amines, secondary amines, tertiary amines, polyamines, hydroxylamines, and heterocyclic amines), amidines; bis-, tris-, or tetra-amidines; guanidines; water-insoluble mono-, bis-, tris-, or tetra-guanidines; and quaternary ammonium hydroxides.

Examples of the base precursors that can be used include those of the decarboxylation type, the decomposition type, the reaction type, the complex salt formation type, and the like. In the present invention, as is described in EP-A-210,660 and U.S. Pat. No. 4,740,445, a method is effectively employed wherein a base is produced by means of a combination of a basic metal compound that is hardly soluble in water, as a base precursor, with a compound (referred to as a complex-forming compound) capable of a complex-forming reaction with the metal ion constituting that basic metal compound, using water as a medium. In this case, although it is desirable to add the basic metal compound that is hardly soluble in water to the light-sensitive material, and to add the complex-forming compound to the processing material, the procedure may be reversed.

The amount to be added of the base or the base precursor is generally 0.1 to 20 g/m$^2$, and preferably 1 to 10 g/m$^2$.

The same hydrophilic polymer as the one for use in the light-sensitive material may be used as the binder in a processing layer.

It is preferable that the processing material is hardened by the same hardener as the one for use in the light-sensitive material.

The processing material may contain a mordant for the purpose of removing by transfer the dyes used in the yellow filter layer or antihalation layer of the light-sensitive material, as described previously, or for other purposes. A polymeric mordant is preferable as the mordant. Examples of the polymeric mordant include a polymer containing a secondary or tertiary amino group, a polymer having a nitrogen-containing heterocyclic moiety, a polymer containing a quaternary cationic group made from such amino group or nitrogen-containing heterocyclic moiety, and the like. The molecular weight of the polymeric mordant is generally 5,000 to 200,000 and particularly 10,000 to 50,000.

The amount to be added of the mordant is generally 0.1 to 10 g/m$^2$ and preferably 0.5 to 5 g/m$^2$.

In the present invention, the processing material may contain a development-stopping agent or a precursor of the development-stopping agent, so that the development-stopping agent functions simultaneously with the development or after a certain delay from the start of the development.

Details of development-stopping agents are described in JP-A-62-190529, pp.(31)–(32).

Further, the processing material may contain a printout preventing agent for a silver halide, so that the printout preventing agent functions simultaneously with the development. Examples of the printout preventing agent include halogen compounds described in JP-B-54-164, JP-A-53-46020, JP-A-48-45228, and JP-B-57-8454, compounds of 1-phenyl-5-mercaptotetrazoles described in U.K. Patent No. 1,005,144, and viologen compounds described in JP-A-8-184936.

The amount of the printout preventing agent to be used is generally $10^{-4}$ to 1 mol, preferably $10^{-3}$ to $10^{-2}$ mol, per mol of Ag.

Meanwhile, the processing material may contain physical development nuclei and a silver halide solvent, so that the silver halide in the light-sensitive material is solubilized and fixed to the processing layer simultaneously with the development.

A reducing agent necessary for the physical development may be any of the reducing agents known in the field of light-sensitive materials. Further, a reducing agent precursor, which itself has no reducing capability, but is given a reducing capability by a nucleophilic reagent or heat in the developing process, can also be used. The developing agent, which is not consumed in the development and diffuses from the light-sensitive material, can be used as a reducing agent, or otherwise a reducing agent may be incorporated in the processing material in advance. In the latter case, the reducing agent incorporated in the processing material may be the same as or different from the reducing agent incorporated in the light-sensitive material.

In the case where a diffusive developing agent is used, an electron transferring agent and/or a precursor of an electron transferring agent may be used in combination with the diffusive developing agent, if necessary. The electron transferring agent or a precursor thereof may be selected from the reducing agents or precursors thereof enumerated previously.

If the reducing agent is added to the processing material, the amount of the reducing agent to be added is generally 0.01 to 10 g/m$^2$, and preferably 0.1 to 5 times the moles of silver in the light-sensitive material.

Examples of the physical development nuclei that can be used include any known colloidal particles of a heavy metal, such as zinc, mercury, lead, cadmium, iron, chromium, nickel, tin, cobalt, copper, or ruthenium, a noble metal, such as palladium, platinum, gold, or silver, and a compound of any of these heavy metals and noble metals with chalcogen such as sulfur, selenium or tellurium.

The particle diameters of these physical development nuclei are preferably 2 to 200 nm.

The physical development nuclei are present in an amount ranging generally from $10^{-3}$ mg/m$^2$ to 10 g/m$^2$ in the processing layer.

The silver halide solvent may be a known compound, preferred examples of which include thiosulfates, sulfites, thiocyanates, thioether compounds described in JP-B-47-11386, compounds having a 5- or 6-membered imido ring, such as urasil and hydantoin, as described in JP-A-8-179458, compounds having a sulfur-carbon double bond, as described in JP-A-53-144319, and mesoion thiolate compounds such as trimethyltriazolium thiolate, as described in "Analytica Chinica Acta", vol. 248, pp.604 to 614 (1991). A compound, as described in JP-A-8-69097, which is capable of fixing a silver halide to stabilize it, can also be used as a silver halide solvent. It is also preferable to use a combination of a plurality of the above-described silver halide solvents.

The total amount to be contained of the silver halide solvent in the processing layer is generally 0.01 to 100 mmol/m$^2$, and preferably 0.1 to 50 mmol/m . This amount ranges from generally 1/20 to 20 times, preferably from 1/10 to 10 times, and more preferably from 1/4 to 4 times the molar amount of coated silver in a light-sensitive material.

A processing material may comprise auxiliary layers such as a protective layer, a subbing layer, a backing layer, and the like, as described for the light-sensitive material.

The processing material is preferably composed of a continuous web and a processing layer coated thereon. The continuous web here refers to a mode, in which a processing material has a length sufficiently longer than the longer side of the light-sensitive material to be dealt with, and a plurality of light-sensitive materials can be processed without cutting a part of the processing material. Generally, the continuous web means that the processing material has a length 5 to 10,000 times greater than the width. Although the width of the processing material is not limited, it is preferably larger than the width of the light-sensitive material to be dealt with.

A mode, in which a plurality of light-sensitive materials are processed side by side, that is, a plurality of light-sensitive materials are arranged in rows and processed, is also preferable. In this case, the width of the processing material is preferably equal to or larger than the width of the light-sensitive material multiplied by the number of simultaneous processes.

In a process utilizing such a continuous web, the web is preferably fed from a feeding roll and wound on a windup roll so that the web can be disposed. Particularly, this disposal is easier when the processing material has a large size.

As explained above, the handling of the processing material in the form of a continuous web is much easier in comparison with the handling of a conventional processing material in the form of a sheet.

The thickness of the support for the processing material for use in the present invention is not limited, but a smaller thickness is preferable, and particularly preferably the thickness is 4 μm or more but 120 μm or less. The thickness of the support of a processing material to be used is preferably 100 μm or less, more preferably 60 μm or less, and particularly preferably 40 μm or less. This is because the amount of the processing material per unit volume increases, and therefore the roll for the processing material can be rendered compact.

The material for the support is not particularly limited, but it must withstand the processing temperature. Generally, photographic bases, such as papers and synthetic polymers (films) described in "Shashin Kogaku no Kiso—Ginen Shashin-hen—," edited by Nihon Shashin-gakkai and published by Korona-sha, 1979, pages (223) to (240), can be mentioned.

The material for a support may be used singly, or may be used in the form of a base, one or both of whose surfaces are coated or laminated with a synthetic polymer, such as polyethylenes.

In addition to the above, bases described, for example, in JP-A-62-253159, pages (29) to (31), JP-A-1-161236, pages (14) to (17), JP-A-63-316848, JP-A-2-22651, JP-A-3-56955, and U.S. Pat. No. 5,001,033 can be used.

Further, a base of a styrene-series polymer having mainly a syndiotactic structure can be preferably used.

The surface of these bases may be coated with a hydrophilic binder plus a semiconductive metal oxide, such as tin oxide and alumina sol, carbon black, and another antistatic agent. A base to which aluminum is deposited may be preferably used as well.

In the present invention, as a preferable method for subjecting to development a light-sensitive material that has been used for photographing by means of a camera is used, mention can be made the method wherein the light-sensitive material and a processing material are put together with the light-sensitive layer and the processing layer facing each other, in the presence of water in an amount of 0.1 to 1 times the amount required for the maximum swelling of all the coating films of both the light-sensitive material and the processing material, except the backing layers, and they are heated at a temperature of 60 to 100° C. for 5 to 60 sec.

Herein water may be any water generally used. Specifically, distilled water, deionized water, tap water, well water, mineral water, and the like can be used. These waters may be used preferably by adding a small amount of an antiseptic agent, to prevent scale formation, decay, or the like, or by filtering them through an activated-carbon filter, an ion-exchange resin filter, or the like, to be circulated.

In the present invention, the light-sensitive material and/or the processing material, which are swollen with water, are put together face to face and thereafter heated. Since the conditions in the swollen layers are unstable, it is important to limit the amount of water to the above-mentioned range in order to prevent localized unevenness in color development.

The amount of water which is required for the maximum swelling can be obtained by a procedure comprising the steps of: immersing, in water, a light-sensitive or processing material having a coating layer for the measuring of swell, measuring the layer thickness, and calculating the weight of the maximum swell, when the layer is found to be sufficiently swollen, and subtracting the weight of the original coated layer from the weight of the maximum swell. An example for measuring the degree of swell is described in "Photographic Science Engineering", vol. 16. pp. 449 (1972), too.

Water can be supplied to the light-sensitive material, to the processing material, or to both of them. The amount of the water to be used ranges from 1/10 to 1 time the amount which is required for the maximum swelling of the whole coating layers of both the light-sensitive material and the processing material, excepting respective backing layers.

As to the timing to supply water, the water may be supplied at any point after exposure and before heat development of the light-sensitive material. Preferably, the water is supplied immediately before the heat development.

The amount of water specified above in the present invention defines the amount of water required at the time when heat development is carried out by putting the light-sensitive material and the processing material together. Therefore, the scope of the present invention includes a method, in which water in an amount exceeding the amount specified in the present invention is supplied either to the light-sensitive material or to the processing material, and thereafter the excess water is removed by means of squeezing or the like, before these materials are put together so that heat development is carried out.

Generally, a required amount of water is supplied to the light-sensitive material or the processing material, or to both of them, or otherwise the amount of water is adjusted to a required amount by means described above, and thereafter the light-sensitive material and the processing material are put together face to face so that heat development is carried out. Alternatively, the light-sensitive material and the processing material are put together face to face, and thereafter water is supplied to the gap between these two materials so that a required amount of water is present.

Various methods can be used for supplying water. Examples of the methods for supplying water include a method in which a light-sensitive material or processing material is immersed in water and thereafter the excess water is removed by means of a squeezing roller. However, a method, in which a predetermined amount of water is supplied to the light-sensitive material or processing material by one-step coating, is preferable. A particularly preferred method is the employment of a water spraying apparatus, which is similar to a recording head in an ink jet method, comprising a plurality of nozzles, which eject water and are arranged at certain intervals in a line or in a plurality of lines, in the direction perpendicular to the direction of the transfer of the light-sensitive material or processing material, and also comprising actuators which displace the nozzles in the direction of the light-sensitive material or processing material being transferred. Further, a method, in which water is coated with a sponge or the like, onto the light-sensitive material or processing material, is also preferable, because the apparatus in this case is simple.

The preferable temperature of the water to be supplied is 30 to 60° C.

As the method of placing the light-sensitive material and the processing material together, methods described in JP-A-62-253,159 and JP-A-61-147,244, can be applied.

Example heating methods in the development step include a method wherein the photographic material is brought in contact with a heated block or plate; a method wherein the photographic material is brought in contact with a hot plate, a hot presser, a hot roller, a hot drum, a halogen lamp heater, an infrared lamp heater, or a far-infrared lamp heater; and a method wherein the photographic material is passed through a high-temperature atmosphere.

To process the photographic element in the present invention, any of various heat development apparatuses can be used. For example, apparatuses described, for example, in JP-A-59-75247, JP-A-59-177547, JP-A-59-181353, and JP-A-60-18951, JU-A-62-25944 ("JU-A" means unexamined published Japanese utility model application), JP-A-6-130509, JP-A-6-95338, JP-A-6-95267, JP-A-8-29955, and JP-A-8-29954, can be preferably used.

As a commercially available apparatus, for example, PICTROSTAT 100, PICTROSTAT 200, PICTROSTAT 300, PICTROSTAT 330, PICTROSTAT 50, PICTROGRAPHY 3000, and PICTROGRAPHY 2000 (all trade names, manufactured by Fuji Photo Film Co., Ltd.), can be used.

The light-sensitive material and/or the processing element for use in the present invention may be in the form that has an electroconductive heat-generating material layer as a heating means for heat development. In this case, as the heat-generating element, one described, for example, in JP-A-61-145544 can be employed.

In the present invention, although the image information can be read out without removing the developed silver and undeveloped silver halide resulting the development, the image can also be read out after removing the developed silver and undeveloped silver halide. In the latter case, a means, by which the developed silver and undeveloped silver halide are removed concurrently with or after the development, can be employed.

In order to remove the developed silver from the light-sensitive material concurrently with the development, or in order to complex or solubilize the silver halide, the processing material may contain an oxidizing agent for silver or a re-halogenating agent, each of which serves as a bleaching agent, or a silver halide solvent, which serves as a fixing agent, so that reactions therewith occur at the time of the heat development.

Further, after the completion of development process for image formation, a second processing material, which contains an oxidizing agent for silver, a re-halogenating agent, or a silver halide solvent, and the light-sensitive material may be put together face to face in order that the removal of the developed silver or the complexing or solubilizing of the silver halide be carried out.

In the present invention, in so far as the above-mentioned process does not provide adverse effects on the reading out of image information after photographing and image forming development that follows, it is preferable that the light-sensitive material is subjected to the above-mentioned process. In particular, since undeveloped silver halide causes significant haze in a gelatin layer to an extent that the background density of image increases, it is preferable to diminish the haze by use of the above-mentioned complexing agent or to solubilize the silver halide so that all or part of the silver halide is removed from the layer.

The silver halide photographic emulsion of the present invention can offer high contrast and good graininess, although it is high in sensitivity. Accordingly, a light-sensitive material for photographing to give an image of high quality, as well as a simple method for forming a color image using the light-sensitive material, can be provided.

The present invention is further explained in detail with reference to the following examples, but the invention is not limited thereto.

EXAMPLES

Example 1

0.74 g of gelatin, having an average molecular weight of 15,000, and 930 ml of distilled water containing 0.7 g of potassium bromide were placed in a reaction vessel, and the temperature was elevated to 40° C. 30 ml of an aqueous solution containing 0.34 g of silver nitrate and 30 ml of an aqueous solution containing 0.24 g of potassium bromide were added to the resulting solution, over 20 sec, with vigorous stirring. After the completion of the addition, the temperature was kept at 40° C. for 1 min, and then, the temperature of the reaction liquid was raised to 75° C. After 27.0 g of gelatin was added together with 200 ml of distilled water, then 100 ml of an aqueous solution containing 23.36 g of silver nitrate and 80 ml of an aqueous solution containing 16.37 g of potassium bromide were added, over 36 min, with the flow rate of the addition being accelerated. Then, 250 ml of an aqueous solution containing 83.2 g of silver nitrate, and an aqueous solution containing potassium iodide and potassium bromide in a molar ratio of 3:97 (the concentration of potassium bromide: 26%), were added, over 60 min, with the flow rate of the addition being accelerated, so that the silver electric potential of the reaction liquid would become +/−0 mV to a saturated calomel electrode. Further, 75 ml of an aqueous solution containing 18.7 g of silver nitrate, and a 21.9% aqueous solution of potassium bromide, were added, over 10 min, so that the silver electric potential of the reaction liquid would become 20 mV to the saturated calomel electrode. After the completion of the addition, the temperature was kept at 75° C. for 1 min; then the temperature of the reaction liquid was dropped to 40° C. Then, 100 ml of an aqueous solution containing 10.5 g of sodium p-iodoacetamidobenzenesulfonate (monohydrate) was added, and the pH of the reaction liquid was adjusted to 9.0. Further, 50 ml of an aqueous solution containing 4.3 g of sodium sulfite was added. After the completion of the addition, the temperature was kept 40° C. for 3 min, and the temperature of the reaction liquid was raised to 55° C. After adjusting the pH of the reaction liquid to 5.8, 0.8 mg of sodium benzenethiosulfinate and 5.5 g of potassium bromide were added, kept at 55° C. for 1 min, and further, 180 ml of an aqueous solution containing 44.3 g of silver nitrate, and 160 ml of an aqueous solution containing 34.0 g of potassium bromide were added over 30 min. The temperature was then dropped, and then desalting was carried out by the usual method. After the completion of the desalting, gelatin was added to be 7 wt %, and pH was adjusted to 6.2.

The resulting emulsion was an emulsion containing hexagonal tabular grains, wherein the average grain size (represented by a sphere-equivalent diameter, which is a diameter of a sphere having the volume equivalent to an individual grain) was 1.29 $\mu$m, the deviation coefficient of the grain size distribution was 15%, the average grain thickness was 0.32 μm, and the average aspect ratio (a ratio obtained by dividing the projected grain diameter by the grain thickness) was 6.6. This emulsion was designated as Emulsion A-1.

An emulsion was prepared in the same manner as in Emulsion A-1, except that $[Ru(NH_3)_5(4,4'\text{-bpy})]^{2+}$ (in which 4,4'-bpy represents 4,4'-bipyridine, and this applies to the formulas given hereinafter) was added to the aqueous solution of potassium bromide added at the last stage for the particle formation, at an addition rate of $2.5\times10^{-5}$ mol per mol of the silver added in this portion. This emulsion was referred to as Emulsion A-2.

An emulsion was prepared in the same manner as in Emulsion A-1, except that $[(H_3N)_5Ru(4,4'\text{-bpy})Ru[(NH_3)_5]^{4+}$ was added to the aqueous solution of potassium bromide added lastly for the formation of particles, at a rate of $2.5\times10^{-5}$ mol per mol of silver added in this portion. This emulsion was referred to as Emulsion A-3.

Separately, 0.74 g of gelatin, having an average molecular weight of 15,000, and 930 ml of distilled water containing 0.7 g of potassium bromide, were placed in a reaction vessel, and the temperature was elevated to 40° C. 30 ml of an aqueous solution containing 0.34 g of silver nitrate, and 30 ml of an aqueous solution containing 0.24 g of potassium bromide, were added to the resulting solution, over 20 sec, with vigorous stirring. After the completion of the addition, the temperature was kept at 40° C. for 1 min, and then, the temperature of the reaction liquid was raised to 75° C. After 27.0 g of gelatin was added together with 200 ml of distilled water, then 100 ml of an aqueous solution containing 23.36 g of silver nitrate, and 80 ml of an aqueous solution containing 16.37 g of potassium bromide, were added, over 36 min, with the flow rate of the addition being accelerated. Then, 250 ml of an aqueous solution containing 83.2 g of silver nitrate, and an aqueous solution containing potassium iodide and potassium bromide in a molar ratio of 3:97 (the concentration of potassium bromide: 26%), were added, over 60 min, with the flow rate of the addition being accelerated, so that the silver electric potential of the reaction liquid would become −20 mV to a saturated calomel electrode. Further, 75 ml of an aqueous solution containing 18.7 g of silver nitrate, and a 21.9% aqueous solution of potassium bromide, were added, over 10 min, so that the silver electric potential of the reaction liquid would become 20 mV to the saturated calomel electrode. After the completion of the addition, the temperature was kept at 75° C. for 1 min; then the temperature of the reaction liquid was dropped to 40° C. Then, 100 ml of an aqueous solution containing 10.5 g of sodium p-iodoacetamidobenzenesulfonate (monchydrate) was added, and the pH of the reaction liquid was adjusted to 9.0. Further, 50 ml of an aqueous solution containing 4.3 g of sodium sulfite was added. After the completion of the addition, the temperature was kept 40° C. for 3 min, and the temperature of the reaction liquid was raised to 55° C. After adjusting the pH of the reaction liquid to 5.8, 0.8 mg of sodium benzenethiosulfinate and 5.5 g of potassium bromide were added, kept at 55° C. for 1 min, and further, 180 ml of an aqueous solution containing 44.3 g of silver nitrate, and 160 ml of an aqueous solution containing 34.0 g of potassium bromide were added over 30 min. The temperature was then dropped, and then desalting was carried out according to the usual method. After the completion of the desalting, gelatin was added to be 7 wt %, and pH was adjusted to 6.2.

The resulting emulsion was an emulsion containing hexagonal tabular grains, wherein the average grain size (represented by a sphere-equivalent diameter) was 1.29 μm, the deviation coefficient of the grain size distribution was 17%, the average grain thickness was 0.27 μm, and the average aspect ratio that was the ratio obtained by dividing the grain's projected diameter by the grain thickness, was 8.5. This emulsion was designated as Emulsion A-4.

An emulsion was prepared in the same manner as in Emulsion A-4, except that $[Ru(NH_3)_5(4,4'\text{-bpy})]^{2+}$ (in which 4,4'-bpy represents 4,4'-bipyridine) was added to the aqueous solution of potassium bromide added lastly for the formation of particles, at a rate of $2.5\times10^{-5}$ mol per mol of silver added in this portion. This emulsion was referred to as Emulsion A-5.

An emulsion was prepared in the same manner as in Emulsion A-4, except that $[(H_3N)_5Ru(4,4'\text{-bpy})Ru[(NH_3)_5]^{4+}$ was added to the aqueous solution of potassium bromide added lastly for the formation of particles, at a rate of $2.5\times10^{-5}$ mol per mol of silver added in this portion. This emulsion was referred to as Emulsion A-6.

Separately, 0.37 g of gelatin, having an average molecular weight of 15,000, and 930 ml of distilled water containing 0.37 g of acid-processed gelatin and 0.7 g of potassium bromide, were placed in a reaction vessel, and the temperature was elevated to 40° C. 30 ml of an aqueous solution containing 0.34 g of silver nitrate, and 30 ml of an aqueous solution containing 0.24 g of potassium bromide, were added to the resulting solution, over 20 sec, with vigorous stirring. After the completion of the addition, the temperature was kept at 40° C. for 1 min, and then, the temperature of the reaction liquid was raised to 75° C. After 27.0 g of gelatin whose amino group was modified with trimellitic acid, was added together with 200 ml of distilled water, and then 100 ml of an aqueous solution containing 23.36 g of silver nitrate and 80 ml of an aqueous solution containing 16.37 g of potassium bromide were added, over 36 min, with the flow rate of the addition being accelerated. Then, 250 ml of an aqueous solution containing 83.2 g of silver nitrate, and an aqueous solution containing potassium iodide and potassium bromide in a molar ratio of 3:97 (the concentration of potassium bromide: 26%), were added, over 60 min, with the flow rate of the addition being accelerated, so that the silver electric potential of the reaction liquid would become −50 mV to a saturated calomel electrode. Further, 75 ml of an aqueous solution containing 18.7 g of silver nitrate, and a 21.9% aqueous solution of potassium bromide, were added, over 10 min, so that the silver electric potential of the reaction liquid would become 0 mV to the saturated calomel electrode. After the completion of the addition, the temperature was kept at 75° C. for 1 min; then the temperature of the reaction liquid was dropped to 40° C. Then, 100 ml of an aqueous solution containing 10.5 g of sodium p-iodoacetamidobenzenesulfonate (monohydrate) was added, and the pH of the reaction liquid was adjusted to 9.0. Further, 50 ml of an aqueous solution containing 4.3 g of sodium sulfite was added. After the completion of the addition, the temperature was kept at 40° C. for 3 min, and the temperature of the reaction liquid was raised to 55° C. After adjusting the pH of the reaction liquid to 5.8, 0.8 mg of sodium benzenethiosulfinate and 5.5 g of potassium bromide were added, kept at 55° C. for 1 min, and further, 180 ml of an aqueous solution containing 44.3 g of silver nitrate, and 160 ml of an aqueous solution containing 34.0 g of potassium bromide were added over 30 min. The temperature was then dropped, and then desalting was carried out by the usual method. After the completion of the desalting, gelatin was added to be 7 wt %, and pH was adjusted to 6.2.

The resulting emulsion was an emulsion containing hexagonal tabular grains, wherein the average grain size (represented by a sphere-equivalent diameter) was 1.29 μm, the deviation coefficient of the grain size distribution was 19%, the average grain thickness was 0.13 μm, and the average aspect ratio was 25.4. This emulsion was designated as Emulsion A-7.

Two kinds of emulsions were prepared in the same manner as in Emulsion A-7, except that $[Ru(NH_3)_5(4,4'\text{-bpy})]^{2+}$ (in which 4,4'-bpy represents 4,4'-bipyridine), was added to the aqueous solution of potassium bromide added lastly for the formation of particles, at the rate of $2.5\times10^{-5}$ mol or $1\times10^{-4}$ mol, per mol of silver added to in this portion. These emulsions were referred to as Emulsions A-8 and A-9, respectively.

Two kinds of emulsions were prepared in the same manner as in Emulsion A-7, except that $[(H_3N)_5Ru(4,4'\text{-bpy})Ru[(NH_3)_5]^{4+}$ was added to the aqueous solution of potassium bromide added lastly for the formation of particles, at the rate of $2.5\times10^{-5}$ mol or $1\times10^{-4}$ mol, per mol of silver added to in this portion. These emulsions were referred to as Emulsions A-10 and A-11, respectively.

5.6 ml of an aqueous 1% potassium iodide solution was added to the Emulsion A-1 at a temperature of 40° C., to which were then added $4.4\times10^{-4}$ mols of red-sensitive spectrally-sensitizing dyes shown below, Compound I, potassium thiocyanate, chloroauric acid, sodium thiosulfate, and mono(pentafluorophenyl)diphenylphosphineselenide, to carry out spectral sensitization and chemical sensitization. After the chemical sensitization was completed, Stabilizer S was added. At this time, the amount of the chemical sensitizer was adjusted so as to make the level of chemical sensitization for the emulsion optimal. The resulting spectrally-sensitized and chemically-sensitized emulsion was designated to as Emulsion A-1r.

Red-sensitive sensitizing dye
A mixture in 4:1:5 (molar ratio)

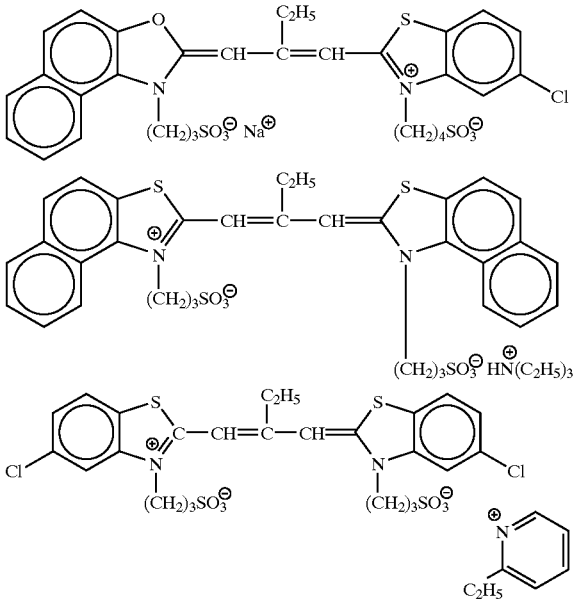

Compound I

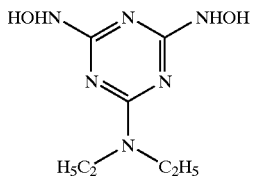

-continued

Stabilizer S (mixture described below)

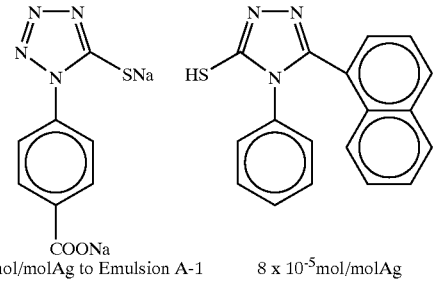

2 x $10^{-4}$mol/molAg to Emulsion A-1 | 8 x $10^{-5}$mol/molAg to Emulsion A-1

The Emulsions A-2, A-3, A-4, A-5, A-6, A-7, A-8, A-9, A-10, and A-11 were subjected to spectral sensitization and chemical sensitization in the same manner as above, to give Emulsions A-2r, A-3r, A-4r, A-5r, A-6r, A-7r, A-8r, A-9r, A-10r, and A-11r, respectively; however, the amount of spectral-sensitizing dye to be added was adjusted in proportion to the surface area of the emulsion grains.

Separately, a dispersion of zinc hydroxide, which was used as a base precursor, was prepared.

31 g of zinc hydroxide powder, whose primary particles had a grain size of 0.2 $\mu$m, 0.4 g of sodium polyacrylate and 1.6 g of carboxymethyl cellulose, as a dispersant, 8.5 g of lime-processed ossein gelatin, and 158.5 ml of water were mixed together, and the mixture was dispersed by a mill containing glass beads for 1 hour. After the dispersion, the glass beads were filtered off, to obtain 188 g of a dispersion of zinc hydroxide.

Further, an emulsified dispersion containing a coupler and a built-in developing agent was prepared.

10.78 g of Cyan coupler (a), 8.14 g of Developing agent (b), 1.05 g of Developing agent (c), 0.15 g of Antifogging agent(d), 8.27 g of High-boiling organic solvent (e), and 38.0 ml of ethyl acetate were dissolved at a temperature of 60° C. The resulting solution was mixed with 150 g of an aqueous solution containing 12.2 g of lime-processed gelatin and 0.8 g of Surfactant (sodium dodecylbenzenesulfonate) (f) dissolved therein, and the resultant mixture was emulsified and dispersed at 10,000 rpm for 20 minutes using a dissolver stirrer. After the dispersion, distilled water was added to bring the total weight to 300 g, and they were mixed at 2,000 rpm for 10 minutes.

Cyan coupler (a)

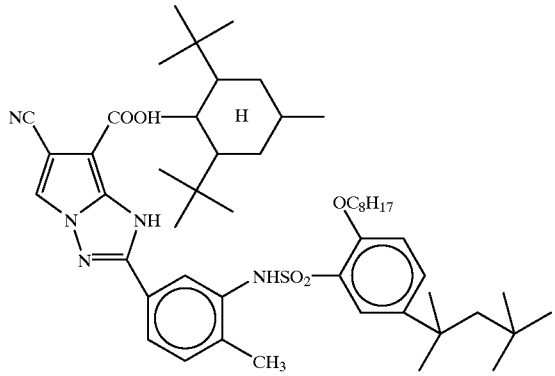

-continued

Developing agent (b)

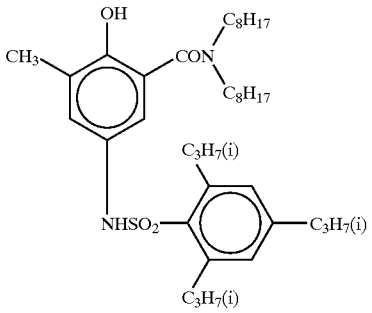

Developing agent (c)

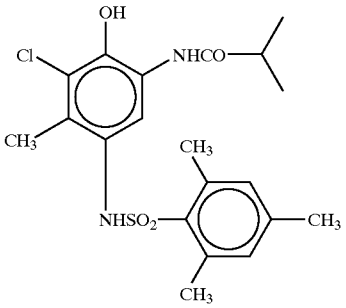

-continued antifoggant (d)

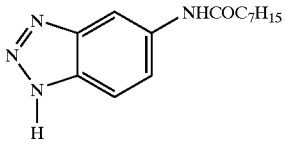

High-boiling organic solvent (e)

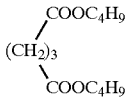

Surface-active agent (f)

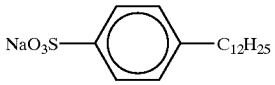

Further, a dispersion of dye for coloring for use in an antihalation layer, was prepared in the same manner.

The dyes and the high-boiling organic solvent used to disperse the dye were shown below.

Cyan dye (g)

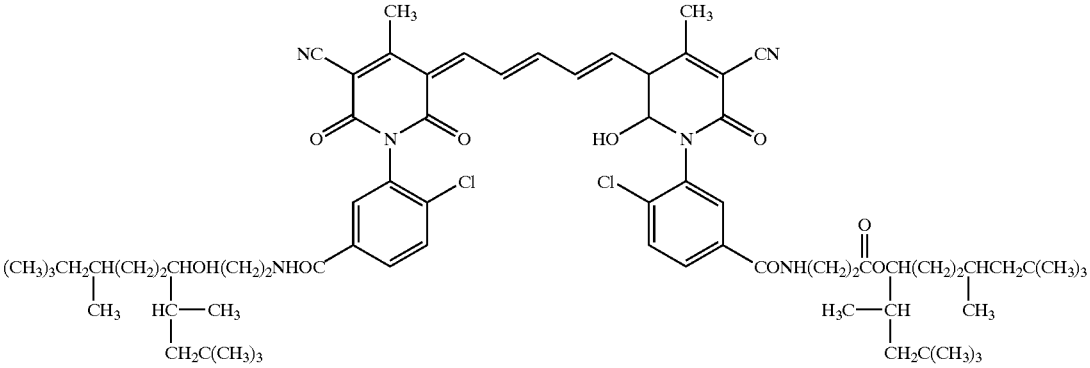

High-boiling organic solvent (h)

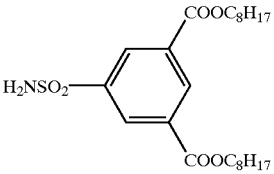

Samples 101 to 110 of a multi-layer color photographic light-sensitive material were prepared by coating, in combination, these dispersions and the silver halide emulsions prepared in the above, on the support, to have the compositions shown in Table 1. The characteristics of the emulsions used are shown in Table 2.

TABLE 1

| | | Sample 101 | Sample 102 | Sample 103 | Sample 104 | Sample 105 | Sample 106 | Sample 107 | Sample 108 | Sample 109 | Sample 110 | Sample 111 |
|---|---|---|---|---|---|---|---|---|---|---|---|---|
| Protective layer | Lime-processed gelatin | 1000 | 1000 | 1000 | 1000 | 1000 | 1000 | 1000 | 1000 | 1000 | 1000 | 1000 |
| | Matting agent (silica) | 50 | 50 | 50 | 50 | 50 | 50 | 50 | 50 | 50 | 50 | 50 |
| | Surfactant(i) | 100 | 100 | 100 | 100 | 100 | 100 | 100 | 100 | 100 | 100 | 100 |
| | Surfactant(j) | 300 | 300 | 300 | 300 | 300 | 300 | 300 | 300 | 300 | 300 | 300 |
| | Water soluble polymer(k) | 15 | 15 | 15 | 15 | 15 | 15 | 15 | 15 | 15 | 15 | 15 |
| | Hardener(l) | 40 | 40 | 40 | 40 | 40 | 40 | 40 | 40 | 40 | 40 | 40 |
| Intermediate layer | Lime-processed gelatin | 375 | 375 | 375 | 375 | 375 | 375 | 375 | 375 | 375 | 375 | 375 |
| | Surfactant(j) | 15 | 15 | 15 | 15 | 15 | 15 | 15 | 15 | 15 | 15 | 15 |
| | Zinc hydroxide | 1100 | 1100 | 1100 | 1100 | 1100 | 1100 | 1100 | 1100 | 1100 | 1100 | 1100 |
| | Water soluble polymer(k) | 15 | 15 | 15 | 15 | 15 | 15 | 15 | 15 | 15 | 15 | 15 |
| Cyan color-forming layer | Lime-processed gelatin | 2000 | 2000 | 2000 | 2000 | 2000 | 2000 | 2000 | 2000 | 2000 | 2000 | 2000 |
| | Emulsion (in terms of coating amount of silver) | A-1r 1726 | A-2r 1726 | A-3r 1726 | A-4r 1726 | A-5r 1726 | A-6r 1726 | A-7r 1726 | A-8r 1726 | A-9r 1726 | A-10r 1726.00 | A-11r 1726.00 |
| | Cyan coupler(a) | 696 | 696 | 696 | 696 | 696 | 696 | 696 | 696 | 696 | 696 | 696 |
| | Developing agent(b) | 526 | 526 | 526 | 526 | 526 | 526 | 526 | 526 | 526 | 526 | 526 |
| | Developing agent(c) | 68 | 68 | 68 | 68 | 68 | 68 | 68 | 68 | 68 | 68 | 68 |
| | Antifogging agent(d) | 9.70 | 9.70 | 9.70 | 9.70 | 9.70 | 9.70 | 9.70 | 9.70 | 9.70 | 9.70 | 9.70 |
| | High-boiling organic solvent(e) | 534 | 534 | 534 | 534 | 534 | 534 | 534 | 534 | 534 | 534 | 534 |
| | Surfactant(f) | 52 | 52 | 52 | 52 | 52 | 52 | 52 | 52 | 52 | 52 | 52 |
| | Water soluble polymer(k) | 14 | 14 | 14 | 14 | 14 | 14 | 14 | 14 | 14 | 14 | 14 |
| Antihalation layer | Lime-processed gelatin | 750 | 750 | 750 | 750 | 750 | 750 | 750 | 750 | 750 | 750 | 750 |
| | Dye(g) | 133 | 133 | 133 | 133 | 133 | 133 | 133 | 133 | 133 | 133 | 133 |
| | High-boiling organic Solvent(h) | 123 | 123 | 123 | 123 | 123 | 123 | 123 | 123 | 123 | 123 | 123 |
| | Surfactant(f) | 14 | 14 | 14 | 14 | 14 | 14 | 14 | 14 | 14 | 14 | 14 |
| | Water soluble polymer(k) | 15 | 15 | 15 | 15 | 15 | 15 | 15 | 15 | 15 | 15 | 15 |
| | | Transparent PET Base (120 μm) | | | | | | | | | | |

*Figure represents the coating amount (mg/m$^2$)

TABLE 2

| | Sample 101 | Sample 102 | Sample 103 | Sample 104 | Sample 105 |
|---|---|---|---|---|---|
| Emulsion used | A-1r | A-2r | A-3r | A-4r | A-5r |
| Average grain size (μm) | 1.29 | 1.29 | 1.29 | 1.29 | 1.29 |
| Average grain thickness (μm) | 0.32 | 0.32 | 0.32 | 0.27 | 0.27 |
| Average aspect ratio | 6.6 | 6.6 | 6.6 | 8.5 | 8.5 |
| Dopant | — | $[Ru(NH_3)_5(4,4'\text{-bpy})]^{2+}$ | $[(H_3N)_5Ru(4,4'\text{-bpy})Ru(NH_3)_5]^{4+}$ | — | $[Ru(NH_3)_5(4,4'\text{-bpy})]^{2+}$ |
| Concentration at the locallized portion (mol/mol Ag) | — | $2.5 \times 10^{-5}$ | $2.5 \times 10^{-5}$ | — | $2.5 \times 10^{-5}$ |
| Remarks | Comparative example | Comparative example | Comparative example | Comparative example | Comparative example |

| | Sample 106 | Sample 107 | Sample 108 | Sample 109 |
|---|---|---|---|---|
| Emulsion used | A-6r | A-7r | A-8r | A-9r |
| Average grain size (μm) | 1.29 | 1.25 | 1.25 | 1.25 |
| Average grain thickness (μm) | 0.27 | 0.13 | 0.13 | 0.13 |
| Average aspect ratio | 8.5 | 25.4 | 24.3 | 24.3 |
| Dopant | $[(H_3N)_5Ru(4,4'\text{-bpy})Ru(NH_3)_5]^{4+}$ | — | $[Ru(NH_3)_5(4,4'\text{-bpy})]^{2+}$ | $[Ru(NH_3)_5(4,4'\text{-bpy})]^{2+}$ |
| Concentration at the locallized portion (mol/mol Ag) | $2.5 \times 10^{-5}$ | — | $2.5 \times 10^{-5}$ | $1.0 \times 10^{-4}$ |
| Remarks | This invention | Comparative example | Comparative example | Comparative example |

TABLE 2-continued

| | Sample 110 | Sample 111 |
|---|---|---|
| Emulsion used | A-10r | A-11r |
| Average grain size (μm) | 1.25 | 1.25 |
| Average grain thickness (μm) | 0.13 | 0.13 |
| Average aspect ratio | 24.3 | 24.3 |
| Dopant | $[(H_3N)_5Ru(4,4'\text{-bpy})Ru(NH_3)_5]^{4+}$ | $[(H_3N)_5Ru(4,4'\text{-bpy})Ru(NH_3)_5]^{4+}$ |
| Concentration at the locallized portion (mol/mol Ag) | $25.5 \times 10^{-5}$ | $1.0 \times 10^{-4}$ |
| Remarks | This invention | This invention |

Surface-active agent (i)

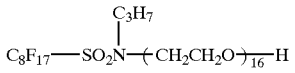

Surface-active agent (j)

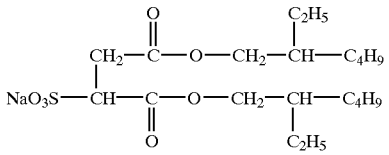

Water-soluble polymer (k)

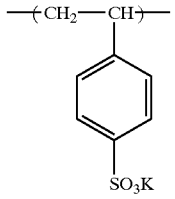

Hardener (1)

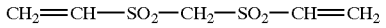

Further, processing materials P-1 and P-2 as shown in Tables 3 and 4 were prepared, respectively.

TABLE 3

Composition of Processing Material P-1

| Layer Composition | Materials added | Amount to be added ($mg/m^2$) |
|---|---|---|
| Forth layer, Protective layer | Acid-processed gelatin | 220 |
| | Water-soluble polymer (y) | 60 |
| | Water-soluble polymer (w) | 200 |
| | Additive (x) | 80 |
| | Potassium nitrate | 16 |
| | Matting agent (Z) | 10 |
| | Surfactant (r) | 7 |
| | Surfactant (aa) | 7 |
| | Surfactant (ab) | 10 |
| Third layer, Intermediate layer | Lime-processed gelatin | 240 |
| | Water-soluble polymer (w) | 24 |
| | Hardener (ac) | 180 |
| | Surfactant (f) | 9 |

TABLE 3-continued

Composition of Processing Material P-1

| Layer Composition | Materials added | Amount to be added ($mg/m^2$) |
|---|---|---|
| Second layer, Bace-forming generation layer | Lime-processed gelatin | 2100 |
| | Water-soluble polymer (w) | 360 |
| | Water-soluble polymer (ab) | 700 |
| | Water-soluble polymer (ae) | 600 |
| | High-boiling organic solvent (af) | 2120 |
| | Additive (ag) | 20 |
| | Guanidine picolinate | 2613 |
| | Potassium quinolinate | 225 |
| | Sodium quinolinate | 192 |
| | Surfactant (f) | 24 |
| First layer, Undercoat layer | Lime-processed gelatin | 247 |
| | Water-soluble polymer (y) | 12 |
| | Surfactant (r) | 14 |
| | Hardener (ac) | 178 |
| | Transparent base (63 μm) | |

TABLE 4

Composition of Processing Material P-2

| Layer Composition | Materials added | Amount to be added ($mg/m^2$) |
|---|---|---|
| Fifth layer, Protective layer | Acid-processed gelatin | 490 |
| | Matting agent (Z) | 10 |
| Forth layer, Intermediate layer | Lime-processed gelatin | 240 |
| | Hardener (ac) | 250 |
| Third layer, Solvent layer | Lime-processed gelatin | 4890 |
| | Silver halide solvent (ah) | 5770 |
| Second layer, Intermediate layer | Lime-processed gelatin | 370 |
| | Hardener (ac) | 500 |

TABLE 4-continued

Composition of Processing Material P-2

| Layer Composition | Materials added | Amount to be added ($mg/m^2$) |
|---|---|---|
| Firth layer, Undercoat layer | Lime-processed gelatin | 247 |
| | Water-soluble polymer (y) | 12 |
| | Surfactant (r) | 14 |
| | Hardener (ac) | 178 |
| | Transparent base (63 $\mu$m) | |

Water soluble polymer (y) κ (kappa)-Carrageenan
Water soluble polymer (w) Sumikagel L5-H (trade name: manufactured by Sumitomo Kagaku Co.)

Additive (x)

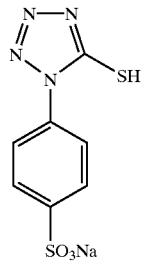

Matting agent (z)
SYLOID79
(trade name: manufactured by Fuji Davisson Kaguku Co.)

Surface-active agent (aa)

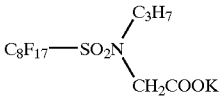

Surface-active agent (ab)

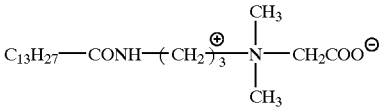

Hardener (ac)

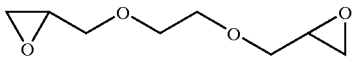

Water soluble polymer (ad) Dextran (molecular weight 70,000)
Water soluble polymer (ae) MP polymer MP102 (trade name: manufacture d by Kuraray Co.)

Surface-active agent (r)

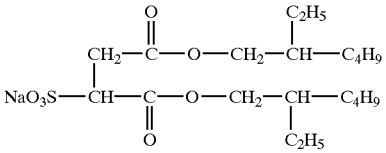

-continued

High-boiling solvent (af) EMPARA 40 (trade name: manufactured by Ajinomoto K.K.)

Additive (ag)

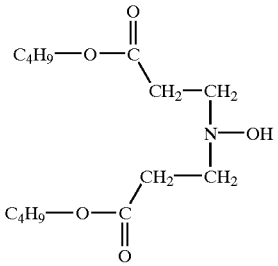

Silver halide solvent (ah)

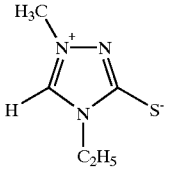

Test specimens were cut off from these light-sensitive materials and exposed to light at an intensity of 200 lux for 1/100 seconds through an optical wedge and a red-color filter, using a photographic daylight (color temperature: about 5500 K) as a light source.

10 $ml/m^2$ of 40° C. hot water was supplied to the surface of the light-sensitive material after the exposure. The film surfaces of the light-sensitive material and the processing material P-1 were overlapped on to put together, and thereafter there materials were subjected to heat development at 83° C. for 17 seconds by using a heat drum. After P-1 was peeled off, 7 $ml/m^2$ of water was applied to the surface of the light-sensitive material from which the P-1 was peeled off, and the processing material P-2 was overlapped on the surface of the light-sensitive material to put together, and further heated at 50° C. for 15 seconds.

On the test specimen of the light-sensitive material that was peeled from the processing material, a cyan color-developed image corresponding to the exposure was formed. The transmission density of the color-developed test specimen obtained after the heat development was measured, to make a so-called characteristic curve, from which minimum density (fog density), relative sensitivity, maximum color density, and contrast were calculated. As to the sensitivity, the reciprocal of exposure amount giving a density higher by 0.15 than the minimum density after the processing, in terms of optical density, was determined as the sensitivity, and the sensitivity found was shown in terms of relative value by assuming the sensitivity of the sample 101 to be 100. Contrast was expressed by an inclination (γ) between the point where the sensitivity was calculated and the point where the density was 2.0 on the characteristic curve.

The results are shown in Table 5.

TABLE 5

| | Sample 101 | Sample 102 | Sample 103 | Sample 104 | Sample 105 | Sample 106 | Sample 107 | Sample 108 | Sample 109 | Sample 110 | Sample 111 |
|---|---|---|---|---|---|---|---|---|---|---|---|
| Minimum density (fogging density) | 0.28 | 0.27 | 0.25 | 0.26 | 0.25 | 0.21 | 0.19 | 0.18 | 0.18 | 0.17 | 0.17 |
| Relative sensitivity | 100 | 91 | 114 | 125 | 108 | 139 | 114 | 96 | 88 | 135 | 147 |
| Maximum color density | 1.99 | 2.01 | 2.15 | 2.05 | 2.08 | 2.39 | 2.11 | 2.26 | 2.31 | 2.44 | 2.48 |
| Contrast | 0.59 | 0.60 | 0.71 | 0.61 | 0.63 | 0.82 | 0.64 | 0.81 | 0.85 | 0.91 | 0.96 |
| Remarks | Comparative | Comparative | Comparative | Comparative | Comparative | This invention | Comparative | Comparative | Comparative | This invention | This invention |

*Sensitivity was represented in terms of a relative value assuming the sensitivity of Sample 101 to be 100.

The results obtained reveal the effects of the invention.

In comparison of Samples 101–103, a tendency of increasing sensitivity is recognized by doping with the binuclear complex compounds for use in the present invention, but the effect is not sufficient. From the results of Samples 104–111 where the tabular particles having a particle thickness of not more than 0.3 μm and a high aspect ratio were used, the followings can be understood. That is, Samples 104, 105, 107, 108 and 109 using Emulsions A-4r, A-5r, A-7r, A-8r and A-9r, respectively, wherein the metal complex dopant for use in of the present invention was not used, show low sensitivity and low contrast. On the other hand, Samples 106, 110 and 111 using Emulsions A-6r, A-10r and A-11r, respectively, wherein the binuclear metal complex dopant for use in the present invention was used, can give quite high sensitivity and quite high contrast.

The effects of the present invention are recognized more remarkably in the emulsions having a thinner particle thickness.

Example 2

An emulsion was prepared in the same manner as Emulsion A-7 prepared in Example 1, except that 0.04 mg of potassium hexachloroiridate (IV) were added at the same time of addition of sodium benzenethiosulfinate, and that 8.9 mg of potassium hexacyanoferrate (II) was added to the aqueous solution of potassium bromide, which was added at the last of the grain formation. The emulsion was designated as Emulsion B-1o.

By changing the amounts of silver nitrate and potassium bromide that were added at the first of the formation of grains, the number of nuclei to be formed was changed from those adopted in the case of Emulsion B-1o, to prepare Emulsion B-1m, comprising hexagonal tabular grains having an average grain size of 0.75 μm in terms of diameter equivalent to a sphere, an average grain thickness of 0.11 μm, and an average aspect ratio of 14.0, and Emulsion B-1u, comprising hexagonal tabular grains having an average grain size of 0.52 μm in terms of diameter equivalent to a sphere, an average grain thickness of 0.09 μm, and an average aspect ratio of 11.3. In these cases, the amounts of potassium hexachloroiridate (IV) and potassium hexacyanoferrate (II) were changed in inverse proportion to the volume of grains, and the amount of sodium p-iodoacetoamidobenzenesulfonate monohydrate to be added was changed in proportion to the circumferential length of an individual grain.

To each of these emulsions, 5.6 ml of an aqueous 1% potassium iodide solution was added at 40° C., and then were added the spectrally-sensitizing dye, the compound I, potassium thiocyanate, chloroauric acid, sodium thiosulfate, and mono(pentafluorophenyl)diphenyl-phosphineselenide, used in Example 1, to carry out spectral sensitization and chemical sensitization. The amount of the spectrally-sensitizing dye to be added was changed in accordance with the surface area of a grain, based on Emulsion A-3r in Example 1, and the amount of the chemical sensitizer to be added was controlled to be optimal in each emulsion. After the chemical sensitization was completed, a stabilizer S was added, with its amount changed in accordance with the surface area of a grain, based on Emulsion A-3r of Example 1. The resulting emulsions were designated as Emulsions B-1or, B-1mr and B-1ur.

Similarly, by changing the spectrally-sensitizing dye to green-sensitizing dyes and to a blue-sensitizing dye, as shown below, respectively, green-sensitive emulsions B-1og, B-1mg, and B-1ug, and blue-sensitive emulsions B-1ob, B-1mb and B-1ub, were prepared, respectively.

Sensitizing dye I for green-sensitive emulsion

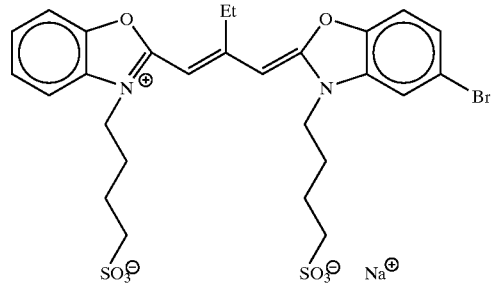

Sensitizing dye II for green-sensitive emulsion

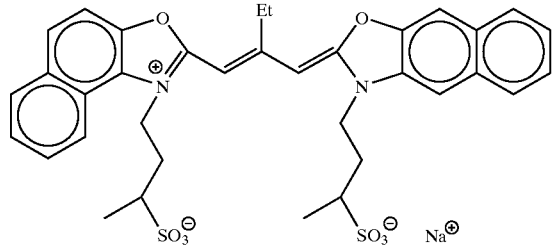

-continued

Sensitizing dye III for green-sensitive emulsion

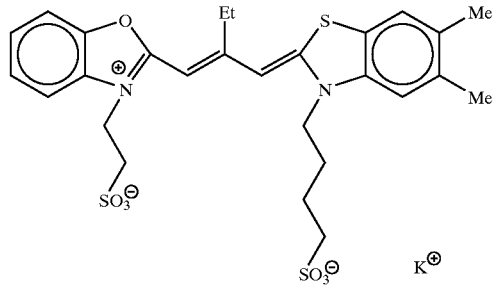

A mixture in 75:18:7 (molar ratio) of the above

Blue-sensitive sensitizing dye

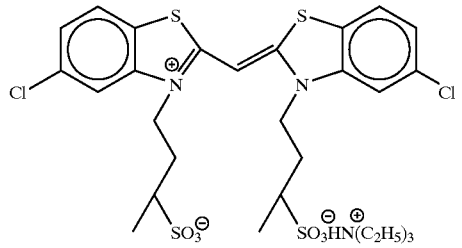

Separately, an emulsion was prepared in the same manner as Emulsion A-10 prepared in Example 1, except that 0.04 mg of potassium hexachloroiridate (IV) were added at the same time of addition of sodium benzenethiosulfinate, and that 8.9 mg of potassium hexacyanoferrate (II) was added to the aqueous solution of potassium bromide, which was added at the last of the grain formation. The emulsion was designated as Emulsion B-2o.

By changing the amounts of silver nitrate and potassium bromide that were added at the first of the formation of grains, the number of nuclei to be formed was changed from those adopted in the case of Emulsion B-2o, to prepare Emulsion B-2m, comprising hexagonal tabular grains having an average grain size of 0.75 $\mu$m in terms of a diameter equivalent to a sphere, an average grain thickness of 0.11 $\mu$m, and an average aspect ratio of 14.0, and Emulsion B-2u, comprising hexagonal tabular grains having an average grain size of 0.52 $\mu$m in terms of a diameter equivalent to a sphere, an average grain thickness of 0.09 $\mu$m, and an average aspect ratio of 11.3. In these cases, the amounts to be added of potassium hexachloroiridate (IV), potassium hexacyanoferrate (II), and $[(H_3N)_5Ru(4,4'\text{-bpy})Ru[(NH_3)_5]^{4+}$, were changed in inverse proportion to the volume of grains, and the amount of sodium p-iodoacetoamidobenzenesulfonate monohydrate to be added was changed in proportion to the circumferential length of a grain.

To each of these emulsions, 5.6 ml of an aqueous 1% potassium iodide solution was added at 40° C., and then were added the spectrally-sensitizing dye, the compound I, potassium thiocyanate, chloroauric acid, sodium thiosulfate, and mono(pentafluorophenyl)diphenyl-phosphineselenide, used in Example 1, to carry out spectral sensitization and chemical sensitization. The amount of the spectrally-sensitizing dye to be added was changed in accordance with the surface area of a grain, based on Emulsion A-4r in Example 1, and the amount of the chemical sensitizer to be added was controlled to be optimal in each emulsion. After the chemical sensitization was completed, the stabilizer S was added, with its amount changed in accordance with the surface area of a grain, based on Emulsion A-4r of Example 1. The resulting emulsions were designated as Emulsions B-2or, B-2mr and B-2ur.

Similarly, by changing the spectrally-sensitizing dye to a green-sensitizing dye and to a blue-sensitizing dye, respectively, green-sensitive emulsions B-2og, B-2mg, and B-2ug, and blue-sensitive emulsions B-2ob, B-2mb and B-2ub, were prepared.

A group of emulsions were prepared in the same manner as in Emulsions B-2or, B-2mr, B-2ur, B-2og, B-2mg, B-2ug, B-2ob, B-2mb, and B-2ub, except for changing the polynuclear complex as defined in the present invention that was added at the last stage for the particle formation to $[(bpy)_2Ru(2,5\text{-dppz})Ru(bpy)_2]^{4+}$ (2,5-dppz=2,5-bispyridylpyrazine), which was added in the amount that would be the same mol of $[(H_3N)_5Ru(4,4'\text{-bpy})Ru[(NH_3)_5]^{4+}$ to silver for individual particle. These emulsions were referred to as Emulsions B-3or, B-3mr, B-3ur, B-3og, B-3mg, B-3ug, B-3ob, B-3mb, and B-3ub, respectively.

Further, a group of emulsions were prepared in the same manner as in Emulsions B-2or, B-2mr, B-2ur, B-2og, B-2mg, B-2ug, B-2ob, B-2mb, and B-2ub, except for changing the polynuclear complex as defined in the present invention that was added at the last stage for the particle formation to $[(cyc)Ru(2,5\text{-dppz})Ru(cyc)]^{4+}$ (cyc=1,4,8,11-tetraazacyclotetradecane), which was added in the amount that would be the same mol of $[(H_3N)_5Ru(4,4'\text{-bpy})Ru[(NH_3)_5]^{4+}$ to silver for individual particle. These emulsions were referred to as Emulsions B-4or, B-4mr, B-4ur, B-4og, B-4mg, B-4ug, B-4ob, B-4mb, and B-4ub, respectively.

Separately, an emulsified dispersion containing a yellow coupler and a built-in developing agent was prepared in the same manner as the cyan coupler dispersion in Example 1.

8.95 g of Yellow coupler (m), 7.26 g of Developing agent (n), 1.47 g of Developing agent (c), 0.17 g Antifogging agent (d), 0.28 g of Antifogging agent (o), 18.29 g of High-boiling organic solvent (p), and 50.0 ml of ethyl acetate were dissolved at a temperature of 60° C. The resulting solution was mixed with 200 g of an aqueous solution containing 18.0 g of lime-processed gelatin and 0.8 g of sodium dodecylbenzenesulfonate dissolved therein, and the resultant mixture was emulsified and dispersed at 10,000 rpm for 20 minutes using a dissolver stirrer. After the dispersion, distilled water was added to bring the total weight to 300 g, and they were mixed at 2,000 rpm for 10 minutes.

A dispersion of a magenta coupler was prepared in the same manner.

7.65 g of Magenta coupler (q), 1.12 g of Magenta coupler (r), 8.13 g of Developing agent (b), 1.05 g of Developing agent (c), 0.11 g of Antifogging agent (d), 7.52 g of High-boiling organic solvent (e), and 38.0 ml of ethyl acetate were dissolved at a temperature of 60° C. The resulting solution was mixed with 150 g of an aqueous solution containing 12.2 g of lime-processed gelatin and 0.8 g of sodium dodecylbenzenesulfonate dissolved therein, and the resultant mixture was emulsified and dispersed at 10,000 rpm for 20 minutes using a dissolver stirrer. After the dispersion, distilled water was added to bring the total weight to 300 g, and they were mixed at 2000 rpm for 10 minutes.

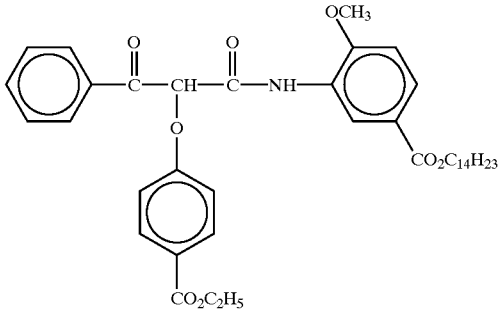

Yellow coupler (m)

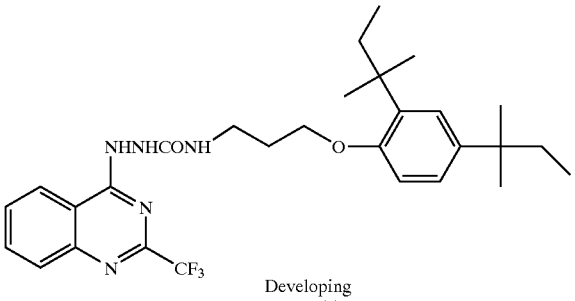

Developing agent (n)

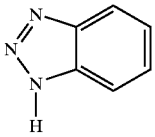

Antifoggant (o)

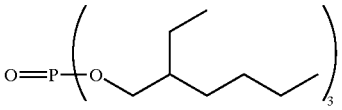

High-boiling organic solvent (p)

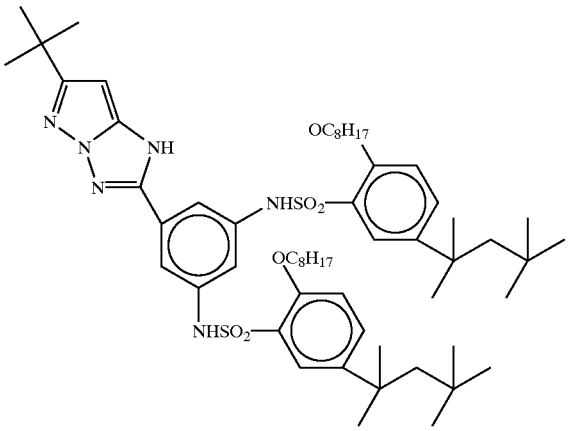

Magenta coupler (q)

-continued

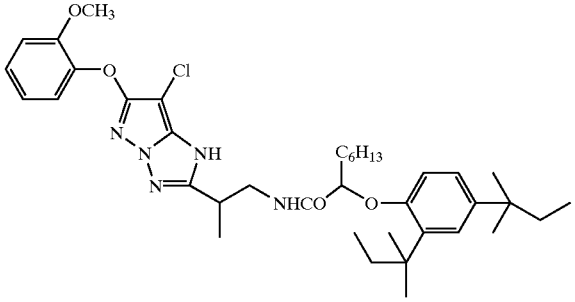

Magenta coupler (r)

Further, a dispersion of dye to color an intermediate layer as a filter layer was prepared in the same manner.

The dye and the high-boiling organic solvent used to disperse the dye are shown below.

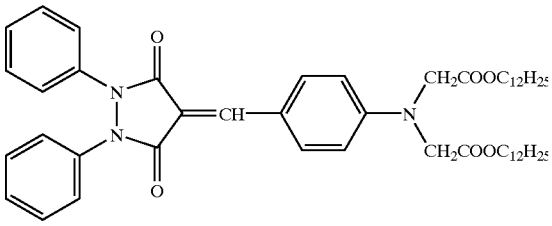

Yellow dye (t)

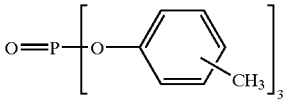

and

EMPARA K65, Trade name, manufactured by Ajinomoto K.K.

High-boiling organic solvent (u)
A mixture in 1:1 of

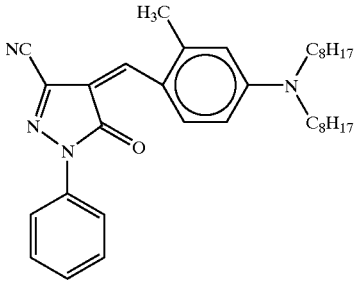

Magenta dye (v)

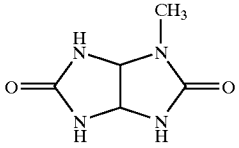

Formalin scavenger (s)

Samples 201 to 204 of a multi-layer color photographic light-sensitive material were prepared by coating, in combination, these dispersions and the silver halide emulsions prepared in the above, on a support, to have the compositions shown in Table 6.

TABLE 6

| | | Sample 201 | Sample 202 | Sample 203 | Sample 204 |
|---|---|---|---|---|---|
| Protective layer | Lime-processed gelatin | 914 | 914 | 914 | 914 |
| | Matting agent(silica) | 50 | 50 | 50 | 50 |
| | Surfactant(i) | 30 | 30 | 30 | 30 |
| | Surfactant(j) | 40 | 40 | 40 | 40 |
| | Water soluble polymer(k) | 15 | 15 | 15 | 15 |
| | Hardener(l) | 110 | 110 | 110 | 110 |
| Intermediate layer | Lime-processed gelatin | 461 | 461 | 461 | 461 |
| | Surfactant(j) | 5 | 5 | 5 | 5 |
| | Zinc hydroxide | 340 | 340 | 340 | 340 |
| | Formalin scavenger(s) | 300 | 300 | 300 | 300 |
| | Water soluble polymer(k) | 15 | 15 | 15 | 15 |
| Yellow color-forming layer (high-sensitivity layer) | Lime-processed gelatin | 1750 | 1750 | 1750 | 1750 |
| | Emulsion(in terms of coating amount of silver) | B-1 ob 525 | B-2 ob 525 | B-3 ob 525 | B-4 ob 525 |
| | Yellow coupler(m) | 298 | 298 | 298 | 298 |
| | Developing agent(n) | 242 | 242 | 242 | 242 |
| | Developing agent(c) | 50 | 50 | 50 | 50 |
| | Antifogging agent(d) | 5.8 | 5.8 | 5.8 | 5.8 |
| | Antifogging agent(o) | 9.5 | 9.5 | 9.5 | 9.5 |
| | High-boiling organic solvent(p) | 500 | 500 | 500 | 500 |
| | Surfactant(f) | 27 | 27 | 27 | 27 |
| | Water soluble polymer(k) | 1 | 1 | 1 | 1 |
| Yellow color-forming layer (medium-sensitivity layer) | Lime-processed gelatin | 1400 | 1400 | 1400 | 1400 |
| | Emulsion(in terms of coating amount of silver) | B-1 mb 211 | B-2 mb 211 | B-3 mb 211 | B-4 mb 211 |
| | Yellow coupler(m) | 277 | 277 | 277 | 277 |
| | Developing agent(n) | 225 | 225 | 225 | 225 |
| | Developing agent(c) | 46 | 46 | 46 | 46 |
| | Antifogging agent(d) | 5.3 | 5.3 | 5.3 | 5.3 |
| | Antifogging agent(o) | 8.8 | 8.8 | 8.8 | 8.8 |
| | High-boiling organic solvent(p) | 566 | 566 | 566 | 566 |
| | Surfactant(f) | 25 | 25 | 25 | 25 |
| | Water soluble polymer(k) | 2 | 2 | 2 | 2 |
| Yellow color-forming layer (low-sensitivity layer) | Lime-processed gelatin | 1400 | 1400 | 1400 | 1400 |
| | Emulsion(in terms of coating amount of silver) | B-1 ub 250 | B-2 ub 250 | B-3 ub 250 | B-4 ub 250 |
| | Yellow coupler(m) | 277 | 277 | 277 | 277 |
| | Developing agent(n) | 225 | 225 | 225 | 225 |
| | Developing agent(c) | 46 | 46 | 46 | 46 |
| | Antifogging agent(d) | 5.3 | 5.3 | 5.3 | 5.3 |
| | Antifogging agent(o) | 8.8 | 8.8 | 8.8 | 8.8 |
| | High-boiling organic solvent(p) | 566 | 566 | 566 | 566 |
| | Surfactant(f) | 25 | 25 | 25 | 25 |
| | Water soiuble polymer(k) | 2 | 2 | 2 | 2 |
| Intermediate layer (yellow filter layer) | Lime-processed gelatin | 560 | 560 | 560 | 560 |
| | Surfactant(f) | 15 | 15 | 15 | 15 |
| | Surfactant(j) | 24 | 24 | 24 | 24 |
| | dye(t) | 85 | 85 | 85 | 85 |
| | High-boiling organic solvent(u) | 85 | 85 | 85 | 85 |
| | Zinc hydroxide | 125 | 125 | 125 | 125 |
| | Water soluble polymer(k) | 15 | 15 | 15 | 15 |
| Magenta color-forming layer (high-sensitivity layer) | Lime-processed gelatin | 781 | 781 | 781 | 781 |
| | Emulsion(in terms of coating amount of silver) | B-1 og 892 | B-2 og 892 | B-3 og 892 | B-4 og 892 |
| | Magenta coupler(q) | 80 | 80 | 80 | 80 |
| | Magenta coupler(r) | 12 | 12 | 12 | 12 |
| | Developing agent(b) | 85 | 85 | 85 | 85 |
| | Developing agent(c) | 11 | 11 | 11 | 11 |
| | Antifogging agent(d) | 1.2 | 1.2 | 1.2 | 1.2 |
| | High-boiling organic solvent(e) | 79 | 79 | 79 | 79 |
| | Surfactant(f) | 8 | 8 | 8 | 8 |
| | Water soluble polymer(k) | 8 | 8 | 8 | 8 |

TABLE 6-continued

| | | Sample 201 | Sample 202 | Sample 203 | Sample 204 |
|---|---|---|---|---|---|
| Magenta color-forming layer (medium-sensitivity layer) | Lime-processed gelatin | 659 | 659 | 659 | 659 |
| | Emulsion | B-1 mg 669 | B-2 mg 669 | B-3 mg 669 | B-4 mg 669 |
| | Magenta coupler(q) | 103 | 103 | 103 | 103 |
| | Magenta coupler(r) | 15 | 15 | 15 | 15 |
| | Developing agent(b) | 110 | 110 | 110 | 110 |
| | Developing agent(c) | 14 | 14 | 14 | 14 |
| | Antifogging agent(d) | 1.5 | 1.5 | 1.5 | 1.5 |
| | High-boiling organic solvent(e) | 102 | 102 | 102 | 102 |
| | Surfactant(f) | 11 | 11 | 11 | 11 |
| | Water soluble polymer(k) | 14 | 14 | 14 | 14 |
| Magenta color-forming layer (low-sensitivity layer) | Lime-processed gelatin | 711 | 711 | 711 | 711 |
| | Emulsion | B-1 ug 235 | B-2 ug 235 | B-3 ug 235 | B-4 ug 235 |
| | Magenta coupler(q) | 274 | 274 | 274 | 274 |
| | Magenta coupler(r) | 40 | 40 | 40 | 40 |
| | Developing agent(b) | 291 | 291 | 291 | 291 |
| | Developing agent(c) | 38 | 38 | 38 | 38 |
| | Antifogging agent (d) | 3.9 | 3.9 | 3.9 | 3.9 |
| | High-boiling organic solvent(e) | 269 | 269 | 269 | 269 |
| | Surfactant(f) | 29 | 29 | 29 | 29 |
| | Water soluble polymer(k) | 14 | 14 | 14 | 14 |
| Intermediate layer (magenta filter layer) | Lime-processed gelatin | 850 | 850 | 850 | 850 |
| | Surfactant(f) | 15 | 15 | 15 | 15 |
| | Surfactant(j) | 24 | 24 | 24 | 24 |
| | Dye(v) | 200 | 200 | 200 | 200 |
| | High-boiling organic solvent(h) | 200 | 200 | 200 | 200 |
| | Formalin scavenger(s) | 300 | 300 | 300 | 300 |
| | Zinc hydroxide | 2028 | 2028 | 2028 | 2028 |
| | Water soluble polymer(k) | 15 | 15 | 15 | 15 |
| Cyan color-forming layer (high sensitivity layer) | Lime-processed gelatin | 842 | 842 | 842 | 842 |
| | Emulsion | B-1 or 1040 | B-2 or 1040 | B-3 or 1040 | B-4 or 1040 |
| | Cyan coupler(a) | 64 | 64 | 64 | 64 |
| | Developing agent(b) | 75 | 75 | 75 | 75 |
| | Developing agent(c) | 6 | 6 | 6 | 6 |
| | Antifogging agent(d) | 0.9 | 0.9 | 0.9 | 0.9 |
| | High-boiling organic solvent(e) | 49 | 49 | 49 | 49 |
| | Surfactant(f) | 5 | 5 | 5 | 5 |
| | Water soluble polymer(k) | 18 | 18 | 18 | 18 |
| Cyan color-forming layer (medium-sensitivity layer) | Lime-processed gelatin | 475 | 475 | 475 | 475 |
| | Emulsion | B-1 mr 602 | B-2 mr 602 | B-3 mr 602 | B-4 mr 602 |
| | Cyan coupler(a) | 134 | 134 | 134 | 134 |
| | Developing agent(b) | 102 | 102 | 102 | 102 |
| | Developing agent(c) | 13 | 13 | 13 | 13 |
| | Antifogging agent(d) | 1.9 | 1.9 | 1.9 | 1.9 |
| | High-boiling organic solvent(e) | 103 | 103 | 103 | 103 |
| | Surfactant(f) | 10 | 10 | 10 | 10 |
| | Water soluble polymer(k) | 15 | 15 | 15 | 15 |
| Cyan color-forming layer (low-sensitivity layer) | Lime-processed gelatin | 825 | 825 | 825 | 825 |
| | Emulsion | B-1 ur 447 | B-2 ur 447 | B-3 ur 447 | B-4 ur 447 |
| | Cyan coupler(a) | 234 | 234 | 234 | 234 |
| | Developing agent(b) | 179 | 179 | 179 | 179 |
| | Developing agent(c) | 23 | 23 | 23 | 23 |
| | Antifogging agent(d) | 3.3 | 3.3 | 3.3 | 3.3 |
| | High-boiling organic solvent(e) | 179 | 179 | 179 | 179 |
| | Surfactant(f) | 17 | 17 | 17 | 17 |
| | Water soluble polymer(k) | 10 | 10 | 10 | 10 |
| Antihalation layer | Lime-processed gelatin | 440 | 440 | 440 | 440 |
| | Surfactant(f) | 14 | 14 | 14 | 14 |
| | Dye(g) | 260 | 260 | 260 | 260 |
| | High-boiling organic solvent(h) | 260 | 260 | 260 | 260 |
| | Water soluble polymer(k) | 15 | 15 | 15 | 15 |
| Transparent PET Base (96 $\mu$m) | | | | | |

*Figure represents the coating amount (mg/m$^2$)

Test specimens were cut from these light-sensitive materials, and exposed to light at an intensity of 200 lux for 1/100 seconds through an optical wedge, in the same condition as in Example 1.

15 ml/m of 40° C. hot water was supplied to the surface of the light-sensitive material after the exposure. The film surfaces of the test specimen and the processing material P-1 were overlapped to put together, and thereafter they were subjected to thermal development at 86° C. for 17 seconds using a heat drum. 10 ml/m of water was applied to the surface of the light-sensitive material from which P-1 had been peeled off. A processing material P-2 was overlapped on the surface of the light-sensitive material to put together, and they were further heated at 50° C. for 30 seconds.

On the test specimen of the light-sensitive material that was peeled from the processing material, a gray color-developed image corresponding to the exposure had been formed. The R-, G- and B-transmission density of the color-developed test specimen obtained after the thermal development was measured, to make so-called characteristic curves, from which minimum density (fog density), relative sensitivity, and contrast, corresponding to each of blue-, green-, and red-sensitive layers were calculated. As to the sensitivity, the reciprocal of exposure amount giving a density higher by 0.15 than the minimum density after the processing, in terms of optical density, was determined as the sensitivity, and the sensitivity found was shown in terms of relative value by assuming the sensitivity of each layer of the sample 201 to be 100. Contrast was expressed by an inclination (γ) between the point where the sensitivity was calculated and the point where the density was 2.0 on the characteristic curve.

The results are shown in Table 7.

TABLE 7

| | Sample 201 | | | Sample 202 | | | Sample 203 | | | Sample 204 | | |
|---|---|---|---|---|---|---|---|---|---|---|---|---|
| | B | G | R | B | G | R | B | G | R | B | G | R |
| Minimum density (Fogging density) | 0.41 | 0.30 | 0.22 | 0.37 | 0.27 | 0.21 | 0.34 | 0.26 | 0.20 | 0.32 | 0.24 | 0.20 |
| Relative sensitivity | 100 | 100 | 100 | 110 | 109 | 111 | 115 | 118 | 119 | 117 | 121 | 134 |
| Contrast | 0.45 | 0.59 | 0.61 | 0.50 | 0.67 | 0.72 | 0.58 | 0.73 | 0.87 | 0.62 | 0.80 | 0.94 |
| Remarks | | Comparative example | | | This invention | | | This invention | | | This invention | |

In view of the results, the effects of the present invention are apparently shown even in multi-layer color photographic photosensitive materials. More precisely, in comparison of Sample 201 with Samples 202–204, it can be understood that Sample 201 composed of an emulsion wherein the metal complex dopant for use in the present invention was not used resulted low sensitivity and low contrast, while Samples 202–204 composed of the emulsion wherein the metal complex dopant for use in the present invention was used could give quite high sensitivity and quite high contrast.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide photographic emulsion, which comprises silver halide particles containing a polynuclear metal complex in which an organic compound is contained as a bridging ligand, wherein the amount of complex compound is within the range of $1\times10^{-7}$ mol or more and not more than $1\times10^{-3}$ mol, per mol of silver halide, and wherein 50% or more of a projected area of the particles is occupied by tabular particles having a particle thickness of 0.3 μm or less, wherein the polynuclear metal complex in which an organic compound is contained as a bridging ligand is a compound represented by the following formula A:

$$[L'_nM(L(ML'_m)_j)_k]^l \qquad \text{Formula A}$$

wherein M represents an arbitrary metal or metal ion, and all of Ms may be the same metal species or Ms may be a different metal species; L is a bridging ligand and represents an organic compound capable of bridging two or more metals or metal ions; L' represents an inorganic compound of no electric charge having atoms of 8 or less, an arbitrary organic compound, or an arbitrary inorganic anion, and all of L's may be the same chemical species or L's may be a different chemical species, with the proviso that when some of the L's are arbitrary inorganic anions, the inorganic anions occupy not more than half of coordinate sites out of the coordinate sites of one metal; n is an integer of 1 to 5, m is an integer of 0 to 5, j is an integer of 1 to 4, k is an integer of 1 or more and l represents an electric charge of the whole complex.

2. The silver halide photographic emulsion according to claim 1, wherein 50% or more of the projected area is occupied by tabular particles having a particle thickness of 0.2 μm or less.

3. The silver halide photographic emulsion according to claim 1, wherein, in the polynuclear metal complex, L' in the formula A is a heterocyclic compound or a compound selected from $H_2O$, $NH_3$ or $PH_3$.

4. The silver halide photographic emulsion according to claim 3, which contains the polynuclear metal complex in which the bridging ligand L in the formula A is a saturated or unsaturated hydrocarbon having a cyano group, or a heterocyclic compound, or a compound represented by the following formula B or C:

Formula B

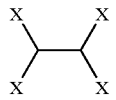

wherein Xs may be the same or different and each represent an oxygen atom, a sulfur atom, a hydroxyl group, a cyano group, an amino group or a nitro group; each bond in the formula may be a single bond or a double bond so far as the octet rule is not disturbed; and a bond between the carbon atoms to which two coordinating substituents are respectively bonded may be replaced with a benzene ring;

Y–R Formula C wherein Y represents an oxygen atom or a sulfur atom, and R represents an alkyl group or an aromatic group.

5. The silver halide photographic emulsion according to claim 4, which contains the polynuclear metal complex (a binuclear or trinuclear metal complex), in which L in the formula A represents an organic compound bridging two or three metals or metal ions, and j and k each are 1 or 2.

6. The silver halide photographic emulsion according to claim 5, which contains the binuclear or trinuclear metal complex, in which L' in the formula A is a compound selected from a nitrogen-containing heterocyclic compound, an oxygen-containing heterocyclic compound, a sulfur-containing heterocyclic compound or $NH_3$.

7. The silver halide photographic emulsion according to claim 1, wherein the polynuclear metal complex to be contained is a complex having magnesium, calcium, strontium, barium, iron, cobalt, nickel, ruthenium, rhodium, palladium, osmium, iridium, platinum, zinc, cadmium or mercury, as a central metal thereof.

8. The silver halide photographic emulsion according to claim 1, which contains a binuclear or trinuclear metal complex, in which L' in the formula A is 2,2'-bipyridine, 1,10-phenanthroline, 1,4,8,11-tetraazacyclotetradecane, or a derivative thereof.

9. The silver halide photographic emulsion according to claim 1, wherein the silver halide particles contained in the emulsion contain a binuclear or trinuclear metal complex represented by the following formula D, E or F:

$$[(NH_3)_5MLM(NH_3)_5]^{n} \quad \text{Formula D}$$

wherein M represents an ion of a metal selected from iron, ruthenium and cobalt, with the proviso that two Ms may be the same metal ion or different; L represents a bridging ligand that is a compound selected from dicyano compounds, cyanopyridines, pyrazines and 4,4'-bipyridines; and n represents 4, 5 or 6;

$$[(bpy)_2X_mMLMX_m(bpy)_2]^{l} \quad \text{Formula E}$$

$$[(cyc)X_mMLMX_m(cyc)]^{l} \quad \text{Formula F}$$

wherein, in formulas E and F, M represents an ion of a metal selected from ion, ruthenium, cobalt, manganese, rhodium and iridium, with the proviso that two Ms may be the same metal ion or different; L represents a bridging ligand selected from pyrazines, 4,4'-bipyridines, 2,2'-bipyrimidines, 2,2'-biimidazoles, 2,2'-bibenzimidazoles and 2,5-bis(2-pyridyl) pyrazines, bpy represents 2,2'-bipyridine, cyc represents 1,4,8,11-tetraazacyclotetradecane, X represents $Cl^-$, $H_2O$, $CH_3OH$, $C_2H_5OH$ or $CH_3CN$; m is 1 when L is coordinated unidentately to one of the metal ions, or m is zero (0) when L is coordinated bidentately; and l represents 4, 5 or 6.

10. The silver halide photographic emulsion according to claim 1, wherein the surface layer of the silver halide particles is being doped with the polynuclear metal complex.

11. The silver halide photographic emulsion according to claim 1, which is a silver bromide, silver chlorobromide or silver iodobromide emulsion.

12. A silver halide photographic light-sensitive material, which has the silver halide emulsion according to claim 1, on a support.

13. The silver halide photographic light-sensitive material according to claim 12, which is a heat-developable color photographic light-sensitive material.

14. The silver halide photographic light-sensitive material according to claim 12, wherein, in the silver halide emulsion, the surface layer of the silver halide particles is being doped with the polynuclear metal complex.

15. The silver halide photographic light-sensitive material according to claim 12, wherein the silver halide emulsion is a silver bromide, silver chlorobromide or silver iodobromide emulsion.

16. A method for forming a color image, comprising:

subjecting the light-sensitive material as claimed in claim 12, to exposure image-wise, attaching the light-sensitive material to a processing material face to face each other in the state that water equivalent to one-tenth to one-fold as much as that required for maximally swelling all the coated films of the light-sensitive material and the processing material is maintained between the light-sensitive material and the processing material, and heating the processing material and the light-sensitive material at a temperature of 60° C. or higher but 100° C. or lower for a time period of 5 seconds or more but 60 seconds or less, thereby forming an image in the light-sensitive material, wherein the processing material has a composition layer including a processing layer containing a base and/or a base precursor, applied on a support.

17. A silver halide color photographic light-sensitive material, which comprises at least, on a support, a silver halide emulsion, a developing agent, and a compound capable of forming a dye by coupling reaction with an oxidized product of the developing agent, wherein 50% or more of a projected area of silver halide particles contained in at least one of the silver halide emulsions is occupied by tabular particles having a particle thickness of 0.3 $\mu$m or less, wherein the silver halide particles contained in the emulsion contain a polynuclear metal complex in which an organic compound is contained as a bridging ligand, wherein the amount of complex compound is within the range of $1\times10^{-7}$ mol or more and not more than $1\times10^{-3}$ mol, per mol of silver halide, and wherein the polynuclear metal complex in which an organic compound is contained as a bridging ligand is a compound represented by the following formula A:

$$[L'_nM(L(ML'_m)_j)_k]^{l} \quad \text{Formula A}$$

wherein M represents an arbitrary metal or metal ion, and all of Ms may be the same metal species or Ms may be a different metal species; L is a bridging ligand and represents an organic compound capable of bridging two or more metals or metal ions; L' represents an inorganic compound of no electric charge having atoms of 8 or less, an arbitrary organic compound, or an arbitrary inorganic anion, and all of L's may be the same chemical species or L's may be a different chemical species, with the proviso that when some of the L's are arbitrary inorganic anions, the inorganic anions occupy not more than half of coordinate sites out of the coordinate sites of one metal; n is an integer of 1 to 5, m is an integer of 0 to 5, j is an integer of 1 to 4, k is an integer of 1 or more and l represents an electric charge of the whole complex.

18. The silver halide color photographic light-sensitive material according to claim 17, which comprises a compound represented by the following formula (I), (II), (III) or (IV), as the developing agent:

formula (I)

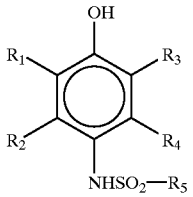

formula (II)

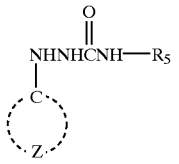

formula (III)

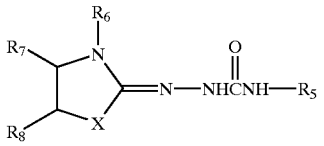

formula (IV)

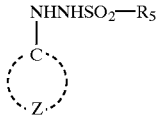

wherein $R_1$, $R_2$, $R_3$, and $R_4$ each represent a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents an alkyl group, an aryl group or a heterocyclic group; Z represents a group of atoms necessary to form, together with the C, an aromatic ring including a heteroaromatic ring, with the proviso that when Z is a group of atoms necessary to form, together with the C, a benzene ring, a total amount of Hammett constants ($\sigma$) of its substituent thereon is 1 or more; $R_6$ represents an alkyl group, X represents an oxygen atom, a sulfur atom, a selenium atom, or an alkyl-substituted or aryl-substituted tertiary nitrogen atom; $R_7$ and $R_8$ each represent a hydrogen atom or a substituent, or $R_7$ and $R_8$ may bond together to form a double bond or a ring; and each of the formulas (I), (II), (III), and (IV) contains at least one ballasting group having 8 or more carbon atoms, to impart oil-solubility to the molecule thereof.

* * * * *